US006863554B1

(12) United States Patent
Glad

(10) Patent No.: US 6,863,554 B1
(45) Date of Patent: Mar. 8, 2005

(54) PCMCIA COMPLIANT COMMUNICATIONS CONNECTORS

(75) Inventor: Paul H. Glad, Salt Lake City, UT (US)

(73) Assignee: Intel Corporation, Santa Clara, CA (US)

( * ) Notice: Subject to any disclaimer, the term of this patent is extended or adjusted under 35 U.S.C. 154(b) by 522 days.

(21) Appl. No.: 09/635,051

(22) Filed: Aug. 9, 2000

Related U.S. Application Data

(63) Continuation of application No. 09/251,391, filed on Feb. 17, 1999, now Pat. No. 6,773,291, which is a continuation-in-part of application No. 09/024,885, filed on Feb. 17, 1998, and a continuation-in-part of application No. 08/799,799, filed on Feb. 13, 1997, now Pat. No. 5,773,332, which is a continuation of application No. 08/402,084, filed on Mar. 10, 1995, now abandoned, which is a continuation-in-part of application No. 08/151,249, filed on Nov. 12, 1993, now Pat. No. 5,411,405.

(51) Int. Cl.[7] ..... H01R 23/02
(52) U.S. Cl. ..... 439/344
(58) Field of Search ..... 439/676, 131, 439/344

(56) References Cited

U.S. PATENT DOCUMENTS

| | | | |
|---|---|---|---|
| 1,989,823 | A | 2/1935 | Raabe |
| 3,433,886 | A | 3/1969 | Myers |
| 3,553,635 | A | 1/1971 | Lundergan et al. |
| 3,613,043 | A | 10/1971 | Scheller et al. |

(List continued on next page.)

FOREIGN PATENT DOCUMENTS

| | | |
|---|---|---|
| CA | 2101354 | 1/1994 |
| CA | 2103514 | 2/1994 |
| CA | 2070571 | 10/1994 |
| DE | 1 195 385 | 6/1965 |

(List continued on next page.)

OTHER PUBLICATIONS

"Wireless Physical Layer Standards" by Jan Boer, et al.—*The Global Magazine of Commercial Wireless Technology*, Oct. 1994, vol. 2, No. 10, pp. 15–17.

"Emerging Commercial Applications for Spread Spectrum Radio" by Jim K. Omura—*The Global Magazine of Commercial Wireless Technology*, Oct. 1994, vol. 2, No. 10, pp. 25, 26 and 28.

(List continued on next page.)

*Primary Examiner*—Neil Abrams
(74) *Attorney, Agent, or Firm*—Stuart A. Whittington

(57) ABSTRACT

An apparatus for conveying signals between a communications card and a signal utilization device or network. In one form (FIGS. 1,2), structures are provided for receiving one or more RJ series plugs and for making electrical connection with at the contacts on the plug and conveying any signals on the contacts to a communications device such as a telephone, facsimile machine, modem, or a local area network adapter. A body (102) includes one or more recesses (106) which receive the plug. An expandable and stretchable membrane (114) isolates the contacts in the plug from electrical contact with an object in a surrounding environment such that passage of current from one or more of the electrical contacts to an object present in the surrounding environment is prevented. Also provided (FIGS. 7, 14) is a replaceable direct access arrangement (151, 258) which is replaceably held within the communications device (150, 250). Both the structures providing the receptacles and the direct access arrangement are easily removable in case of damage or if other functions are desired. The replaceable direct access arrangement allows operation in countries having different telecommunications standards and allows operation with many different communications devices. Alternative structures for allowing connection to RJ series plugs are described. Wireless communication structures are also described.

57 Claims, 42 Drawing Sheets

U.S. PATENT DOCUMENTS 3,622,684 A 11/1971 Press et al.
3,685,002 A 8/1972 Kennedy
3,777,303 A 12/1973 McDonough
3,794,956 A 2/1974 Dubreuil
4,047,781 A 9/1977 DeNigris et al.
4,059,321 A 11/1977 Rasmussen et al.
4,103,985 A 8/1978 Krolak et al.
4,109,295 A 8/1978 Rostek et al.
4,225,209 A 9/1980 Hughes
4,241,974 A 12/1980 Hardesty
4,242,721 A 12/1980 Krolak et al.
4,303,296 A 12/1981 Spaulding
4,482,938 A 11/1984 Norden
4,497,526 A 2/1985 Myers
4,511,198 A 4/1985 Mitchell et al.
4,603,229 A 7/1986 Menchetti
4,611,875 A 9/1986 Clarke et al.
4,648,682 A 3/1987 Tubbs
4,679,879 A 7/1987 Triner et al.
4,734,043 A 3/1988 Emert et al.
4,758,168 A 7/1988 Awakowicz et al.
4,781,626 A 11/1988 Lazarchik
4,809,360 A 2/1989 Kraft
4,878,848 A 11/1989 Ingalsbe
4,944,698 A 7/1990 Siemon et al.
4,954,928 A 9/1990 Julien
4,968,260 A 11/1990 Ingalsbe
4,969,830 A 11/1990 Daly et al.
4,984,982 A 1/1991 Brownlie et al.
4,986,762 A 1/1991 Keith
4,993,962 A 2/1991 Noda et al.
4,997,381 A 3/1991 Oh
5,035,641 A 7/1991 Van-Santbrink et al.
5,035,649 A 7/1991 Collier et al.
5,038,250 A 8/1991 Uenaka et al.
5,043,721 A 8/1991 May
5,082,450 A 1/1992 Warren, Sr. et al.
5,085,591 A 2/1992 Warren, Sr. et al.
5,114,356 A 5/1992 Taybl et al.
5,122,069 A 6/1992 Brownlie et al.
5,132,877 A 7/1992 Branan et al.
5,159,533 A 10/1992 Kuang
5,182,698 A 1/1993 Kobyashi et al.
5,183,404 A * 2/1993 Aldous et al. ..... 439/131
5,196,994 A 3/1993 Tanuma et al.
5,242,310 A 9/1993 Leung
5,244,397 A 9/1993 Anhalt
5,260,994 A 11/1993 Suffi
5,285,014 A 2/1994 Gilchrist
5,296,692 A 3/1994 Shino
5,310,630 A 5/1994 Inagaki
5,319,516 A 6/1994 Perkins
5,336,099 A 8/1994 Aldous et al.
5,338,210 A 8/1994 Beckham et al.
5,385,479 A * 1/1995 Okada ..... 439/144
5,386,340 A 1/1995 Kurz
5,391,082 A * 2/1995 Airhart ..... 439/76.1
5,391,083 A 2/1995 Roebuck et al.
5,391,094 A 2/1995 Kakinoki et al.
5,395,268 A 3/1995 Okada
5,411,405 A 5/1995 McDaniels et al.
5,457,601 A 10/1995 Georgopulos et al.
5,470,237 A 11/1995 Byezek et al.
5,477,418 A 12/1995 MacGregor et al.
5,499,923 A 3/1996 Archibald et al.
5,505,628 A 4/1996 Ramey et al.
5,505,633 A 4/1996 Broadbent
5,509,811 A 4/1996 Homic
5,532,898 A 7/1996 Price
5,537,436 A 7/1996 Bottoms et al.
5,538,442 A * 7/1996 Okada ..... 439/676
5,547,401 A 8/1996 Aldous et al.
5,548,483 A 8/1996 Feldman
5,561,727 A 10/1996 Akita et al.
5,562,463 A * 10/1996 Tan ..... 439/76.1
5,562,504 A 10/1996 Moshayedi
5,608,606 A 3/1997 Blaney
5,608,607 A 3/1997 Dittmer
5,611,055 A 3/1997 Krishan et al.
5,619,396 A 4/1997 Gee et al.
5,628,055 A * 5/1997 Stein
5,634,802 A 6/1997 Kerklaan
5,637,018 A 6/1997 Gargiulo
5,679,013 A 10/1997 Matsunaga et al.
5,692,914 A 12/1997 Mitani et al.
5,702,271 A 12/1997 Steinman
5,735,715 A 4/1998 Olson
5,773,332 A * 6/1998 Glad ..... 439/344
5,775,951 A 7/1998 Gargiulo
5,912,806 A 6/1999 Onoda et al.
5,940,275 A 8/1999 Laity
5,984,731 A 11/1999 Laity
6,011,690 A 1/2000 Hughes et al.
6,012,953 A 1/2000 Francis
6,095,851 A 8/2000 Laity et al.
6,115,257 A 9/2000 Laity
6,116,962 A 9/2000 Laity
6,146,209 A 11/2000 Francis
6,164,989 A 12/2000 Glad et al.
6,183,308 B1 2/2001 Laity
6,488,542 B2 12/2002 Laity

FOREIGN PATENT DOCUMENTS

DE 29607724 U1 8/1996
EP 0355 385 7/1989
EP 0 729 206 8/1996
EP 0 793 310 3/1997
EP 0 917 254 5/1999
JP 62-78656 4/1987
JP 64-10585 7/1987
JP 64-10585 1/1989
JP 1-96055 6/1989
JP 1-97652 * 6/1989
JP 1-243384 9/1989
JP 2-90481 3/1990
JP 2-162667 6/1990
JP 3-36477 4/1991
JP 3-262069 11/1991
JP 3-292519 12/1991
JP 4-10748 1/1992
JP 4-51761 2/1992
JP 6-52923 7/1992
JP 6-61658 8/1992
JP 6-61659 8/1992
JP 05-250291 9/1993
JP 8-162233 6/1996
WO WO 94/17572 8/1994
WO WO 95/13633 5/1995
WO WO 99/41805 8/1999

OTHER PUBLICATIONS

Egghead Software Product Catalog, p. 16—"Maxtor DeskRunner desktop adapter"; Maxtor Mobile Max hard drive; "MobileMax PCMCIA flash memory card".

The PC Zone, vol. 17CD product catalog, p. 61—"Descartes Card Reader/Writer".

"PCMCIA Redefines Mobile Computing" by Earle J. Robinson–*P/C Computing*, Jul. 19993, pp. 238–248 and 252.

"Worldport Fax/Data PCMCIA 2.0 Modem" USRobotics.

"623K Telephone Jacks", by Molex, p. 61.
"616L Type Telephone Jacks" by Molex, p. 81.
"Unique Features for SRAM Card", one page.
Power Macintosh 4400 series user Manual, Apple Computer, Inc. 1997. pp. 1–60.
No Author, "In Services Digital Network (ISDN) Cable Terminator/Filter Device," Research Disclosure, Sep. 1990, No. 31788, Kenneth Mason Publications Ltd., England.

* cited by examiner

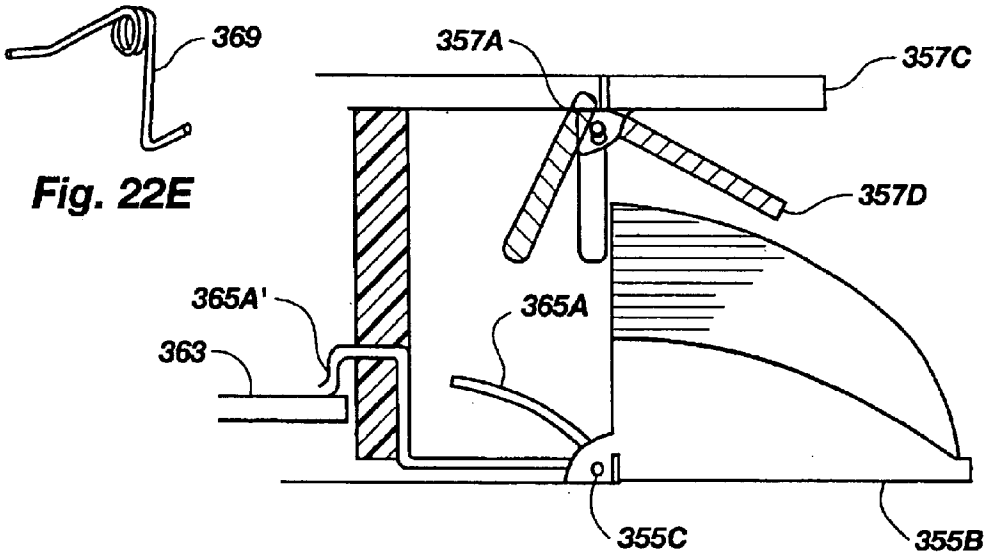
Fig. 22E
Fig. 22B
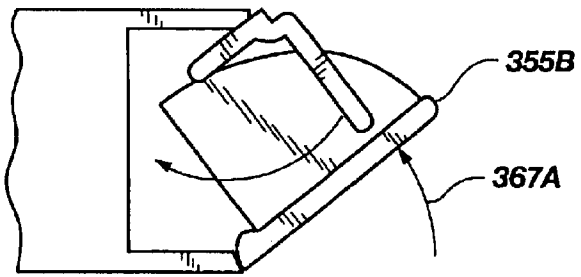
Fig. 22D
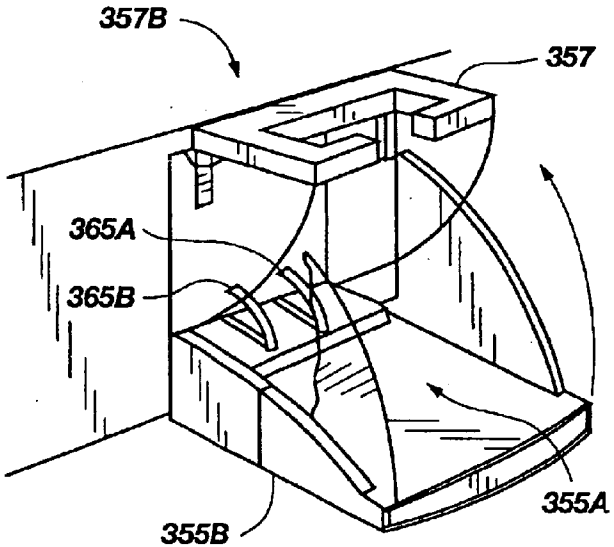
Fig. 22A
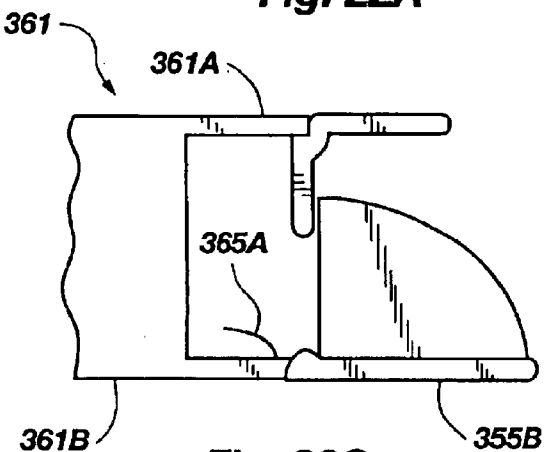
Fig. 22C

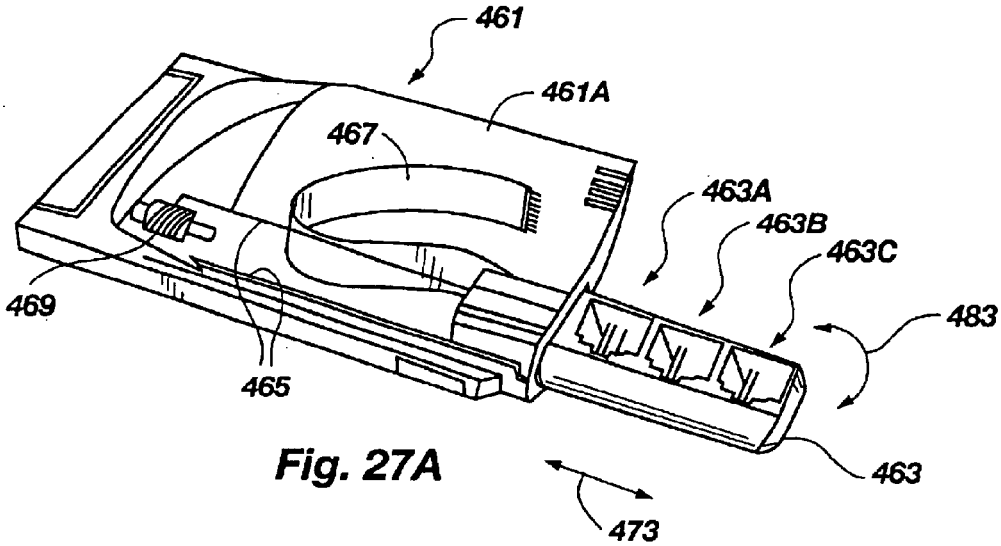
Fig. 27A
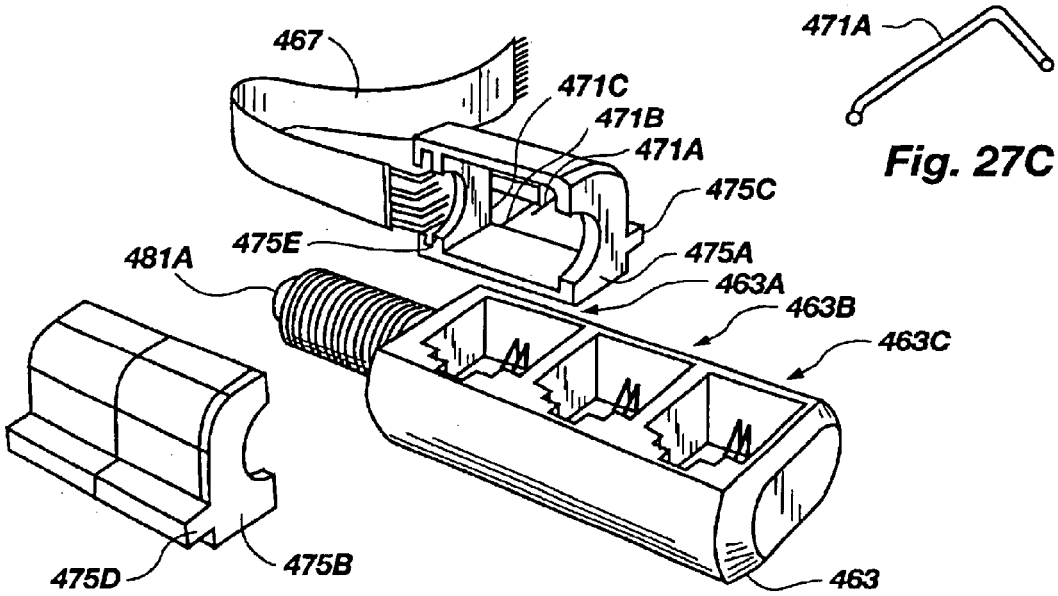
Fig. 27B
Fig. 27C
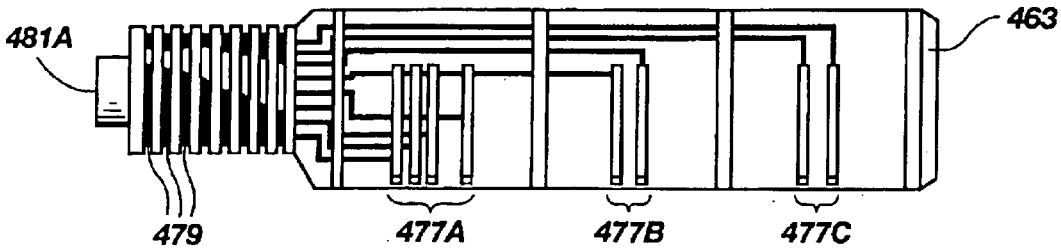
Fig. 27D 651
651A
34E
666A
666B
666C
653A
657A
657E
653B
657B
14
10
12
653C
657C
657D
657
659

655A
655B
655C
655D
655

665
663
661
11

PCMCIA COMPLIANT COMMUNICATIONS CONNECTORS

CROSS REFERENCE TO RELATED APPLICATIONS

This continuation application claims the benefit of priority under 35 U.S.C. § 120 to U.S. application serial number 09/251,391 (now U.S. Pat. No. 6,773,291) entitled Compliant Communications Connectors, filed Feb. 17, 1999, which is a continuation-in-part of U.S. application Ser. No. 09/024,885 entitled Versatile Communications Connectors filed on Feb. 17, 1998 and U.S. application Ser. No. 08/799,799 (now U.S. Pat. No. 5,773,332) entitled Adaptable Communications Connectors filed on Feb. 13, 1997, which in turn is a continuation of U.S. application Ser. No. 08/402,084 (now abandoned) filed on March 10, 1995 entitled Adaptable Communications Connectors, which is a continuation-in-part of U.S. patent application Ser. No. 08/151,249 (now U.S. Pat. No. 5,411,405) filed on Nov. 12, 1993 entitled Miniature Electrical Communications Connectors.

BACKGROUND

1. The Field of the Invention

This invention relates to electronic communication devices. More particularly, the present invention relates to connectors used to attach a communications line to a computer and which are compliant with one or more standards.

2. The Background Art

Telecommunications services have become an integral part of modern society. The number of telephones in the United States alone exceeds 150 million. Moreover, communications within an organization between people and machines further increases the size of the communications network. The vast majority of the communications devices now in use require a wired connection to a communications line. Such communications devices include, for example, telephones, facsimile machines, modems, and local area network (LAN) adapters. Wireless communications, however, are becoming more commonplace in many instances.

In order to conveniently attach a communications line to a communications device, standard connectors have been promulgated. The most popular of these connectors is known in the art as the RJ-xx series of connectors. Of the RJ-xx series of connectors, the RJ-11, RJ-12, and RJ-45 connectors are widely used. The RJ-11 connector comprises a six contact plug and a corresponding jack which is standardized in the industrialized world. The conventional six contact RJ-11 connector has the desirable attributes of having both low cost and high reliability.

The RJ-xx series of connectors, mostly the RJ-11 connector, is commonly used to attach a communications device such as a telephone, facsimile machine, or a modem (all of which may be integrated into a single device) to a communications line. Such devices are becoming smaller, so small that one or more dimensions of the customary RJ-11 jack, also referred to as a receptacle, is larger than a corresponding dimension of communications device. For example, communication devices which comply with the Personal Computer Memory Card International Association (PCMCIA), also referred to as PC Card, standards have dimensions of about 2.1 inches by about 3.4 inches with a thickness of only 3.5 mm, 5 mm, 8 mm, or 10.5 mm. Such small communications devices cannot incorporate customary RJ-xx series receptacles but still require compatibility with RJ-xx series plugs in order to attach to a communications line.

U.S. Pat. No. 5,183,404 to Aldous provides several schemes for providing a miniature RJ-11 compatible receptacle. Disadvantageously, many of the schemes set forth in Aldous leave the electrical contacts exposed to the surrounding environment. Thus, a user may come in contact with the electrical contacts of the plug, which in the U.S. may carry more than 80 volts. Further, since the contacts of the RJ-11 plug are exposed, the contacts may be inadvertently shorted together. Thus, the scheme included in the Aldous reference presents a danger of electrical shock and electrical short circuit. Moreover, some of the receptacle schemes disclosed in the Aldous reference are particularly prone to breakage and damage because of inherently weak structures.

Thus, it would be an advance in the art to provide a miniaturized communications connector which overcomes these drawbacks.

BRIEF SUMMARY AND OBJECTS OF THE INVENTION

In view of the above described state of the art, the present invention seeks to realize the following objects and advantages.

It is a primary object of the present invention to provide a communications line receptacle for use with a miniaturized communications device wherein the electrical contacts are shielded or isolated from the surrounding environment.

It is also an object of the present invention to provide a miniaturized communications line connector which is resistant to breakage and which can be stored out of the way when not being used.

It is a further object of the present invention to provide a communications line receptacle which is readily replaceable if broken.

It is another object of the present invention to provide a communications card which can be readily adapted to meet various communications standards.

It is a further object of the present invention to provide a communications card which can provide wireless communications.

It is yet another object of the present invention to provide communications line receptacles which allow one or more RJ-xx series plugs to be connected to a communications card while the external dimensions of the communications card meet an established standard when not being used and also such that the communications line receptacles occupy minimal space in the communications card.

These and other objects and advantages of the invention will become more fully apparent from the description and claims which follow, or may be learned by the practice of the invention.

The present invention provides an apparatus for receiving an RJ-xx series plug and making electrical connection with at least two conductors on the plug and conveying any signals on the conductors to a communications device such as a telephone, facsimile machine, modem, local area network adapter, or some other device.

The apparatus includes a body, also referred to as a body means. A recess, or recess means, is provided on the body.

In some embodiments the recess means preferably includes an open first end and a closed second end. In other embodiments, the recess means preferably includes open first and second ends. The recess means preferably has dimensions such that the plug is closely received therein. A means is also provided for releasably engaging the plug such that the plug is releasably held in the recess.

At least first and second electrical conductors are provided in the recess. Each of the electrical conductors are positioned such that they have electrical continuity with the electrical contacts in the plug when the plug is received into the recess. A means for conveying any electrical signal present on the electrical contacts to the communications device is also provided.

A replaceable direct access arrangement unit allows the communications card to be interfaced with telephone systems, or other communications systems, which may each require adherence to a different standard. When necessary, a user merely replaces an existing direct access arrangement unit with another direct access arrangement unit which is compatible with the wired telephone system or the wireless communications system that is available to the user.

Also preferably included with the recess means is an expandable means for isolating the contacts in the plug from electrical continuity with an object in a surrounding environment such that passage of current from one or more of the electrical contacts to an object present in the surrounding environment is prevented. The expandable means is located at the second end of the recess and is preferably a stretchable membrane. The expandable means expands to accommodate a plug received in the recess and tends to return, and can be returned by a user, to a position within the thickness of the body when not being used so the apparatus assumes a compact configuration.

Embodiments of the present invention include receptacle modules which receive an RJ-xx series plug. One preferred embodiment of the present invention includes a means for holding the body which receives the RJ-xx series plug. The means for holding the receptacle body or the receptacle module can be easily installed in and removed from the communications device by the user. The present invention allows the body to be retracted into and extended from the communications device while still allowing easy removal and replacement of the body making up the receptacle module. Another preferred embodiment of the present invention includes means for pivotally rotating the body into and out of the communications device such that the body is substantially entirely within the communications device when not being used and the body is rotated to a position where the recess which receives the plug is accessible to the user when desired.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIG. 22A is a detailed perspective view of another of RJ-xx series receptacle which can substitute for the pertinent structures represented in FIG. 22, the receptacle including a pivoting cover.

FIG. 22B is a elevated, side cross sectional view of the receptacle represented in FIG. 22A.

FIGS. 22C–D are diagrammatic side views showing the motion of the pivoting cover represented in FIGS. 22A–B.

FIG. 22E is a perspective view of a spring member which can be preferably used in the receptacle structure represented in FIGS. 22A–D.

FIG. 27A is a perspective view of another communications card in accordance with the present invention providing three RJ-xx series receptacles positioned on a rotatable and retractable member shown in an extended position.

FIG. 27B is an exploded perspective view of the rotatable and retractable member shown in an extended position in FIG. 27A.

FIG. 27C is a detailed perspective view of an electrical contact utilized in the retractable member shown in FIG. 27A.

FIG. 27D is a diagrammatic view showing the position of electrical contacts in the rotatable and retractable member shown in FIG. 27A.

DETAILED DESCRIPTION OF THE PREFERRED EMBODIMENTS

Reference will now be made to the drawings wherein like structures will be provided with like reference designations.

U.S. patent application Ser. No. 08/799,799, filed Feb. 13, 1997, which issued on Jun. 30, 1998 as U.S. Pat. No. 5,773,332, and U.S. patent application Ser. No. 08/971,501, filed Feb. 17, 1998, are both now incorporated herein by this reference in their entireties.

Figure 1:
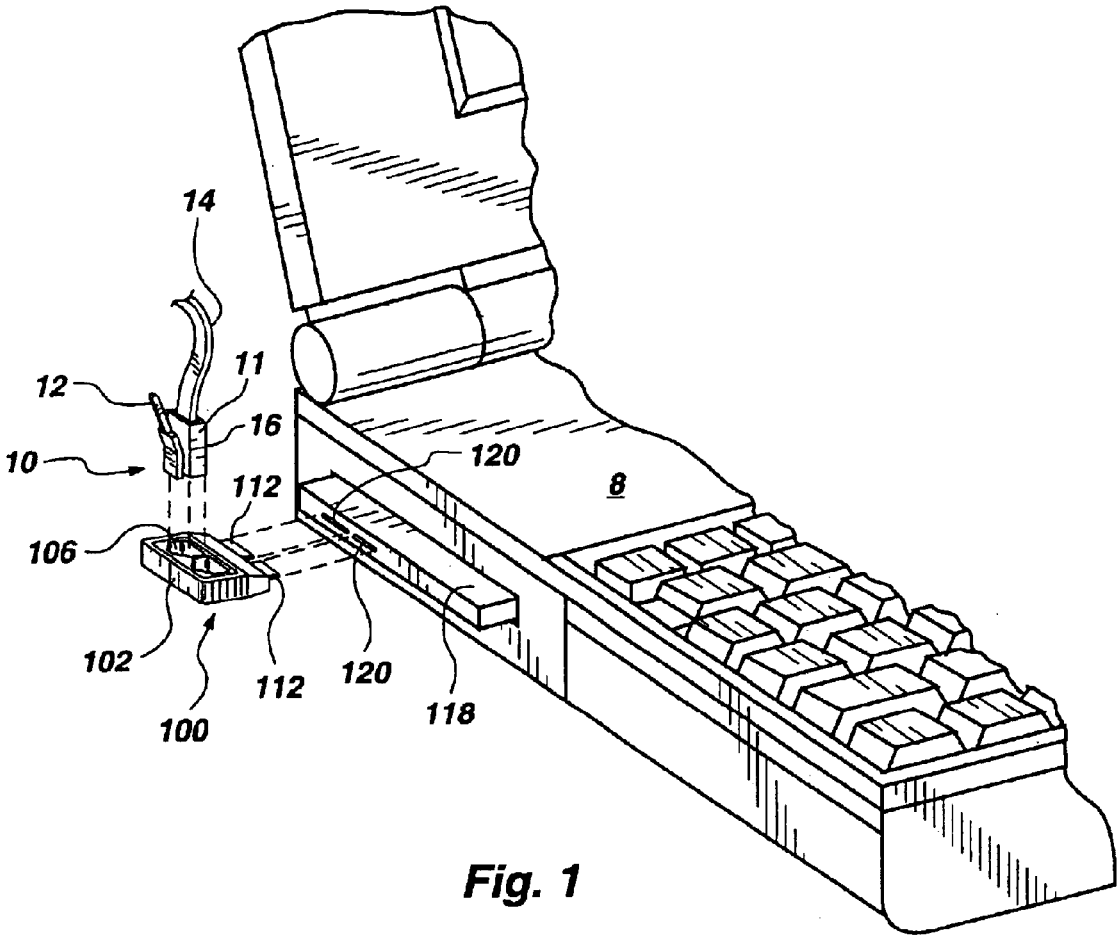
FIG. 1 is a partial perspective view of a lap top computer with a communications card partially inserted therein and a first embodiment of the present invention ready to be coupled to the communications card.

As is evident to those skilled in the art, advances in technology is allowing many different electrical devices to be made smaller than was contemplated just a few years ago. Represented in FIG. 1 is a partial perspective view of a lap top computer 8. In order to meet the demand for devices utilized with such lap top computers without adding any significant weight or bulk, devices such as a modem card 118 (shown partially withdrawn from the lap top computer 8) which complies with the PCMCIA (also known as PC Card) standards have been produced. Significantly, while most lap top computers are generally note book size (about 8.5 inches by about 11 inches) or smaller, the need for further miniaturization of devices such as the modem card 118 will increase as computing devices of all kinds continue to shrink.

The lap top computer 8 represented in FIG. 1 includes a PCMCIA compliant socket 124. The Personal Computer Memory-Card International Association (PCMCIA) promulgates the PCMCIA standard which has gained wide acceptance in the industry. It is preferred that the PCMCIA compliant socket adhere to PCMCIA standard pertaining to Type I, Type II, and Type III cards. The preferred standards specify the physical, electrical and environmental parameters which compliant devices must meet. The system and method of the present invention described herein are preferably compatible with the PCMCIA Card Services Specification 2.1 and Card Services Specification 2.1 as well. This standard and the accompanying specifications are well-known in the art and PCMCIA release 2.1, PCMCIA Card Services Specification 2.1, and Card Services Specification 2.1, PCMCIA Standard Release 2.1, and all releases promulgated thereafter (including the PC Card standard (1995)), are now all incorporated by reference herein in their entireties. It is to be understood that the present invention can be utilized with other PCMCIA specifications and standards which are now available or which-become available in the future as well as with other similarly instructive standards which are now available in the industry or which become available in the future. Examples of such other specifications and standards include the CardBus PC Card standard which is also now incorporated herein by reference in its entirety. Further information regarding the implementation of these standards can be obtained from the publication Anderson, D. & Shanley, T., CardBus System Architecture (1996) (published by Addison-Wesley Publishing Company) which is also now incorporated herein in it entirety.

The modem card 118 shown in FIG. 1 can also represent numerous other communication devices, for example, a local area network adaptor, voice mail device, telephonic communication device, or a facsimile device. Indeed, with the continuing trend of miniaturizing such devices, all of these devices may be combined into one card the size of the modem card 118 represented in FIG. 1. All of these devices are examples of those intended to come within the scope of the meaning of the term "communication device" as used herein. Even further, other devices which require communication with one or more additional devices which are now available or which may become available in the future are intended to also come within the meaning of the term communication device as used herein.

As used herein, the term "data utilization device" is intended to include all digital computing devices which are adaptable to receive data or instructions via a communications medium. Perhaps the most common current example of such a device is the personal computer.

Figure 2:
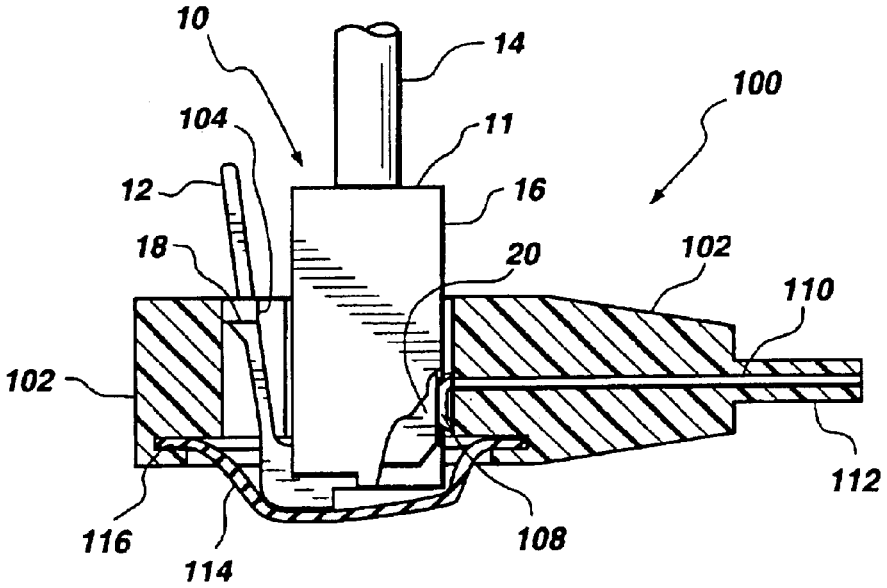
FIG. 2 is a cross sectional view of the first embodiment of the present invention represented in FIG. 1.
Figure 3:
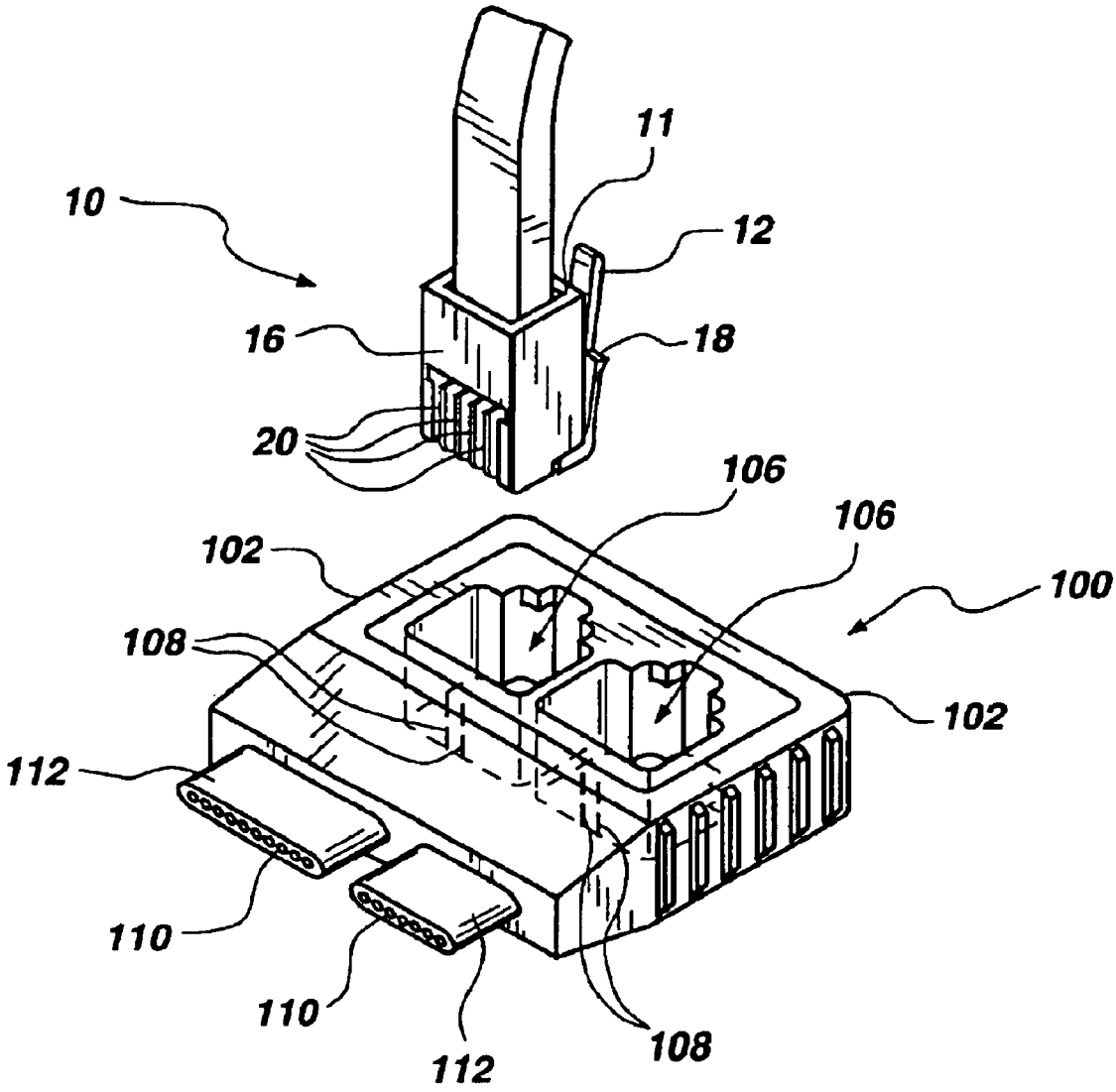
FIG. 3 is a reverse perspective view of the first embodiment of the present invention represented in FIG. 1.

A plug, which is compatible with the RJ-xx series industry standard, is indicated generally at 10 in FIGS. 1, 2, and 3. The RJ plug 10 includes a block 11 which has a first face 16 into which a plurality of electrical contacts 20 are recessed. The electrical contacts 20 are connected to wires (not explicitly represented in FIGS. 1–3) contained within a cable 14 which lead to the communications network, to another communications device, or some other device. A biased clip 12, which is integrally molded as part of the block 11, is used to hold the plug 10 in a corresponding receptacle.

Detailed information regarding the RJ-xx series of connectors can be found in the publication found at Title 47 (Telecommunications), Code of Federal Regulations, Chapter I (Federal Communications Commission), Subchapter B (Common Carrier Services), Part 68 (Connection of Terminal Equipment to the Telephone Network), Subpart F (Connectors), Section 68.500 (1992) which is now incorporated herein by reference in its entirety.

FIGS. 1–3 represent a first preferred arrangement of the present invention embodied in a receptacle module generally represented at 100. The receptacle module 100 includes a male coupling 112 which provides both physical and electrical connections to a corresponding female coupling 120 provided in the modem card 118. It will be appreciated that many different structures available in the industry provide equivalent functions to the male coupling 112 and the female coupling 120.

The receptacle module 100 includes a body 102 which can preferably be fabricated from a plastic material using techniques known in the art but can also be fabricated using any suitable materials and techniques now available or which may become available in the future. Two recesses, both of which are generally indicated at 106 in FIG. 3, are formed in the body 102. The inclusion of two recesses 106 desirably allows accommodation of two communication lines by the receptacle module 100.

A cross sectional view of one of the recesses 106 is provided in FIG. 2. FIG. 2 also shows the plug 10 inserted into the recess 106. The recess 106 has a first open end and a second closed end. When an RJ-xx series plug is inserted into the recess 106, a plurality of conductors 108 communicates with one of its respective contacts 20. The conductors 108 are preferably spring-like so that they are in firm electrical continuity with the contacts 20. In some applications only two conductors 108 are provided while more than two conductors 108 are provided in other applications. Each of the conductors 108 is joined to a respective hollow pin, one of which is shown in cross section at 110, which mates with corresponding pins provided in the female coupling (120 in FIG. 1).

It will be appreciated that the number of pins and conductors can be varied in accordance with the particular application for the receptacle block. Moreover, it is within the scope of the present invention to utilize any techniques now available, or which become available in the future, to provide electrical connection between the conductors in the recesses and the coupling structure.

Still referring to FIG. 2, as the plug 10 is received into the recess, a ledge 104 provided on the biased clip 12 engages a ridge 18 formed on the body 102 and protrudes into the recess 106. The biased clip 12 and the ledge 104 cooperate to hold the plug 10 in the recess 106. When removal of the plug 10 is desired, the biased clip 12 is compressed and the plug 10 is removed from the recess 106.

Enclosing one end of the recess is an expandable member 114. In the embodiment of the invention represented in FIG. 2, the expandable member is an elastic and stretchable membrane. The expandable member 114 is preferably a rubber-like material which is an electrical insulator. The expandable member 114 is anchored in a groove 116 provided in the body 102 around the recess 106.

As clearly shown in the cross section of FIG. 2, when the plug 10 is fully inserted into the recess. 106 the expandable member 114 is moved to expand the depth of the recess 106. The expandable member 114 isolates the contacts 20 from exposure to the surrounding environment. If the expandable member 114 were not included, as in the previously available schemes, the contacts 20 would be exposed to the surrounding environment and the possibility that the contacts 20 will be shorted together is present. It is also possible that the contacts 20 could be shorted to an electrical ground, pass a current to a user who touches the contacts 20, or some other event might occur which would damage the communications devices attached to the cable 14. As known in the art, voltages of more than 70 volts regularly are present on the contacts 20 when connected to the common carrier telephone network in the United States.

The illustrated expandable member 114 is preferably fabricated from a rubber-like material which is flexible enough to allow the end of the plug 10 to expand the flexible member 114 without undue force being exerted on the plug 10. The material from which the expandable member 114 is fabricated should be strong enough to allow long time use without any failure, e.g., tearing. Those skilled in the art will appreciate that the perimeter of the expandable member 114 should be securely anchored in the groove 116.

It is to be understood that structures other than the expandable member 114 can function as the expandable means for isolating the contacts 20 from electrical continuity with any object in the surrounding environment. For example, a combination of rigid panels joined together to allow expansion can function as the expandable means. Further, a combination of rigid elements and elastic elements, or one or more rigid, elements which fold within the thickness of the body 102, can be devised using the information contained herein. It is preferred that the thickness of the body 102 be not greater than the thickness of the modem card 118. Thus, the expandable member 114 should tend to automatically return to within the plane of the body 102 once the plug 10 is removed and/or allow the user to collapse the expandable member 114. Referring to FIG. 3, it is preferred that the recesses 106 have particular dimensions. It is preferred that the two unbroken side walls of the recess each have a length in the range from about 0.265 inches to about 0.285 inches and the single remaining straight wall, which is perpendicular to the two side walls, have a dimension in the range from about 0.45 inches to about 0.475 inches for compatibility with RJ-45 plugs. It is also preferred that the two unbroken side walls of the recess have a length in the range from about 0.265 inches to about 0.285 inches and the single remaining straight wall, which is perpendicular to the two side walls, have a dimension in the range from about 0.375 inches to about 0.4 inches for compatibility with RJ-11 and RJ-12 plugs.

Figure 4:
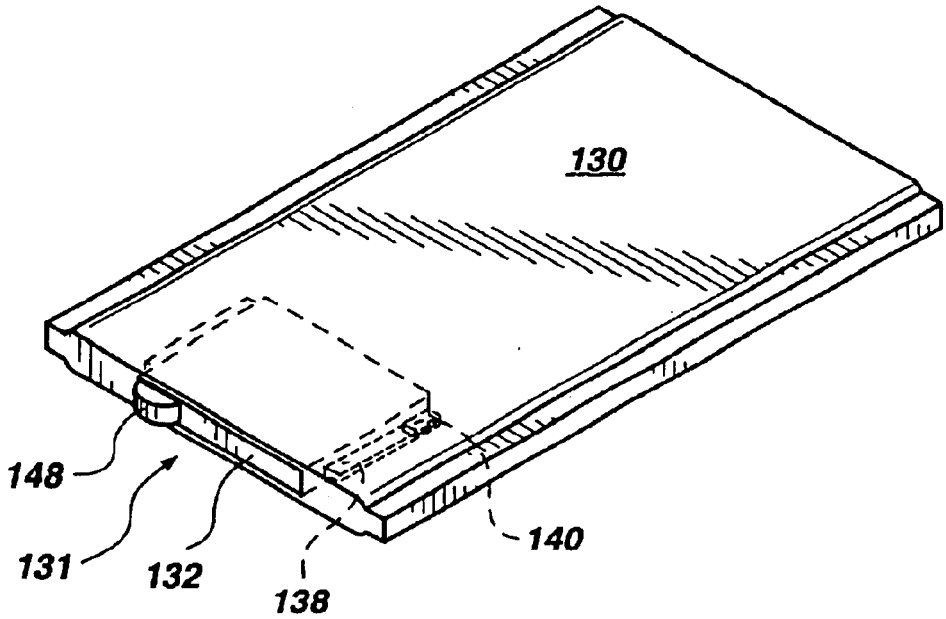
FIG. 4 is a perspective view of a second embodiment of the present invention with a receptacle module illustrated in a retracted position.

FIG. 4 is a perspective view of a second embodiment of the present invention with a receptacle module, generally represented at 131. The receptacle module 131 is illustrated in FIG. 4 as being retracted into a communications card 130. The communications card 130 can house any of the communications devices indicated earlier.

The receptacle module 131 includes a body 132 and a finger pull 148 formed thereon. The receptacle module 131 is conveniently kept in its retracted position illustrated in FIG. 4 until the communications card 130 needs to be connected to a communications line (not shown in FIG. 4). When needed, the user grasps the finger pull 148 and pulls the receptacle module 131 to its extended position represented in FIG. 5.

Figure 5:
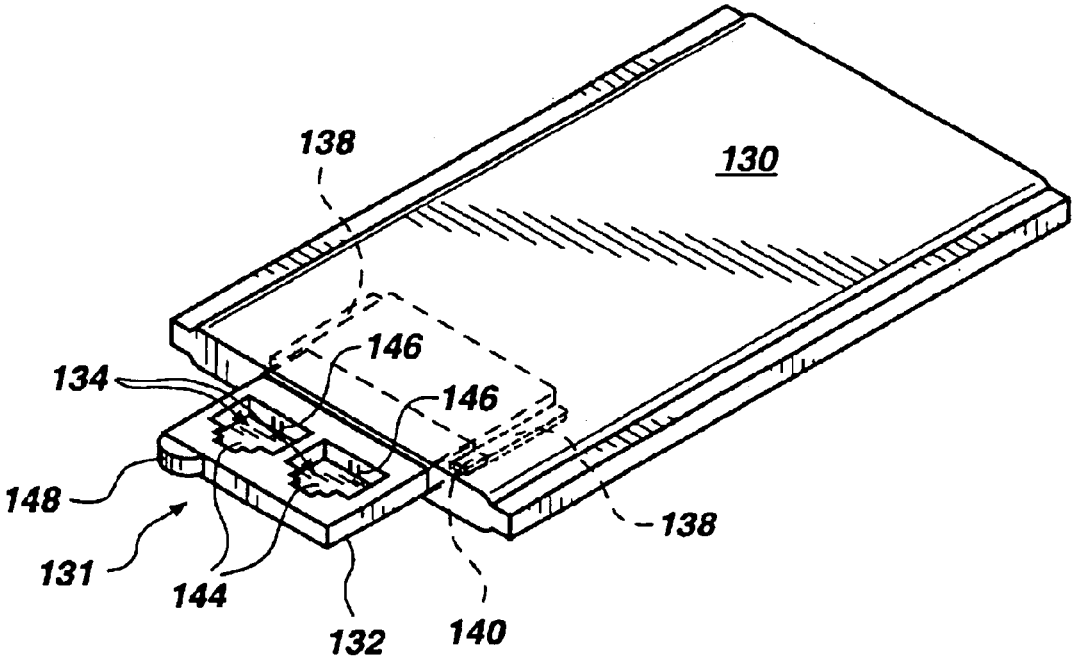
FIG. 5 is a perspective view of the second embodiment of the present invention represented in FIG. 4 illustrated in an extended position.

FIG. 5 illustrates the receptacle modules in its extended position. The receptacle module 131 includes a pair of ridges (one shown in phantom image at 140 in FIGS. 4 and 5) which extend from the sides of the receptacle module 131 and which slide along a pair of grooves, shown best in phantom image in FIG. 5 at 138.

The receptacle module 131 includes two recesses, each generally indicated at 134, with each recess including a plurality of conductors 146. Each recess 134 also preferably includes an expandable member 144 which can be identical, similar, or equivalent to the expandable member 114 discussed in connection with FIGS. 1–3.

Figure 6:
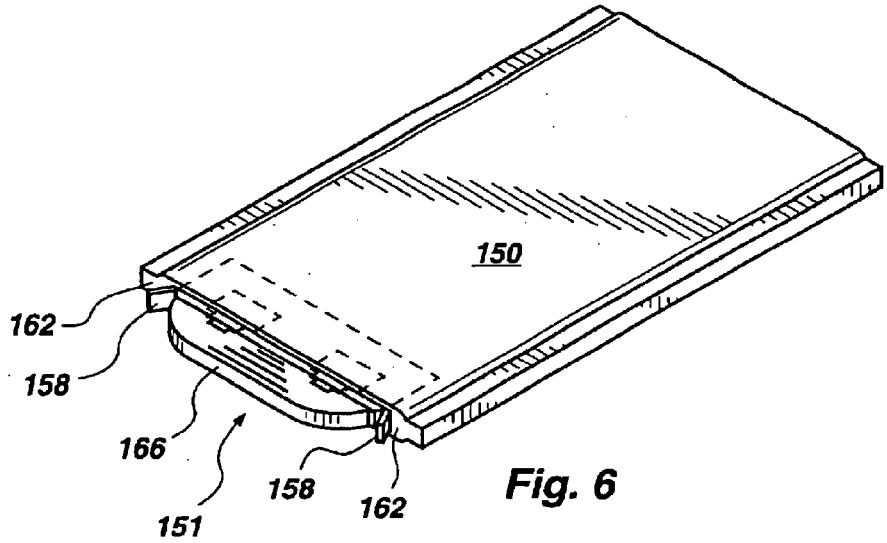
FIG. 6 is a perspective view of a third embodiment of the present invention with a removable receptacle module illustrated in a retracted position.
Figure 7:
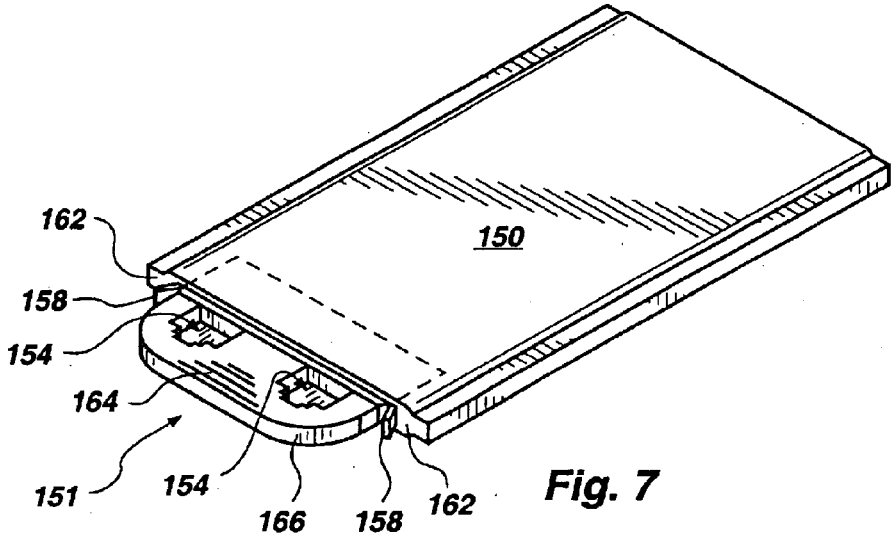
FIG. 7 is a perspective view of the third embodiment of the present invention represented in FIG. 6 with the removable receptacle module illustrated in an extended position.

FIG. 6 is a perspective view of a third embodiment of the present invention including a removable receptacle module generally represented at 151. The removable receptacle module 151 is shown in place in a communications card 150 as has been explained earlier. The removable receptacle module includes a body 166 which is illustrated in FIG. 6 in a retracted position. It will be appreciated that the retracted position illustrated in FIG. 6 can be used or the body 166 can be fully withdrawn into the communications card 150 housing. In order to use the apparatus, a user preferably grasps finger grips 166 and pulls the body 166 out to an extended position as represented in FIG. 7.

The removable receptacle module 151 is advantageously easily removable from the communications card 150. In order to remove the entire removable receptacle module 151 from the communications card 150, a pair of wings 158 are squeezed inwardly so a ledge (158 in FIG. 8) provided on each wing 158 disengages from an edge 162 of the communications card 150 housing. The entire removable receptacle module 151 can then be removed from the communications card 150. It will be appreciated that other structures can carry out the function of the wings 158, as will be explained later in this disclosure.

It is common for a receptacle module, such as receptacle module 100, to be broken or damaged during use. If a receptacle module, or other structure providing connection to a communications line is permanently affixed to the communications card or its equivalent, then the only practical recourse is replacement of the entire communications card, even though only the receptacle module has been damaged. The embodiment of the present invention represented in FIGS. 6–9 provides that the receptacle module can be easily replaced in case of damage.

Moreover, the removable receptacle module 151 can be replaced with another removable receptacle module which is adapted to receive another size or style of plug (not represented in FIGS. 6–9). For example, the RJ-11, RJ-12, and RJ-45 connectors have all been generally adopted for specialized applications. Thus, a removable receptacle module adapted for use with RJ-11 plugs can be easily replaced with a removable receptacle module adapted for use with RJ-45 plugs and so forth.

Figure 8:
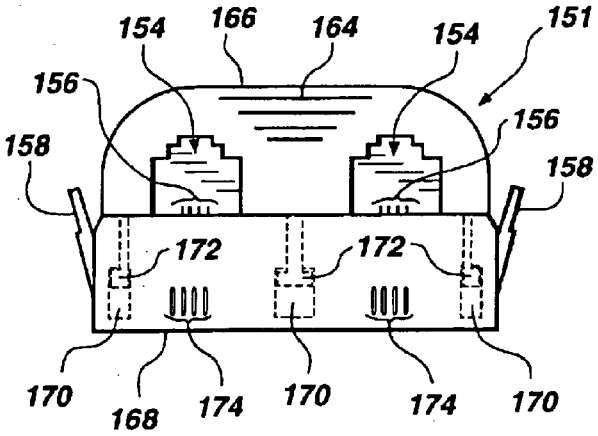
FIG. 8 is a top plan view of the removable receptacle module represented in FIG. 7.
Figure 9:
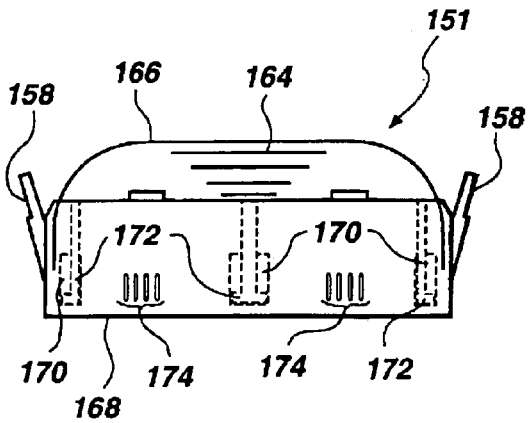
FIG. 9 is a top plan view of the removable receptacle module represented in FIG. 6.

FIGS. 8 and 9 provide detailed views of the removable receptacle module 151 with the body 166 in an extended and retracted position, respectively. Provided in the body 166 are a pair of recesses, generally indicated at 154, and a plurality of conductors 156. Each recess 154 preferably includes an expandable member, generally indicated at 154, as has been previously explained.

As represented in FIGS. 8 and 9, the removable receptacle module 151 includes a shell 168 from which the wings 156 extend and in which the body 166 slides. It will be appreciated that many different structures can be devised by those skilled in the art to carry out the functions of the shell using the teachings contained herein. Attached to the body 166 are three guides 172 which slide within three respective grooves 170. The guides 172 and the grooves 172 are configured so that the body 168 is held captive in, i.e., cannot be completely removed from, the shell 168. Also represented in FIGS. 8 and 9 are a plurality of electrical conductors indicated at brackets 174 which mate with suitable structures within the communications card 150 housing to allow transfer of signals between the communications line (not illustrated in FIGS. 8 and 9) and the communications card (150 in FIGS. 6 and 7).

It will be appreciated that since the housing 168 of the receptacle module 151 is retained within the communications card 151, and that the communications card 150 is held within a lap top computer or a cabinet of some kind, the shell 168 is protected from breakage and damage so it can be removed without undue difficulty even if damage does occur to other components of the removable receptacle module 151.

Figure 10:
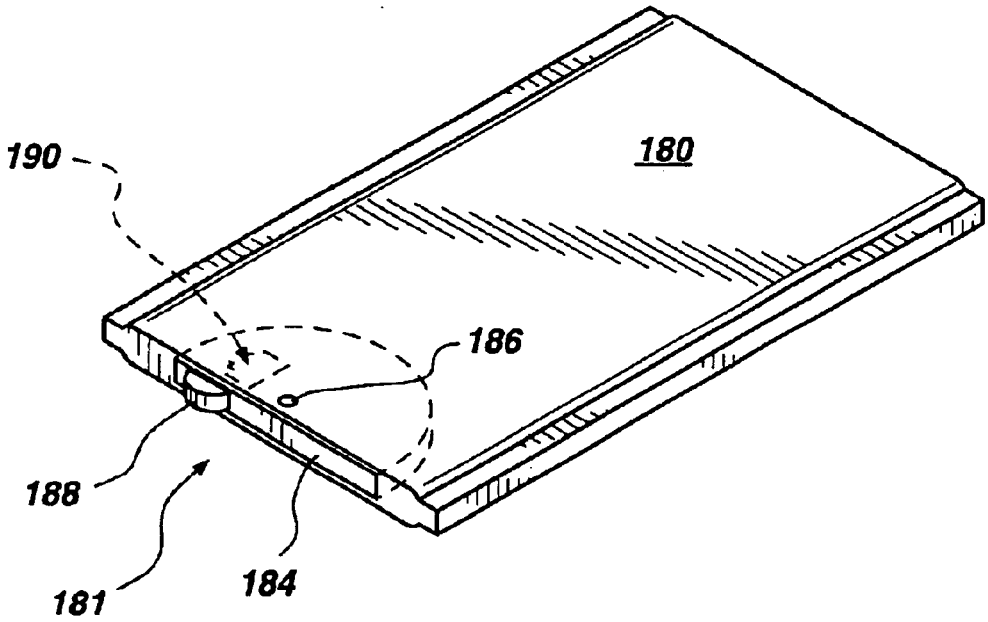
FIG. 10 is a perspective view of a fourth embodiment of the present invention with the receptacle module illustrated in a retracted position.

FIG. 10 provides a perspective view of a fourth embodiment of the present invention. The embodiment illustrated in FIG. 10 includes a receptacle module, generally indicated at 181, illustrated in a retracted position. The receptacle module 181 includes a body 184 which is preferably semicircular in shape and rests, when in its retracted position, within a cavity in a communications card 180, the cavity being generally indicated at 182 in FIG. 11. The cavity 182 is preferably semicircular in shape but can be any shape which provides sufficient room to accommodate the body 184 in its retracted position.

Figure 11:
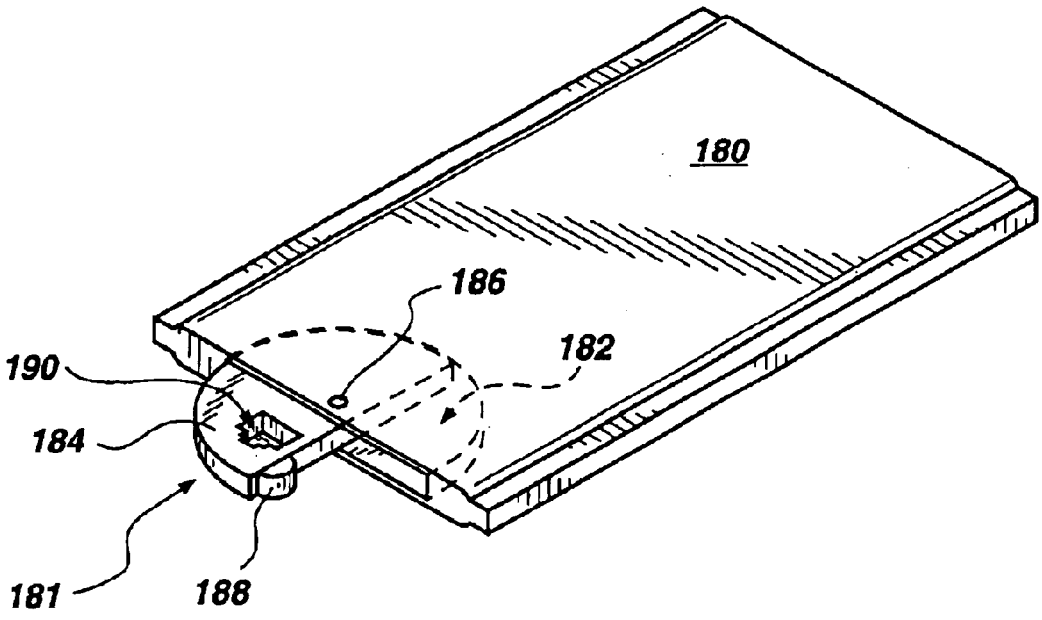
FIG. 11 is a perspective view of the fourth embodiment of the present invention represented in FIG. 10 with the receptacle module illustrated in an extended position.

The body 184 is attached to the communications card 180 housing by way of a pivot 186. The pivot 186 allows the body 184 to be rotated by pulling on a finger grip 188 to an extended position as illustrated in FIG. 11. In its extended position, the receptacle module 181 allows access to a recess 190 which is preferably configured as explained earlier and is ready to receive a plug, such as plug 10 in FIG. 1. Electrical connections between the conductors (not illustrated) disposed in the recess 190 and the circuitry contained in the communications card 190 are provided as can be designed by those skilled in the art. Those skilled in the art can also arrive at numerous structures which are equivalent to those illustrated in FIGS. 10 and 11 using the teachings contained herein.

Figure 12:
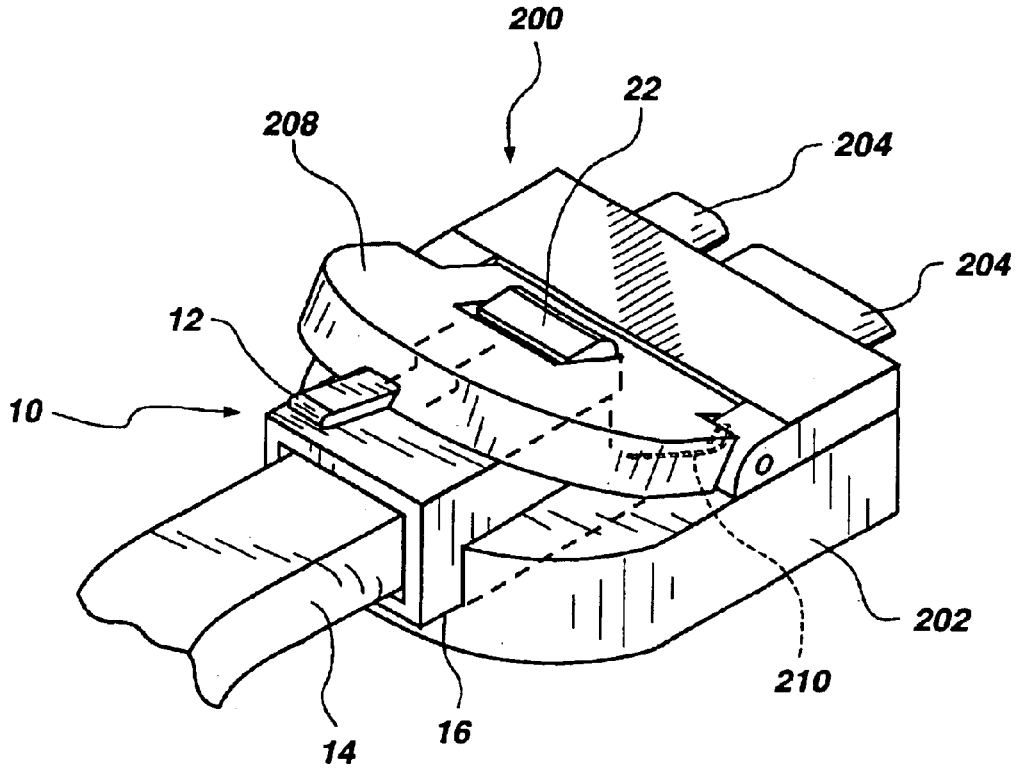
FIG. 12 is a perspective view of a fifth embodiment of the present invention.
Figure 13:
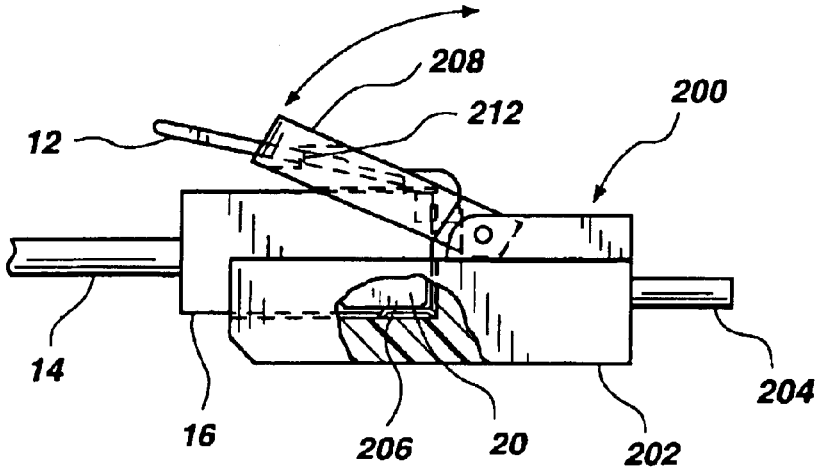
FIG. 13 is a side elevational view of the fifth embodiment of the present invention represented in FIG. 12.

FIG. 12 provides a perspective view of a fifth embodiment of the present invention which includes a receptacle module, generally indicated at 200, with male couplings 204 similar to those represented in FIGS. 1–3 at 112 and which are received by a communications card such as those described earlier. A body 202 is provided with a recess into which the plug 10 is inserted. As illustrated best in the cross sectional view of FIG. 13, a plurality of conductors 206 are provided which communicate with respective contacts 20 on the plug 10.

With the plug 10 in position on the body 202, a lever 208 holds the plug 10 in place. The lever 208 is biased toward the body 202 by a spring 210. A ledge 212 provided on the lever 208 engages the ridge (18 in FIGS. 2 and 3) provided on the clip 12 to further hold the plug in place. An aperture is provided on the lever 208 to accommodate a hump 22 which is provided on plugs which comply with the RJ-xx series standards. It will be appreciated that the biased lever provides a much more secure and convenient to use apparatus than any of those available in the art which are suitable for use with RJ-xx series plugs and which is suitable for use with miniaturized devices such as the previously described communications cards.

Figures 14, 14A:
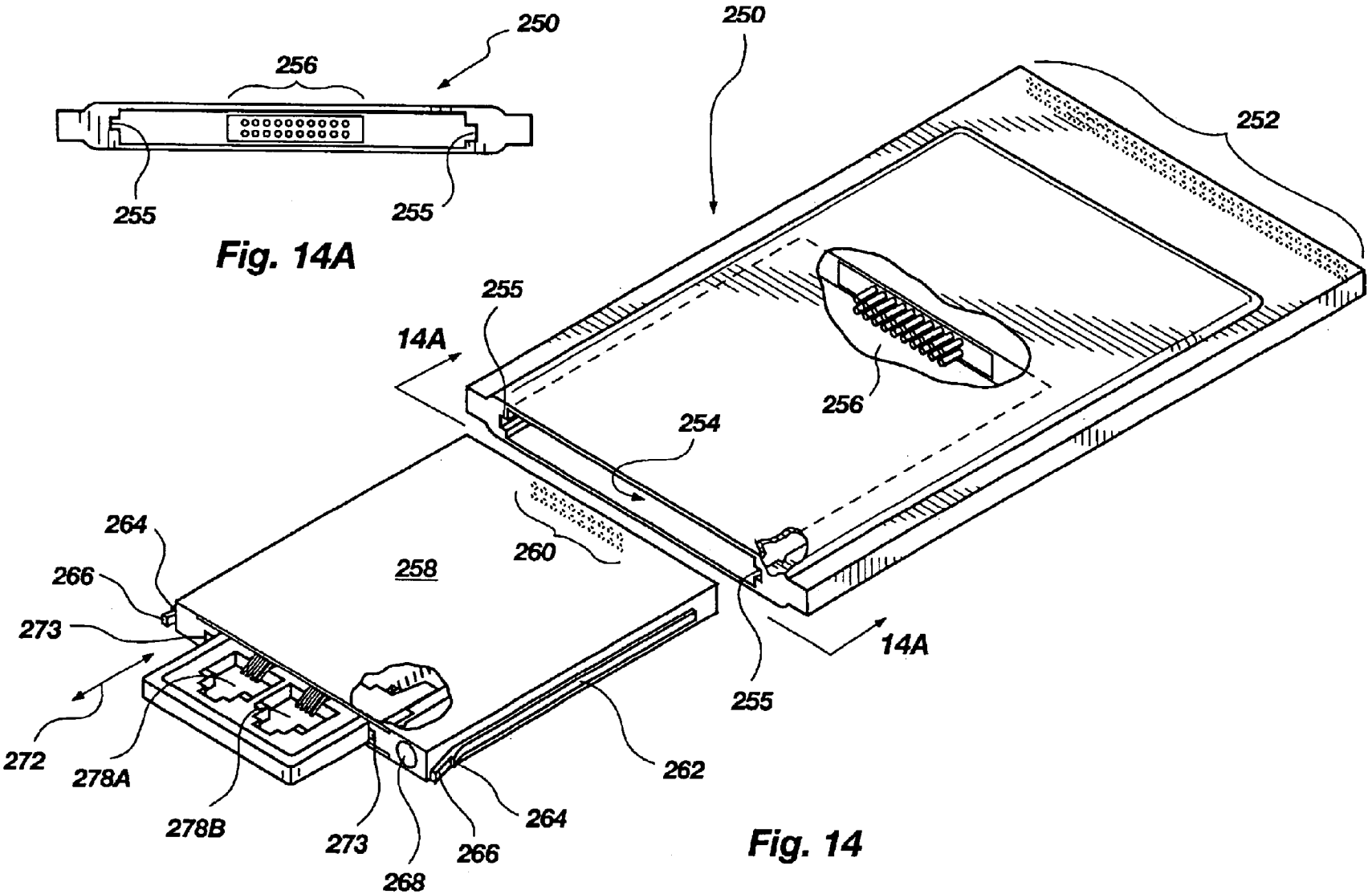
FIG. 14 is a perspective view of a sixth embodiment of the present invention having a replaceable direct access arrangement unit ready to be inserted into the communications card.
FIG. 14A is an end view taken along line 14A—14A of FIG. 14.

Reference will next be made to FIG. 14. FIG. 14 provides a perspective view of a preferred sixth embodiment of the present invention. The embodiment of FIG. 14 provides a communications card 250 which includes a replaceable direct access arrangement 258 which is shown ready to be inserted into the communications card 250. As is known in the industry, the communications card 250 makes electrical connection to a computing device via connector sockets, which are represented at 252 in FIG. 14.

The inclusion of a replaceable direct access arrangement, also referred to as a data access arrangement (abbreviated "DAA"), provides important advantages not previously available in the industry. In the past, DAAs provided a few functions such as: matching the impedances between the telephone line and the modem; receiving data from the telephone line; transmitting data onto the telephone line; providing a pulse dial; and detecting an incoming ring signal. Significantly, different countries and regions of the world require that the DAA carry out different functions.

Presently, it has become a practice in the industry to supply a DAA with a modem in accordance with whatever country the user intends to make the connection to a telephone line, i.e., "U.S." modems are sold in the U.S. and "German" modems are sold in Germany. Since desktop personal computers are very seldom moved from country to country, it has been satisfactory in the past to purchase a modem which can be used in only one country; if the user moved, a new modem was purchased if necessary.

Significantly, the widespread popularity of portable personal computers, and the use of PCMCIA cards in desktop computers, has meant that the computer or the computer peripheral is not bound to any particular location but can travel to any location in the world. Unfortunately, the industry has not recognized, and has not begun to effectively solve, the problems faced by a portable computer user traveling from country to country. Available telephone communication devices are ill suited for use in one or more countries which a user might visit. Even if the desirability of providing a telephone communication device and DAA which is suitable for use in multiple countries was recognized in the industry, the requirements of some countries mandate the use of components which seem too large to allow their incorporation into a communications card which is used with a portable computer.

The present invention solves these problems found in the industry by including a replaceable DAA 258 which is received into a cavity which is generally indicated at 254 in FIG. 14. The replaceable DAA 258 not only can carry out the customary functions already known in the art, but in accordance with the present invention the replaceable DAA 258 can also carry out other desirable functions as described herein.

The replaceable DAA 258 preferably makes electrical connection with the communications card 250 via twenty connector pins 256 provided in the back of the cavity 254 and corresponding connector sockets 260 provided on the rear of the DAA 258. As necessary, a user can install an appropriate replaceable DAA 258 to perform the functions necessary to obtain direct connection to a country's telephone system or to perform some other function.

It will be appreciated, and as will be explained shortly, the replaceable DAA 258 can house components different than those necessary to connect to a telephone line such as providing the components necessary to interface with a computer network or provide wireless communication service such as cellular telephone service or carry out some other function.

Figure 14B:
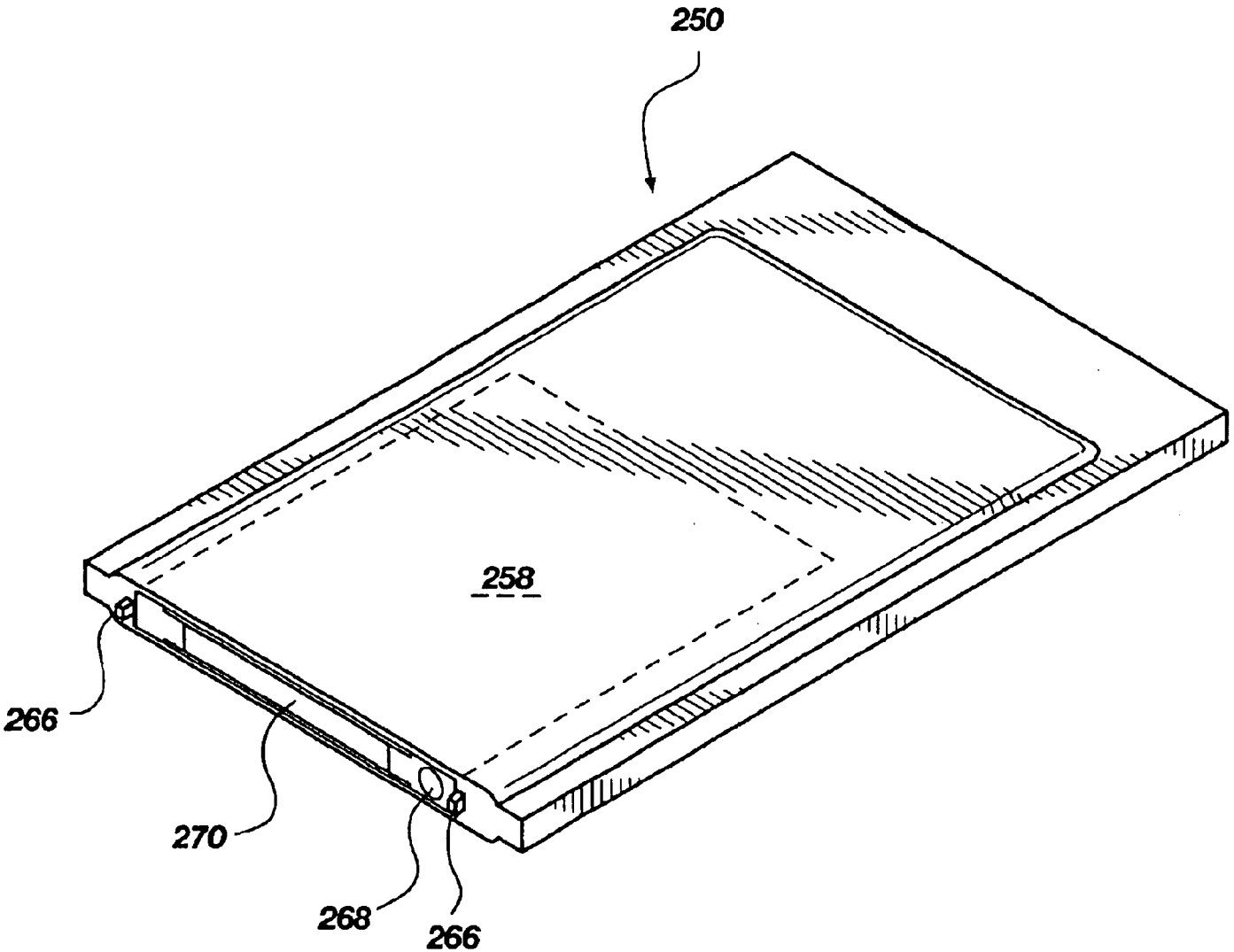
FIG. 14B is a perspective view of the embodiment illustrated in FIG. 14 showing the components retracted into the communications card.

Represented in FIG. 14 are grooves 255 into which are received respective ridges 262 provided on the sides of the replaceable DAA 258. The grooves 255 are more clearly represented in the end view of FIG. 14A. The grooves 255 and the ridges 262 function to guide the replaceable DAA 258 into and out of the cavity 254. The replaceable DAA 258 is preferably held in the cavity 254 by a pair of flexible ledges 264 which engage corresponding notches 257 provided on the inner surface of the cavity 254. FIG. 14B illustrates the communications card 250 when the replaceable DAA 258 is fully inserted into the cavity 254.

To remove the replaceable DAA 258 from the remainder of the communications card 250, a pair of tabs 266 are squeezed, resulting in the ledges 264 being released from the notches 257, and allowing the replaceable DAA 258 to be extracted from the cavity 254. It will be appreciated that many different arrangements can be arrived at by those skilled in the art to allow the components of the replaceable DAA 258 to be connected to, and removed from, the remainder of the communications card 250.

The replaceable DAA 258 illustrated in FIG. 14 is provided with a receptacle module 270 which is provided with a pair of RJ-xx series receptacles represented at 278A&B which are adapted to connect to a communications line having an RJ-xx series plug such as those represented in FIG. 1-3. It will be appreciated that the RJ-xx series receptacles 278A&B can be provided with the expandable member 114 shown in FIG. 2 if desired. It is within the scope of the present invention to provide the receptacle module 270 with structures to allow its removal as shown in FIG. 1 or to include structures to allow extension out of, as shown by the phantom image of FIG. 14, the replaceable DAA 258 and retraction into the replaceable DAA 258 in the direction of arrow 272 as represented in FIG. 14B.

Figure 14C:
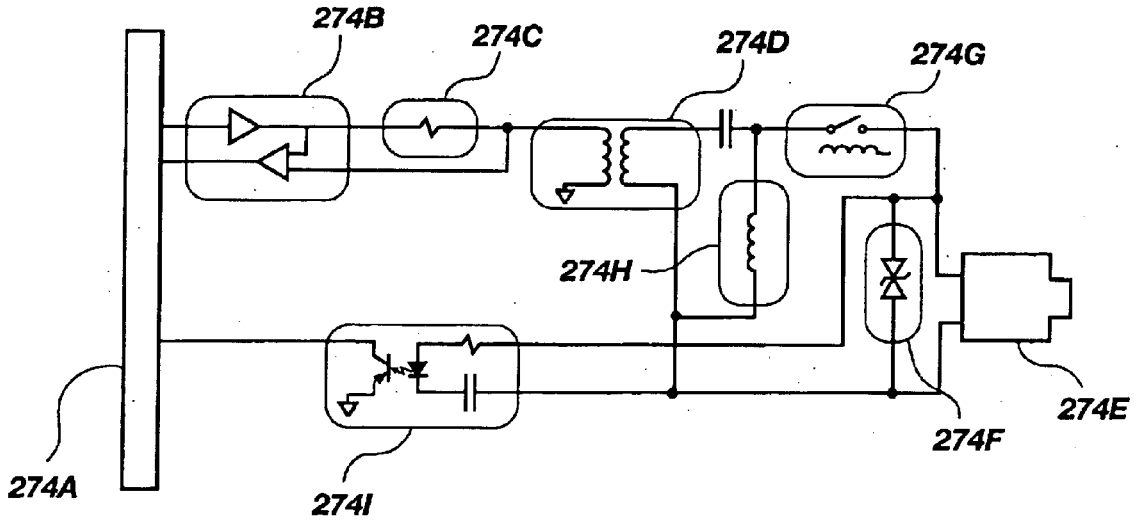
FIGS. 14C–E are block diagrams illustrating the preferred functions carried out by the replaceable direct access arrangement unit.
Figure 14D:
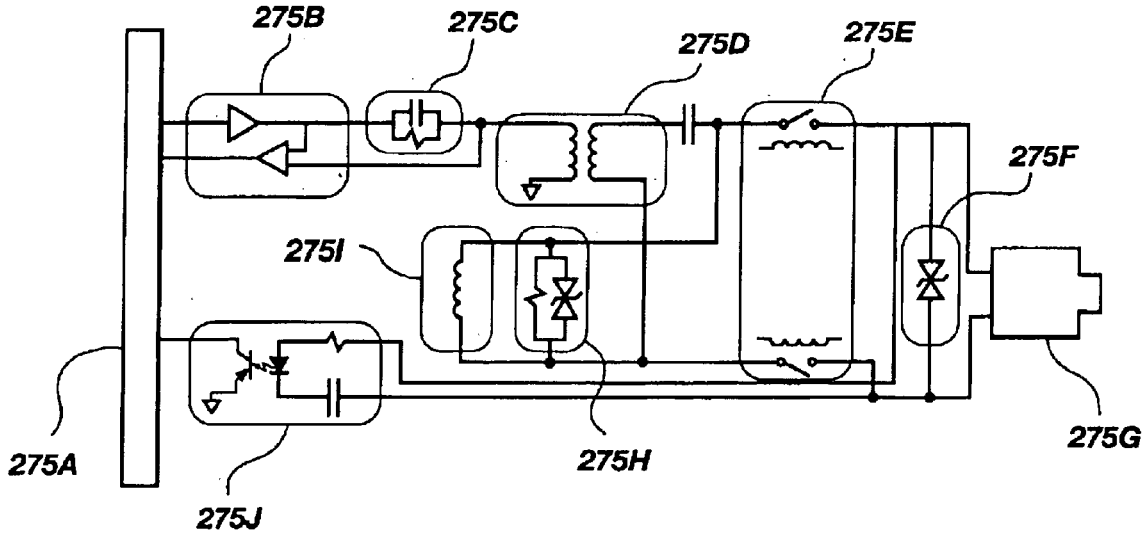
Figure 14E:
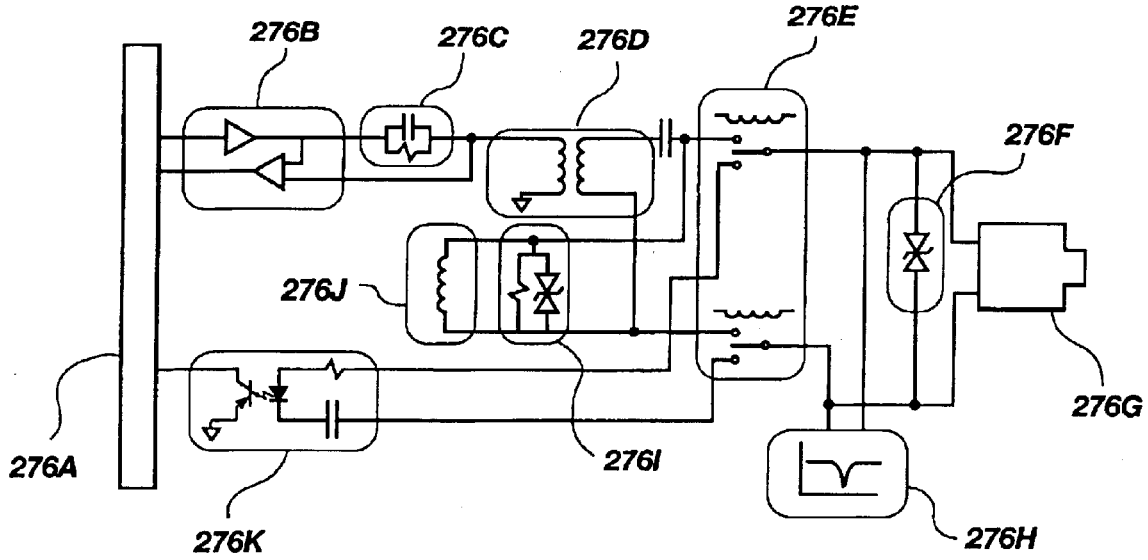

FIGS. 14C–E are high level block diagrams illustrating some of the preferred functions carried out by the replaceable DAA 258. As suggested above, a number of different replaceable DAA 258 units can be provided, each being adapted to carry out a particular function and the user changing the replaceable DAA 258 as necessary. Provided below in Tables A–C are descriptions of the preferred functions carried out by the blocks represented in FIGS. 14C–E, respectively.

TABLE A

| FIG. 14C | |
|---|---|
| US DAA | |
| 274A | Modem connection |
| 274B | Hybrid circuit |
| 274C | AC impedance network |
| 274D | Signal transducer |
| 274E | Line connector |
| 274F | Transient protection |
| 274G | Loop relay |
| 274H | DC holding current |
| 274I | Ring detect circuit |

TABLE B

| FIG. 14D | |
|---|---|
| Norway DAA | |
| 275A | Modem connection |
| 275B | Hybrid circuit |
| 275C | AC impedance network |
| 275D | signal transducer |
| 275E | Loop relays |
| 275F | Transient protection |
| 275G | Line connector |
| 275H | Pulse dial |
| 275I | DC holding current |
| 275J | Ring detect |

TABLE C

| FIG. 14E | |
|---|---|
| German DAA | |
| 276A | Modem connection |
| 276B | Hybrid circuit |
| 276C | AC impudence network |
| 276D | Signal transducer |
| 276E | Loop relays |
| 276F | Transient protection |
| 276G | Line connector |
| 276H | Billing tone filter |
| 276I | Pulse dial |
| 276J | DC holding current |
| 276K | Ring detect |

Figure 14F:
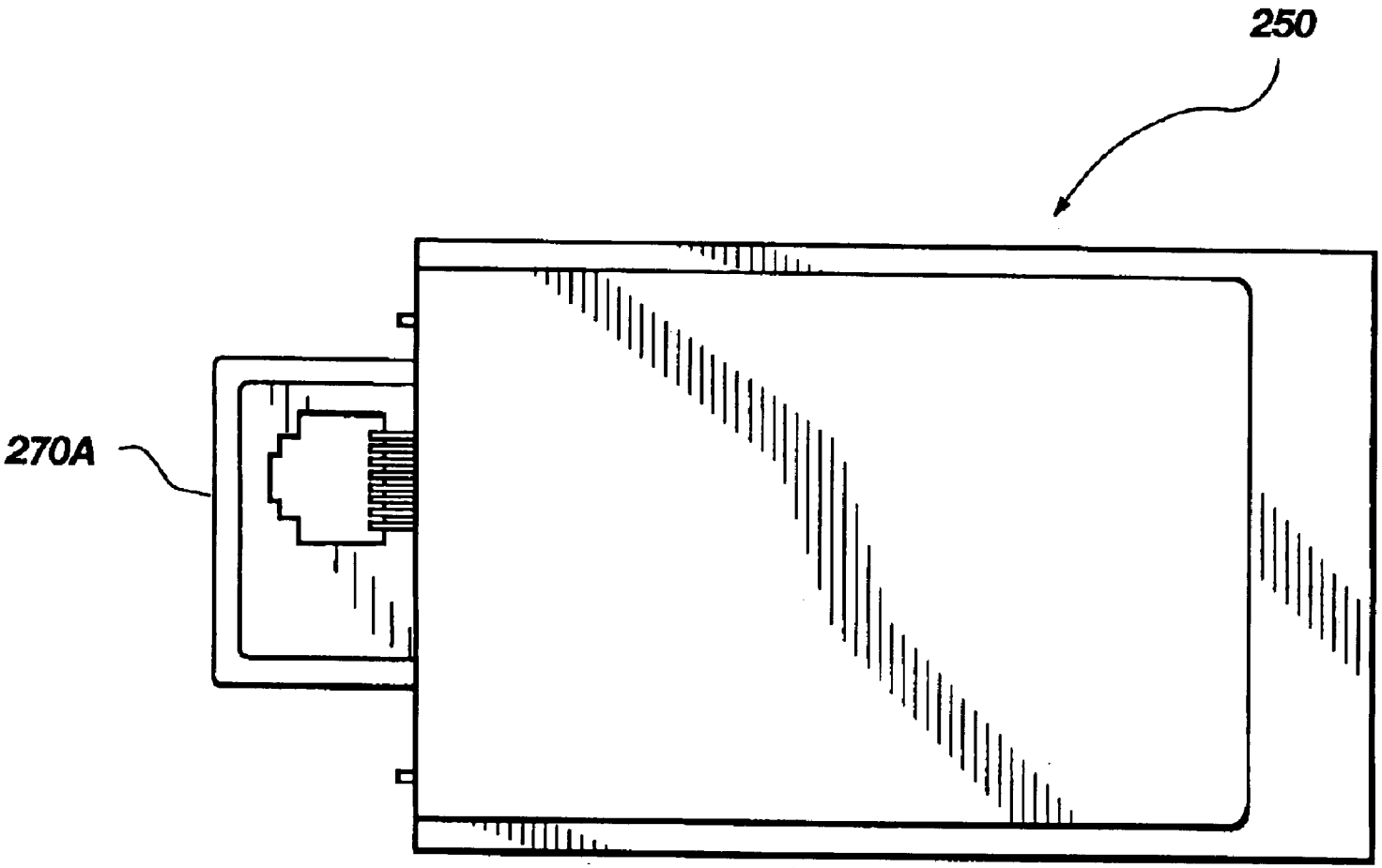
FIG. 14F is a top view of a communications card having another replaceable direct access arrangement unit installed therein.

FIG. 14F shows a receptacle module 270A which includes only a single RJ-xx series receptacle. Some country's regulations require that only a single telephone line be connected to a telecommunications device. The RJ-xx series receptacle illustrated in FIG. 14F is preferably an eight conductor RJ-45 receptacle. The DAA to which the receptacle module 270A is connected preferably provides the interfacing functions needed to directly attach to the telephone system of the particular country or countries.

Reference will next be made to FIGS. 15A–D which are detailed views of the receptacle module 270 and the structures which allow the receptacle module 270 to extend out of or retract into the replaceable DAA 258 (shown in FIG. 14). It will be appreciated that the structures which allow extension and retraction of the receptacle module 270 can be incorporated into the replaceable DAA 258, directly into a communications card 250, or into any other device which would benefit from the compact communications connector described herein.

Prior to the present invention, if the structures providing RJ-xx series connectors were affixed to the PCMCIA p0communications card, the connectors would be broken off or damaged and the user would be required to discard the entire communications card and would be stranded with an inoperative communications card. The devices described in U.S. Pat. No. 5,183,404 to Aldous are particularly afflicted by this problem. Prior to the advent of the instant invention, the industry had not recognized the described incidents as a significant problem and the industry has not been able to arrive at the solution described herein.

The present invention allows the structures which provide the communications receptacles to be readily replaced by the user. The user may need to replace the structures which provide the communications receptacles due to damage or in order to interface with different communications lines or devices. The present invention provides these advantages which have not otherwise been available in the industry. Thus, the user can replace damaged receptacle structures, or replace the structure if other functions are necessary, quickly and without any difficulty.

Figure 15B:
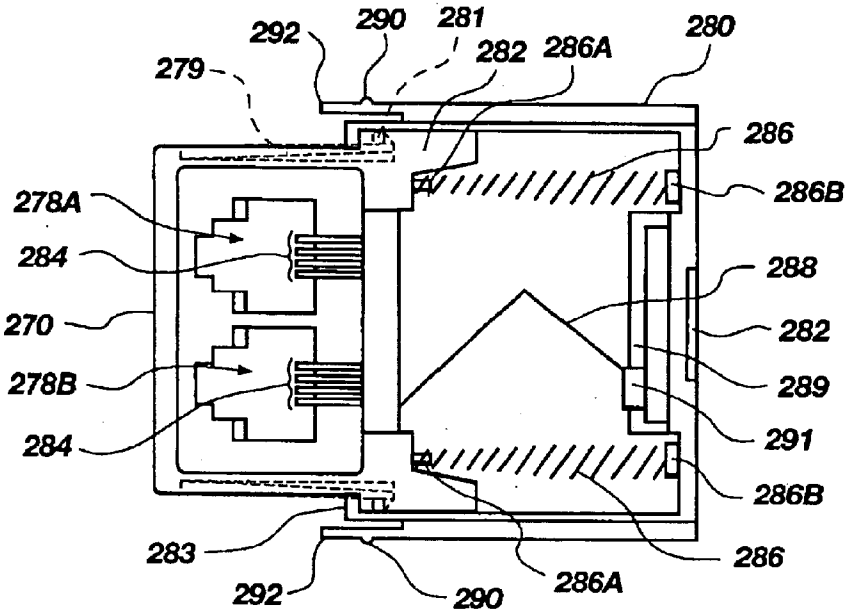
FIGS. 15A and 15B are top views showing the electrical interconnection between the receptacle module and the replaceable direct access arrangement (not shown in these figures) and the accompanying mechanism which retracts and extends the receptacle module into and out of the replaceable direct access arrangement.
Figure 15D:
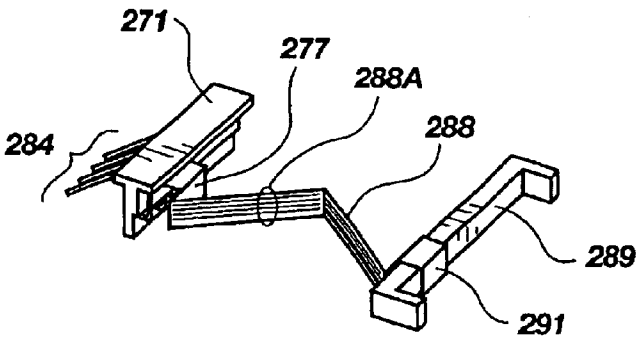
FIG. 15D is a detailed perspective view of the electrical interconnection circuit between the receptacle module and the frame.
Figure 15A:
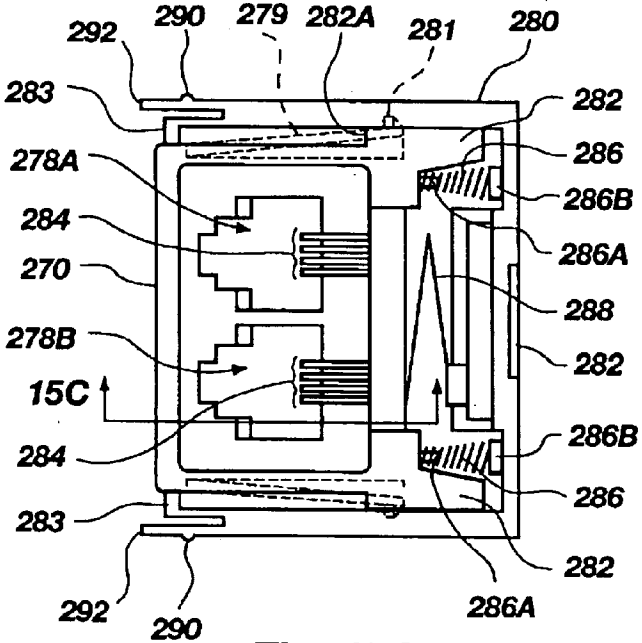

Represented in FIGS. 15A and 15B is a receptacle module 270 which includes two RJ-xx series receptacles, generally represented at 278A&B. FIG. 15A shows the receptacle module 270 in its retracted position. FIG. 15B shows the receptacle module 270 in its extended position. Each of the RJ-xx series receptacles 278A&B is provided with four conductors represented at bracket 284. It will be understood that the representation of the RJ-xx series receptacles described herein is exemplary of one presently preferred application with inclusion of other types of connectors and devices also being within the scope of the present invention.

A frame 280 is shown in FIGS. 15A&B. The frame 280 is, for example, received into a cavity (not represented in FIGS. 15A&B) provided in the replaceable DAA 258 and is held in place by locking ridges 290 which engage notches 273 (FIG. 14). An electrical connector represented at 282 in FIG. 15A-B provides electrical connection and provides further physical stability and can be selected by those skilled in the art using the information provided herein. The frame 280 is removed from the replaceable DAA 258 by the user squeezing together tabs 292 and the frame 280 being pulled from the replaceable DAA 258. It will be appreciated that the structures represented in FIGS. 15A&B can be incorporated into many different devices which are now available in the industry or which may become available in the future.

As represented in FIGS. 15A&B, the receptacle module 270 is biased in its extended position by springs 286. The springs 286 are held in place by posts 286A and 286B. A flexible interconnecting circuit 288 provides electrical connection between the connector 282 and the conductors 284. Further information regarding the interconnecting circuit 288 will be provided in connection with FIGS. 15C&D. As will be appreciated by those skilled in the art, the structures described herein provide the advantage of being more compact than previously possible following conventional teachings in the art.

Figure 15C:
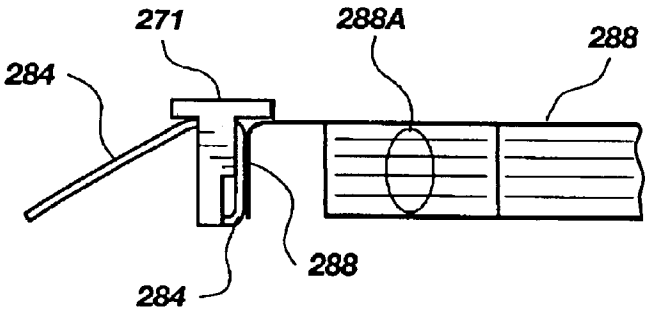
FIG. 15C is a detailed side view of the electrical interconnection circuit between the receptacle module and the by frame.

FIGS. 15C&D show a flexible interconnecting circuit 288 which provides a plurality of conductors indicated at 288A. The flexible interconnecting circuit 288, rather than utilizing pin and socket terminal connections, relies on surface mount connections thus making the structures more compact. The electrical signals received at the connector 282 (FIGS. 15A&B) are conveyed to conductors (not illustrated) formed on the surface of a bar 289 and a holding clip 291 presses the conductors 288A onto the appropriate conductors formed on the surface of the bar 289. The flexible interconnecting circuit 288 bends as necessary to accommodate the extension and retraction of the receptacle module 270.

To make a surface electrical connection with the conductors of the RJ-xx series receptacles, the conductors 284 p0being held in place by a member 271, the flexible interconnecting circuit 288 is folded so that the conductors 288A are pressed against a corresponding conductor represented at 284. The flexible interconnecting circuit 288 is held in place on the member 271 by a clip 277. The receptacle module 270 can provide electrical interconnection between the conductors 284 of the RJ-xx series receptacles 278A&B. Using the described structure, a reliable and compact arrangement is provided to make electrical connection with the RJ-xx series receptacles.

Referring again to FIGS. 15A&B, a pair of flexible arms 279 are each provided with a protruding knob 281 which is received into a groove formed in the inner surface of the frame which allows the receptacle module 270 to slide within the frame 280 and hold the receptacle module 270 in either, its extended or retracted position. Projecting from the side of the receptacle module 270 are wings 282 which provide further positional stability. The leading edge 282A of the wings 282 abuts a stop 283 on the frame to limit the extension motion of the receptacle module 270. The operation of the flexible arms 279 in the retraction and extension movement will be explained in further detail by reference to FIGS. 16A–D.

Figure 16B:
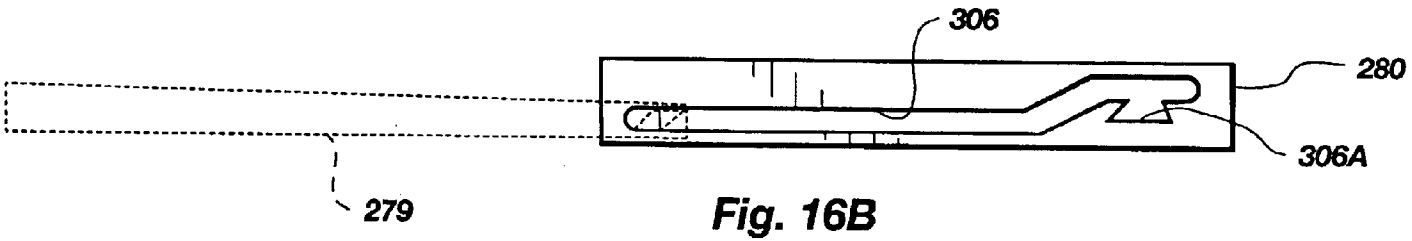
FIGS. 16A, 16B and 16C are side views.
Figure 16A:
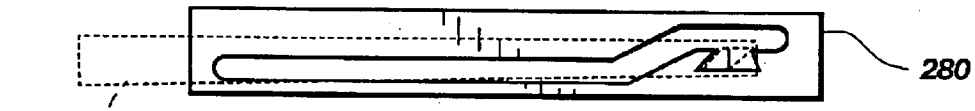

FIG. 16A is a side view of the inner surface of the frame 280 showing a groove 306 formed therein and the receptacle module 270 in its retracted position. As can be seen in FIG. 16A, the knob 281 is held in a trough 306A. The shape of the knob 281 and the shape of the trough 306A, together with the biasing action of the springs (286 in FIGS. 15A&B), keep the knob 281 in the trough 306A. When extension of the receptacle module (270 in FIGS. 15A&B) is desired, the user pushes in on the receptacle module 270 so that the sloping rear side of the knob 281 causes the free end of the flexible arm 279 to bend upward allowing the knob 281 to escape the trough 306A and move forward in the groove 306 to the extended position represented in FIG. 16B.

Figure 16C:
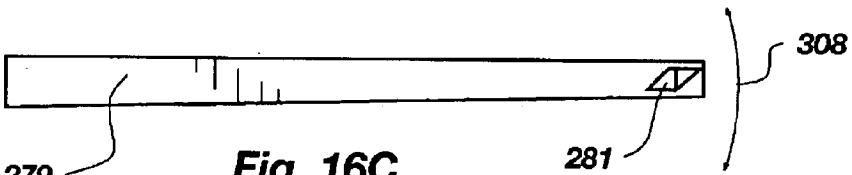
Figure 16D:
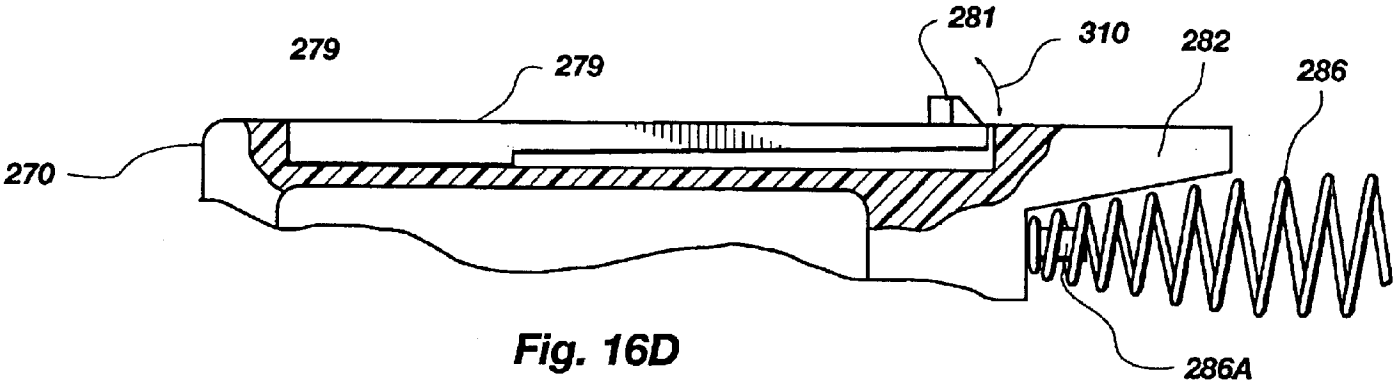
FIG. 16D is a top view, of a mechanism which functions to retract and extend the receptacle module into and out of the replaceable direct access arrangement.

FIG. 16C provides a side view of the flexible arm 279 showing its vertical movement as represented by arrow 308. FIG. 16D provides a top view of a portion of the receptacle module 270 further showing the shape of the knob 281 and the horizontal movement of the flexible arm 279. It will be appreciated that the described structures provide a simple and reliable arrangement for extending and retracting the receptacle module 270 and which advantageously is more compact than previously available structures. By making the retraction and extension structures more compact, more room is provided for other components.

Figure 17B:
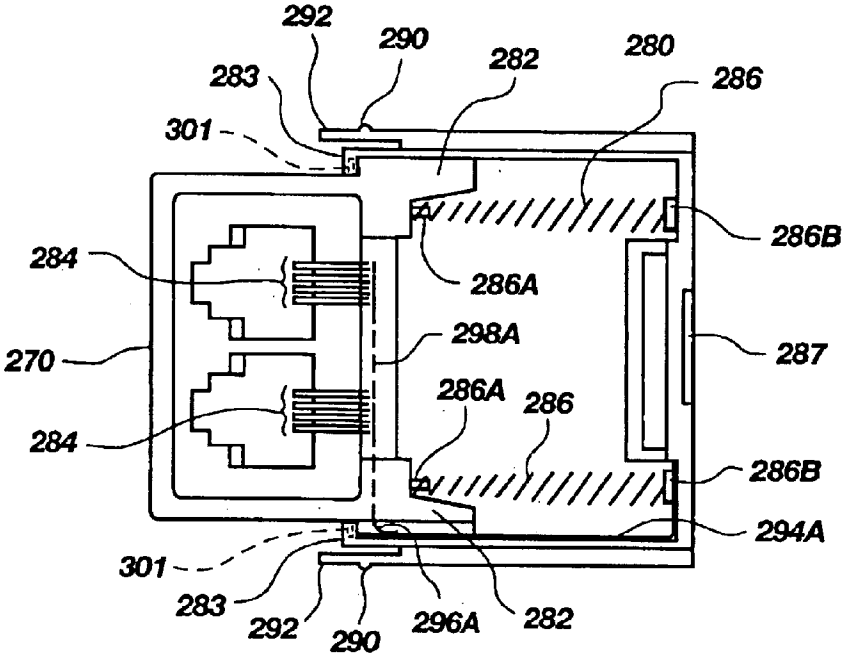
FIGS. 17A and 17B are top views showing the electrical interconnection between the receptacle module and the replaceable direct access arrangement and the accompanying mechanism which retracts and extends the receptacle module into and out of the replaceable direct access arrangement.
Figure 17C:
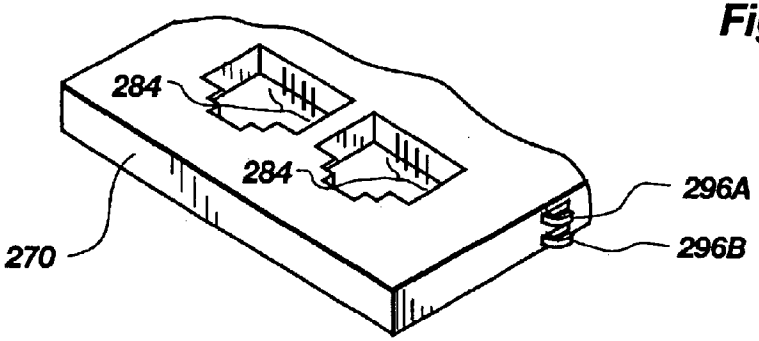
FIG. 17C is a detailed perspective view of the electrical interconnection circuit between the receptacle module and the frame represented in FIGS. 17A–B.
Figure 17A:
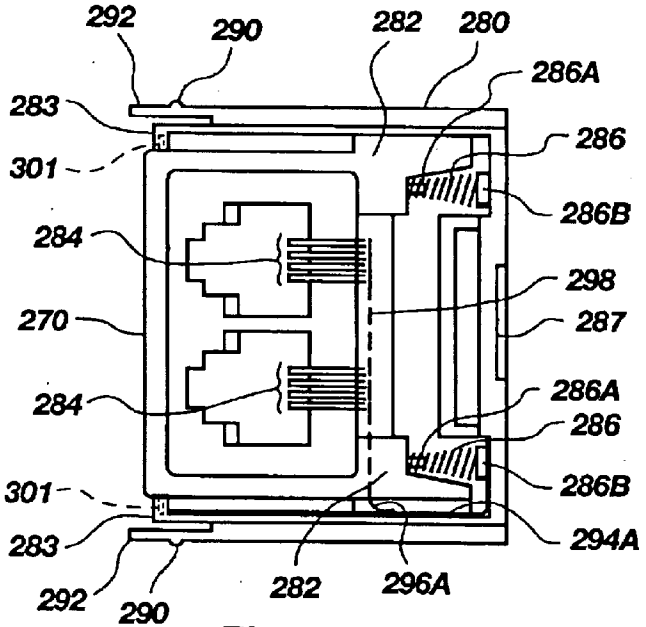

Reference will next be made to FIGS. 17A–C which illustrate in detail additional structures which allow the receptacle module 270 to extend out of or retract into the replaceable DAA 258 (shown in FIG. 14) and the electrical interconnection between the connector 287 and the conductors 284 in the RJ-xx series receptacles. Many of the structures represented in FIGS. 17A&B are the same as the correspondingly numbered structures represented in FIGS. 15A&B. Thus, only the differences between the represented structures will be described.

Represented in FIGS. 17A&B is one of at least two exposed conductors represented at 294A which is attached to the inner surface of frame 280. FIG. 17C shows two sliding electrical contacts 296A and 296B. The sliding electrical contacts 296A&B are preferably of the spring type to ensure that each of the sliding electrical contacts 296A&B makes solid electrical contact to each of the respective conductors, one of which is represented at 294A in the top views of FIGS. 17A&B. An electrical connection is made from the sliding electrical contacts 296A&B, through the receptacle module 270, and to the appropriate conductor 284. It will be understood that many variations on the electrical interconnection structures can be carried out within the scope of the present invention using the information set forth herein.

Figure 18A:
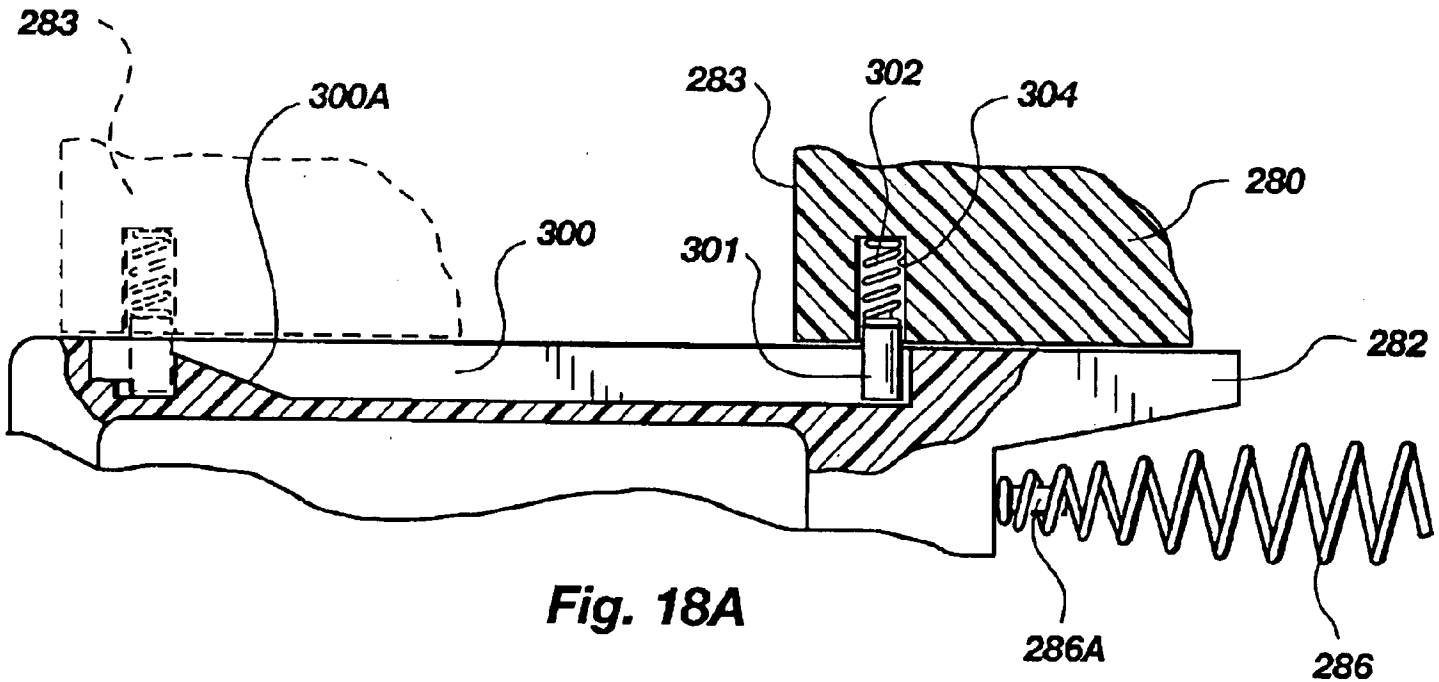
FIGS. 18A and 18B are top and side views, respectively, of a mechanism which functions to retract and extend the receptacle module into and out of the replaceable direct access arrangement.

FIGS. 18A&B will be referred to next to describe the structures which allow the receptacle module 270 to extend and retract. FIG. 18A is a cross sectional top view of the receptacle module 270 showing a groove formed therein. Still referring to FIG. 18A, provided on the inner surface of the stop 283 is a pin 301 which is held in a recess 304 and biased outwardly from the recess 304 by a spring 302. In FIG. 18A, the solid image of the stop 283 and the pin 301 shows their position in the groove 300 when the receptacle module 270 is in its extended position. The biasing force of the spring 286, partially represented in FIGS. 18A&B, holds the receptacle module 270 in its extended position.

Figure 18B:
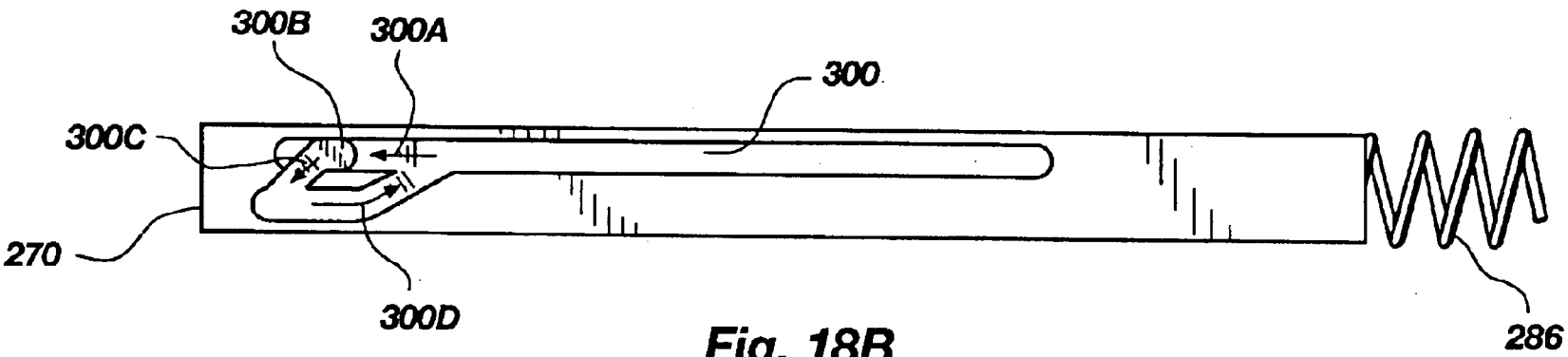

Reference will now be made to both FIGS. 18A and 18B to explain the movement of the receptacle module 270 from its extended position to its retracted position. When the receptacle module 270 is to be moved to its retracted position, the user (not represented in the figures), pushes the receptacle module 270 toward the frame 280. The pin 301 travels in the groove 300 up the ramp 300A and into the well 300B where the pin 301 is held. The retracted position of the receptacle module 270 is represented by the phantom image in FIG. 18A. To move the receptacle module 270 from its retracted position to its extended position, the user again pushes the receptacle module 270 inward toward the frame 280 which causes the pin 301 to move out of the well 300B up a ramp indicated by arrow 300C. The user then releases the receptacle module 270 which allows the receptacle module 270 to extend and the pin 301 to travel down a ramp indicated by arrow 300D where the pin 301 again enters groove 300 and the receptacle module 270 completes its extension.

Figure 19B:
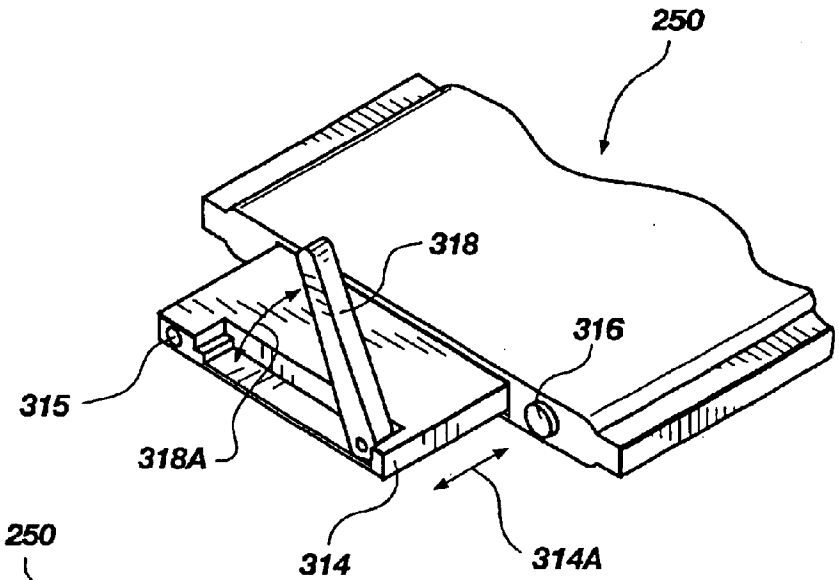
FIGS. 19A–C are perspective views of three different antenna configurations which may be included in embodiments of the present invention.
Figure 19C:
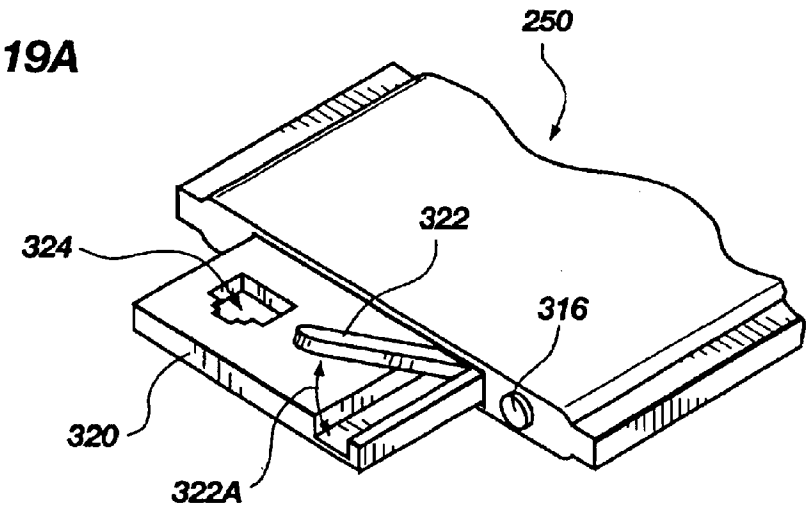
Figure 19A:
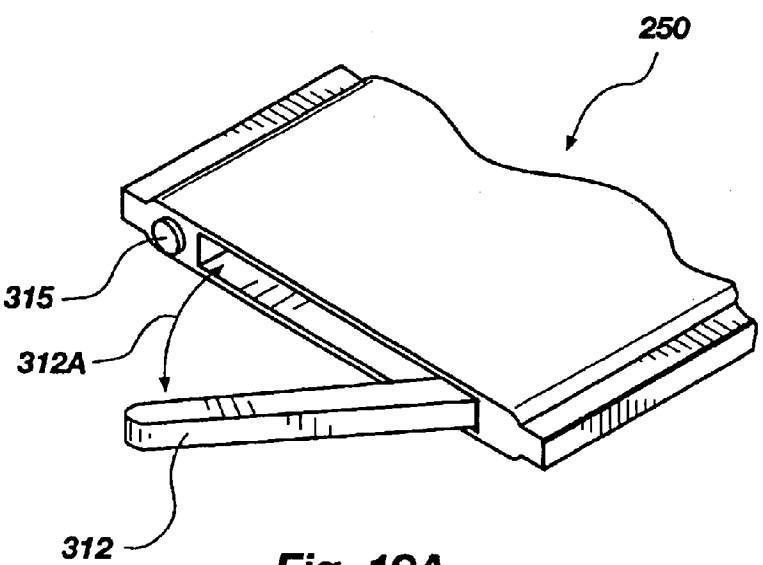

Reference will next be made to FIGS. 19A–C. In order to accommodate wireless communication between the communications card and a wireless communication system, an antenna is provided on the communications cards represented in FIGS. 19A–C. The embodiments of the present invention illustrated in FIGS. 19A–C are particularly adapted for accommodating cellular telephone signals but those skilled in the art can readily adapt the embodiments to accommodate other communication systems, including those utilizing radio frequency techniques as well as other mediums.

FIG. 19A illustrates an antenna 312 which pivots into and out of the end of the communications card 250 in the directions of arrow 312A. When use of the antenna is desired, the user depresses a release button 315 which allows the antenna to pivot out of the end of the communications card.

FIG. 19B illustrates an antenna 318 which is pivotally mounted on a retractable block 314. When use of the antenna is desired, the user depresses a release button 315 which allows the antenna 318 to pivot in the directions of arrow 318A. The retractable block 314 can be stored within the communications card and extended and retracted in the directions of arrow 314A and released from its retracted position by depressing button 316.

FIG. 19C illustrates an antenna 322 which is pivotally mounted on a retractable block 320. The retractable block 320 is extended by depression of button 316. When the retractable block 320 is extended, the antenna 322 is pivoted up or down in the direction of arrow 322A. Also provided on the retractable block 320 is a receptacle 324 allowing a communications line to also be attached thereto.

Each of the arrangements represented in FIGS. 19A–C can be best adapted for use with particular types of antenna which may assume shapes and sizes very different than the illustrated antennas. For example, antennas which are vertically polarized, horizontally polarized, or circularly polarized can have application with the embodiments of the present invention. Moreover, the antennas used with the embodiments illustrated in FIGS. 19A–C can include components which extend or further pivot to increase the length of, or change the shape of, the antenna. Those skilled in the art will appreciate that the components necessary to carry out wireless communication, such as cellular telephone communication, can be packaged in the communications card 250 or in a DAA adapted for such purpose. Further information regarding wireless computer networks can be obtained from IEEE 802.11 Standard (and any available drafts thereof) which is now incorporated herein by reference in its entirety.

Figure 20:
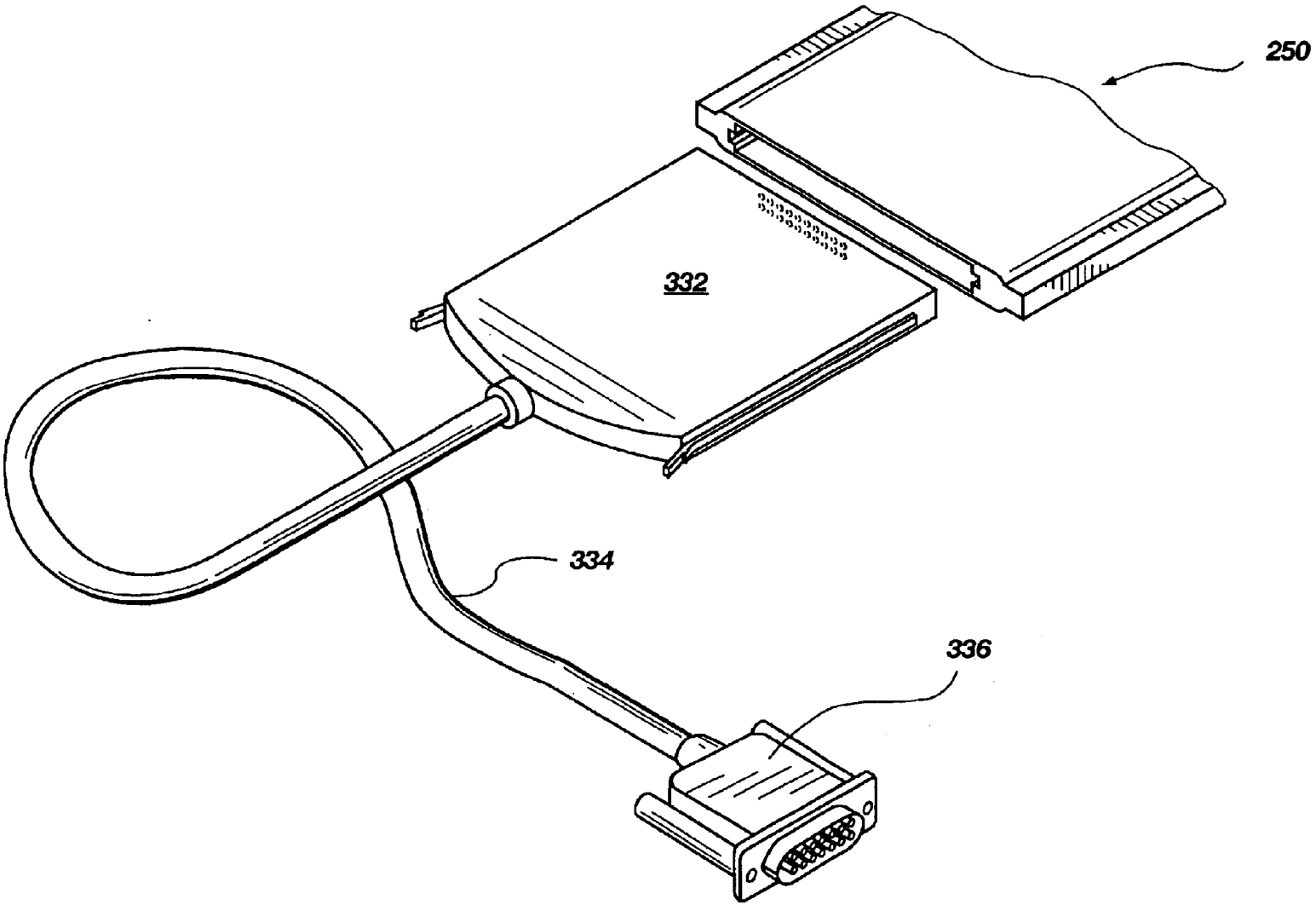
FIG. 20 is a perspective view of an embodiment of the present invention which is adapted for use with a portable cellular telephone.

Reference will next be made to FIG. 20 which shows a communication card 250 and a replaceable DAA 332 which are adapted to interface with a portable cellular telephone via a cable 334 and a connector 336 which attaches directly to a corresponding connector (not illustrated) on the portable cellular telephone (not illustrated). It will be appreciated that those skilled in the art will be able to provide replaceable DAAs 332 and connectors 336 which are adapted to function with any number of cellular telephones or other communications devices and which allow the user to easily and quickly change the application to which the communications card is put.

Figure 21:
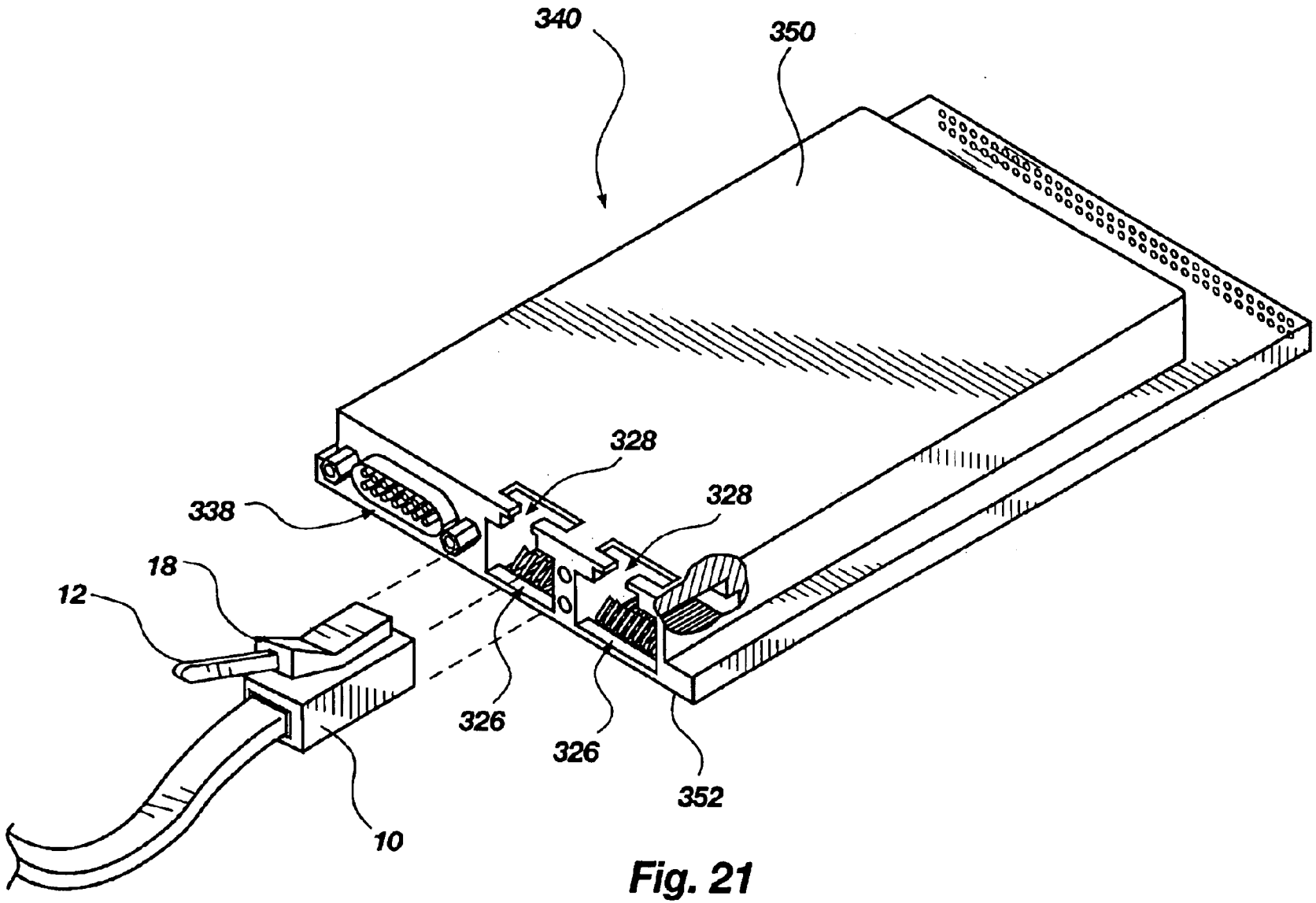
FIG. 21 is a perspective view of a communications card in accordance with the present invention having an RJ-xx series receptacle placed directly in the end thereof.

Reference will next be made to FIG. 21. FIG. 21 provides a perspective view of a communications card generally designated 340. The communications card 340 follows the PCMCIA (also referred to as PC Card) Type III standard for dimensions and configuration. The height of a PCMCIA Type III card is still not great enough to allow a standard RJ-xx series receptacle to be mounted therein. In the communications card 340 illustrated in FIG. 21, a T-shaped cutout 328 is removed from the housing of the communications card 340. The T-shaped cutout 328 accommodates the biased clip 12 and the ridge 18 present on the plug 10. The shape of the T-shaped cutout 328 engages the biased clip 12 and the ridge 18 to hold the plug 10 in place. Represented in FIG. 21 are two receptacles, each generally designated at 326. Preferably, one of the receptacles 326 is an eight conductor RJ-45 receptacle, which is called for in some computer network standards, and the other of the receptacles 326 is an RJ-11 receptacle. As can be seen in the figures, and particularly in FIG. 21, the PCMCIA Type III PC card 340 includes an upper surface 350 and a lower surface 352 which form a portion of the housing for the communication card 340. Also represented in FIG. 21 is a connector 338 which can be used to make a connection to another communication device (in a manner similar to that described in connection with connector 336 illustrated in FIG. 20), as is known in the art.

Figure 21A:
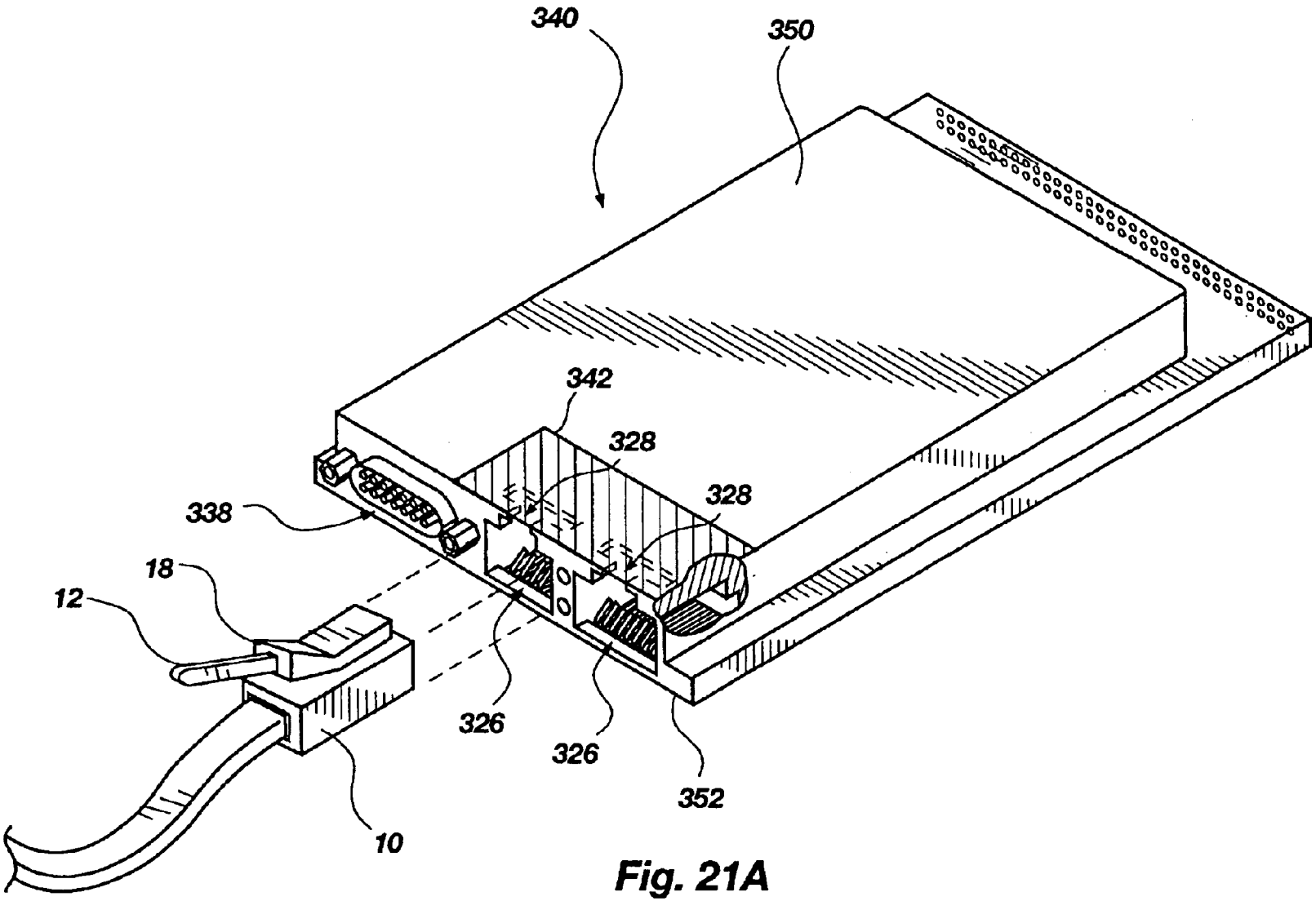
FIG. 21A is a perspective view of another communications card in accordance with the present invention having an RJ-xx series receptacle placed directly in the end thereof.

Reference will next be made to FIG. 21A which shows all of the structures represented in FIG. 21 with the inclusion of a cover 342 which shields the T-shaped cutouts 328 and the receptacles 326. The cover 342 is preferably a thin membrane-like material which is attached to, or integral with, the upper surface. The cover can preferably be fabricated from a material having a thickness in the range from about 0.001 inch to about 0.050 inches thick such that the card 340 maintains compliance, or substantial compliance, with the pertinent PCMCIA card physical thickness standard. It is also within the scope of the present invention to fabricate the cover 342 from an elastic material. Moreover, the cover 342 can be structured to straddle the entire upper surface 350 of the PC Card 340, or just a portion of the upper surface 350, as deemed best for the particular application of the invention.

Figure 22:
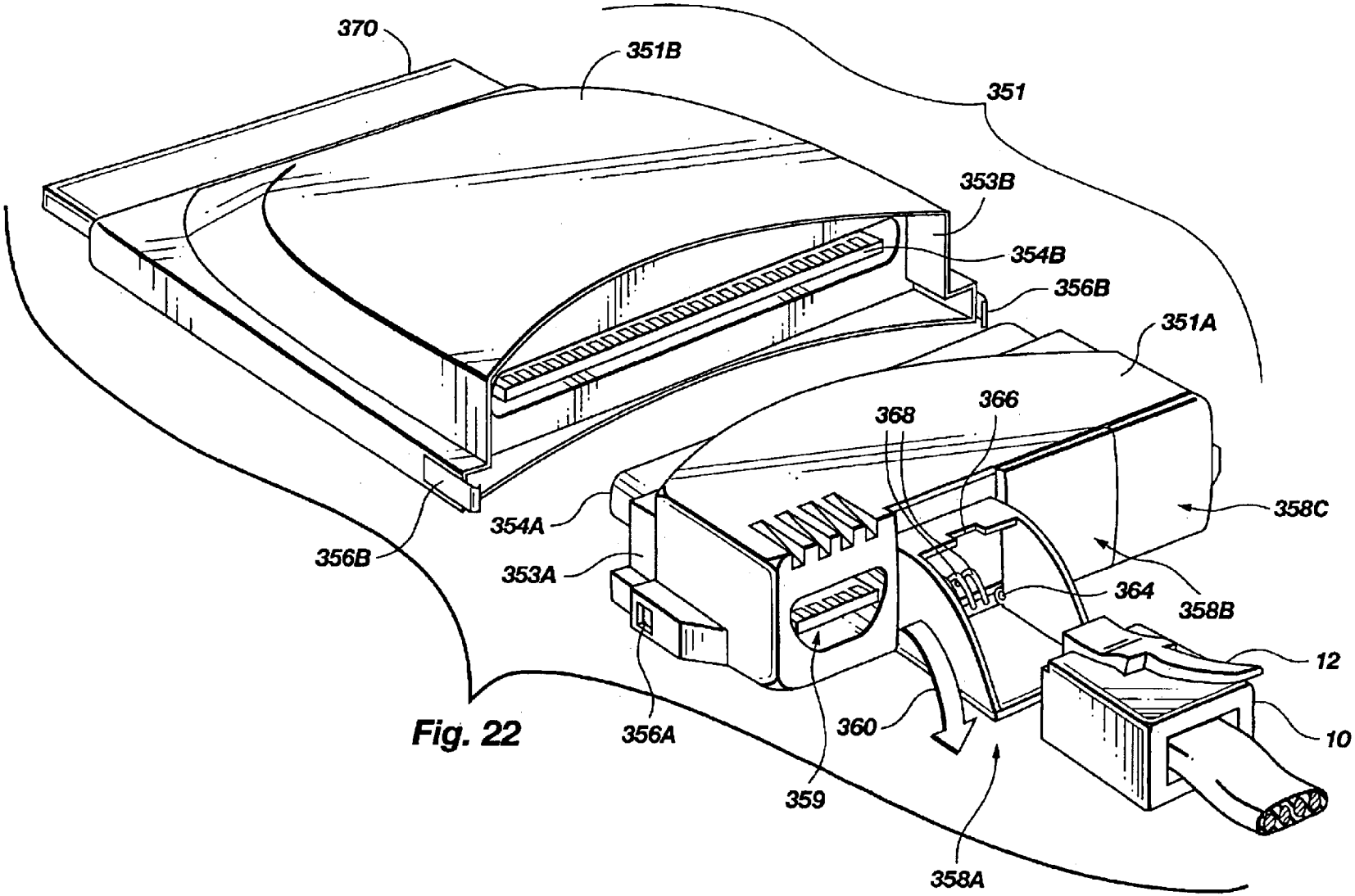
FIG. 22 is a perspective view of a communications card in accordance with the present invention having a plurality of RJ-xx series receptacles with pivoting covers positioned in an end thereof.

Reference will next be made to FIG. 22. FIG. 22 is a perspective view of another communications card, generally indicated by the bracket 351, in accordance with the present invention. The communications card 351 preferably follows the PCMCIA (also referred to as PC Card) Type III standard for dimensions and configuration. The communications card 351 has a plurality of RJ-xx series receptacles 358A–C which are each provided with a pivoting cover, one of which is indicated at 362. The pivoting cover 362 pivots about pin 364 as represented in FIG. 22.

The communications card 351 includes two major components, a card body 351B and a connector housing 351A. Many of the embodiments of the present invention described hereinafter will have a similar structure and the description provided now will apply to all similarly structured embodiments. The card body 351B includes a front end 370 which provides connector sockets in accordance with the PCMCIA standard. The connector housing 351A provides the necessary physical/electrical components to connect to one or more communications lines. For example, the connector housing 351A includes RJ-xx series receptacles 358A–C and an auxiliary connector, generally indicated at 359, which preferably can be a connector suitable for coupling to a wireless communications device, for example a portable telecommunications device which complies with the GSM (Global System for Mobile Communications). communications standard. The connector housing 351A also preferably includes the DAA components such as those described earlier and others which perform similar functions.

The connector housing 351A can be removed from the card body 351B and replaced with another connector housing 351A in case a connector housing 351A becomes damaged, if another DAA is needed by a user, and/or if different connectors are needed. It is also to be appreciated that the card body 351B and connector housing 351A arrangement illustrated in FIG. 22 provide advantages even if the distribution of components is different than that preferably described herein, for example, if the DAA is located in the card body 351B rather than in the connector housing 351A.

Still referring to FIG. 22, to provide a secure mating between the card body 351B and the connector housing 351A, a female portion 353B receives a male portion 353A when the connector housing 351A is mated to the card body 351B. Moreover, the structure of the electrical connector which provides for communications between the card body 351B and the connector housing 351A, comprising a connector receptacle 354B and a connector plug 354A, further enhances the physical and electrical connection between the card body 351B and the connector housing 351A. Two spring fingers 356B are received by recesses, one of which is represented at 356A, to further secure the card body 361B and the connector housing 351A together. It is to be appreciated that the structures illustrated in FIG. 22, and the other figures herein described, are merely exemplary and many different connector configurations can be used within the scope of the present invention.

When the connector housing 351A and the card body 351B are joined together, and the communications card 351 is received into a computing device, communications via a communications line, such as that shown connected to the RJ plug 10, is ready to occur. A pivoting cover, such as that represented at 362, is provided for each one of the RJ-xx series receptacles 358A–C. The RJ-xx series receptacles 358A–C can be fabricated to receive any of the RJ-xx series plugs, such as RJ-11, RJ-12, and RJ-45 plugs. With the pivoting covers in the closed position, the components of the connector housing 351A are protected and the overall length of the communications card 351 is reduced. When the pivoting cover, for example pivoting cover 362, is moved in the direction of arrow 360, the RJ plug 10 can be inserted into the recess formed by the pivoting cover 362. A ledge 366 engages the biased clip 12 and holds a plurality of spring conductors 368 in electrical contact with the corresponding contacts in the RJ plug 10 when inserted therein.

Those skilled in the art will readily be able to arrive at numerous alternative structures capable of providing the electrical functions required by the connector housing 351A and the card body 351B using the information set forth herein and known in the industry. Thus, when the pivoting cover 362 is open as illustrated in FIG. 22, an RJ plug is inserted therein and communications via a communications line can efficiently occur.

Reference will next be made to FIG. 22A which is a detailed perspective view of another of RJ-xx series receptacle, generally referred to at 355A, which includes a pivoting cover 355B. As understood by those skilled in the art, the receptacle 355A can readily substitute for the pertinent structures represented in FIG. 22. In FIG. 22A, the pivoting cover 355B has been lowered to an operative position wherein an RJ-xx series plug (not represented in FIG. 22A) can be received into the receptacle 355A. When the pivoting cover 355B is in its operative position, the electrical contacts 365A&B are ready to receive corresponding contacts provided on an RJ-xx series plug.

FIG. 22B will be referred to next to provide further information on the structure represented in FIG. 22A. FIG. 22B is an elevated, side cross sectional view of the receptacle represented in FIG. 22A showing the pivoting cover in its operative position ready to receive an RJ-xx series plug. The pivoting cover 355B rotates about pivot point 355C between the operative position represented in FIG. 22C and movement towards a closed position which is represented in FIG. 22D as suggested by arrow 367A. It will be appreciated that FIG. 22D shows the pivoting cover 355B between its closed position and its open position and that the pivoting cover can attain a completely closed position in the direction of arrow 367A.

With the pivoting cover 355B in its operative position, the side walls of the pivoting cover 355B guide an RJ-xx series plug into engaging contact with electrical contacts 365A&B so that an appropriate electrical circuit is completed between the RJ-xx series plug inserted therein and the communications card in which the receptacle 355A is installed. To securely hold the RJ-xx series plug in its proper place, a pivoting clip holder 357 is shown in an operative position in FIG. 22A.

As best explained referring to FIG. 22A, the pivoting clip holder 357 holds the biased clip 12 (see FIG. 1) of the RJ-xx series plug so that the RJ-xx series plug is in secure engagement with the electrical contacts 365A&B. The shape of an aperture 357B (FIG. 22A) provided in the pivoting clip holder 357 engages the ridge 18 formed on the RJ plug body biased clip 12 (the ridge 18 is best seen in FIG. 2).

FIG. 22B shows a pivot point 375A about which the pivoting clip holder 357 rotates. In FIG. 22B, the pivoting clip holder 357 is shown in an operative position (as shown in FIG. 22A) with the pivoting clip holder shown in a partially closed position at 357D. A biasing mechanism, such-as spring 369 represented in FIG. 22E, is preferably installed about the pivot point 357A to bias the pivoting clip holder 357 into the position represented by arrow 367B in FIG. 22D. An alternative biasing mechanism can be installed about the pivot point 355C to properly bias the pivoting cover 355B.

FIG. 22C provides a side view of the pivoting cover 355B and the pivoting clip holder 357 when they are in their operational positions. FIG. 22D similarly provides a side view of the pivoting cover 355B and the pivoting clip holder 357 being moved in the directions of arrows 367A and 367B, respectively, toward their closed storage positions.

As with many of the embodiments of the present invention described herein, the embodiment of the present invention illustrated in FIGS. 22A–E provides an advantageous structure which easily makes a secure connection to an standard RJ-xx series plug which requires less space inside of the communications card than other structures (compare the amount of space inside the upper and lower surfaces of the communications card represented in FIG. 21 which is required by the structures which accommodate the RJ-xx series plug) so that additional space in the communications card can be devoted to circuitry necessary to carry out communications functions. Moreover, the structures represented in FIGS. 22A–E, when in their closed storage position, substantially comply with the PCMCIA/PC Card physical dimension limitations. Moreover, when the structures represented in FIG. 22A-E are in their closed storage position the pertinent structures are kept from damage and breakage.

Figure 23:
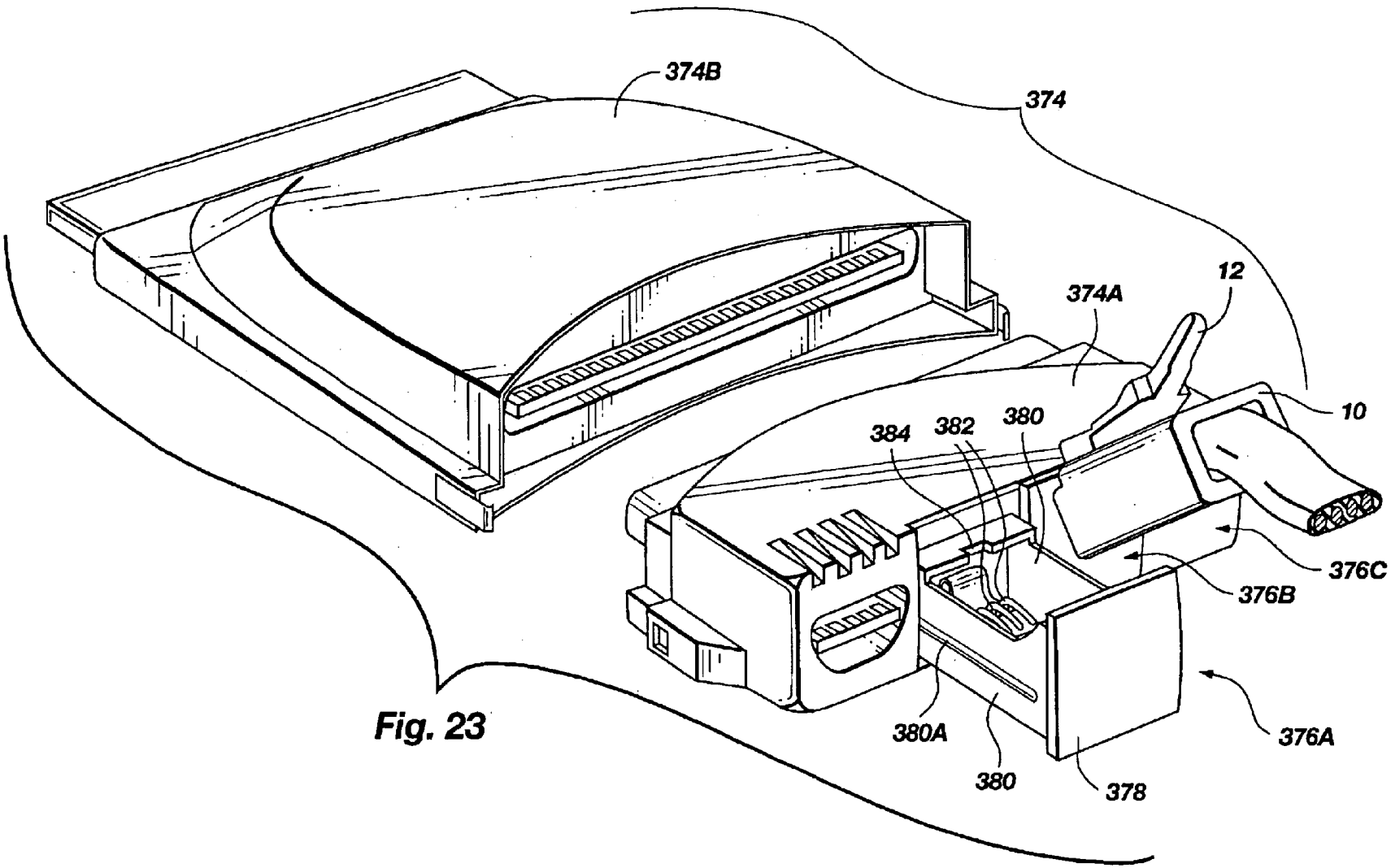
FIG. 23 is a perspective view of a communications card in accordance with the present invention having a plurality of RJ-xx series receptacles located in sliding drawers positioned on the end of the communications card.

Reference will next be made to FIG. 23. FIG. 23 is a perspective view of another communications card, generally indicated by bracket 374. The communications card 374 includes many of the structures described in connection with communications card 351 illustrated in FIG. 22. Thus, only the different and/or additional structures will be discussed in connection with the communications card 374 represented in FIG. 23.

As shown in FIG. 23, a card body 374B and a connector housing 374A are included in the communications card 374. The connector housing 374A encloses three RJ-xx series receptacles which are contained in sliding drawers, generally indicated at 376A–C. The sliding drawers 376A–C each include a drawer front, one of which is shown at 378, and drawer sides, represented at 380. Drawer ridges, one of which is shown at 380A, are provided on the drawer sides 380 and are one example of a structure which can be used to allow the sliding drawers to retract into, and extend from, the connector housing 374A. When the sliding drawers 376A–C are in their closed position, the internal components of the connector housing 374A are shielded from damage and contamination.

As represented in FIG. 23 at sliding drawer 376A, when an RJ plug 10 is to be connected, the sliding drawer 378 is extended from the connector housing 374A, and the RJ plug 10 is inserted therein at an angular orientation as represented in FIG. 23. The sliding drawers 376A–C include structures to hold the RJ plug 10 at the preferred angular orientation when the RJ plug 10 is inserted therein. As the RJ plug 10 is received into the sliding drawer 376A the biased clip 12 engages a ledge 384 which holds the electrical contacts of the RJ plug 10 in continuity with a plurality of conductors, indicated at 382 in the sliding drawer 376A. Those skilled in the art will readily be able to arrive at numerous different structures which provide the electrical functions to be carried out by the connector housing 374A and the card body 374B using the information set forth herein and known in the industry. When the communications card 374 is not being used, all of the sliding drawers 376A–C are closed and components of the connector housing 374A are protected from damage and the overall length of the communications card 374 is preferably and substantially within the PCMCIA Type III standard. Desirably, as is the case with the other embodiments of the present invention described herein, the components which carry electrical current from the communications line are shielded from contact with structures in the surrounding environment thus preventing the contacts from being inadvertently shorted together or shorted to ground or conveying current to a human being.

Figures 23A, 23B, 23C:
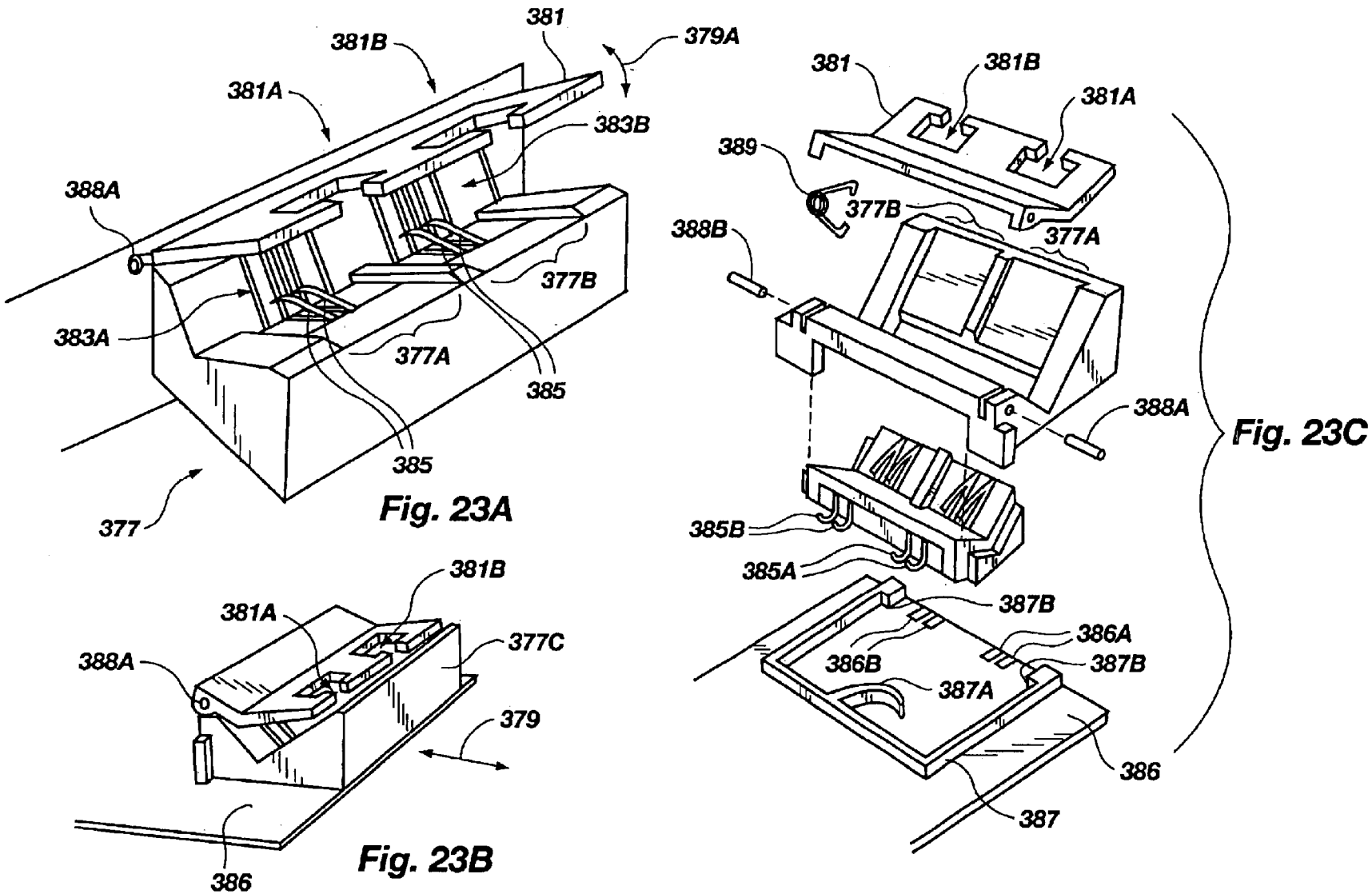
FIG. 23A is a partial perspective view of a communications card in accordance with the present invention having a plurality of RJ-xx series receptacles located in a sliding drawer provided at one end of the communications card the sliding drawer shown in a extended, operational configuration.
FIG. 23B is a partially transparent perspective view of the communications card represented in FIG. 23A wherein the sliding drawer is shown in a closed storage configuration.
FIG. 23C is an exploded perspective view showing additional detail of the components represented in FIGS. 23A–B.

Reference will next be made to FIG. 23A. FIG. 23A is a partial perspective view of a communications card in accordance with the present invention having a plurality of RJ-xx series receptacles located in a sliding drawer, generally represented at 377, provided at one end of a communications card with the sliding drawer 377 shown in an extended operational configuration.

The communications card 374 can preferably include many of the components described in connection with the communications card 351 illustrated in FIG. 22. Thus, only the different and/or additional structures will be discussed in connection with the communications card represented in FIGS. 23A–C.

As shown in FIG. 23A, a sliding drawer, generally indicated at 377 is provided with two RJ-xx series receptacles, each generally referred to at 383A and 383B, respectively. The sliding drawer 377 includes a drawer body 377C and two receptacle grooves 377A and 377B. The drawer body 377C slides into and out of the communications card in the directions indicated by arrow 379. It will be appreciated that the receptacle grooves are one preferred arrangement for a recess means and that any structure which function to hold a plug is intended to fall within the scope of the present invention, regarding both the embodiment of the present invention represented in FIGS. 23A–C and all other embodiments represented herein.

Also represented in FIG. 23A is a clip holder 381. The clip holder 381 is provided with two apertures 381A&B. The clip holder 381 holds the biased clip 12 (see FIG. 1) of the RJ-xx series plug in the proper position so that the RJ-xx series plug is in secure engagement with the electrical contacts 385. The clip holder 381 includes apertures 381A&B.

The shape of the apertures 381A&B provided in the clip holder 381 allows the ridge 18 formed on the biased clip 12 to be engaged so that the electrical contacts in the plug make secure electrical contact with the electrical contacts 385 and thus provide electrical continuity with other communications components. A spring 389 is one preferred structure which functions as a means for biasing the clip holder 381 in the proper direction. It is to be understood that the spring 389, and all other springs and live hinges described herein in connection with all of the embodiments of the present invention set forth herein, are exemplary of the structures which can function as a means for biasing within the scope of the present invention.

The described structure provides secure electrical connection yet, as with the other structures described herein, easy removal of the plug is possible when removal is desired. The clip holder 381 pivots about pivot points 388A and 388B (see FIG. 23C).

FIG. 23A shows the drawer 377 in its extended operational position. FIG. 23B shows a partially transparent perspective view of the drawer 377 in a closed storage configuration. When in the closed storage position the drawer 377 preferably fits within the thickness and length limitations of the PCMCIA/PC Card standards, and more preferably within the PC Card Type III thickness (namely it fits between the upper and lower surfaces of the communications card) and length standards. The user can readily extend and retract the drawer 377 in the directions indicated by arrow 379. When the drawer 377 is in its closed storage position, the connector components are shielded from damage and contamination. Most preferably the overall length of the communications card wherein the structures represented in FIG. 23A-C are installed is preferably and substantially within the one or more of the PCMCIA standards, for example the Type III standard. Desirably, as is the case with the other embodiments described herein, the components which carry electrical current from the communications line are shielded from contact with structures in the surrounding environment thus preventing the contacts from being inadvertently shorted together or shorted to ground or conveying current to a human being.

Referring again to FIG. 23A, when an RJ series plug 10 is to be connected to the communication card, the drawer 377 is extended from the communications card and an RJ-xx series plug can be received into each one of the receptacle grooves 377A and 377B. The receptacle grooves 377A and 377B hold the RJ-xx series plug in a correct lateral position on the drawer 377 with the clip holder 381 keeping the RJ-xx series plug in the receptacle groove and against the electrical contacts 385.

FIG. 23C is an exploded perspective view showing much of the internal arrangement of the components represented in FIGS. 23A–B. As represented best in FIG. 23C, the pivot points 388A&B about which the clip holder 381 rotates are inserted through holes in the clip holder 381 and into holes in the drawer body 377C.

As shown best in FIG. 23C, the drawer body 377C is supported on a circuit board 386. Movement of the drawer body 377C in the directions of arrow 379 is guided by a guide rail structure 387. Provided on the guide rail structure 387 is a biasing mechanism, such as a live hinge 387A, which biases the drawer body 383A toward its open operative position represented in FIG. 23A. Stops 387B are provided on the guide rail structure 387 so that the drawer body 377C travels the correct distance out of the communications card and so that the drawer body contacts 385A&B meet the circuit board contacts 386A&B so that complete electrical communications can occur.

As discussed in connection with other embodiments of the present invention, the embodiment of the present invention represented in FIGS. 23A–C allows rapid and easy connection of a communications plug and also allows convenient storage when the communications card is not being used. When the communications card is not being used, the pertinent components illustrated in FIGS. 23A–C are protected from damage and the overall length of the communications card is preferably and substantially within the PCMCIA/PC Card standard, for example the PCMCIA Type III standard. Also, as is the case with the other embodiments described herein, the components which carry electrical current from the communications line are shielded from contact with structures in the surrounding environment thus preventing the contacts from being inadvertently shorted together or shorted to ground or conveying current to a human being.

Figure 24A:
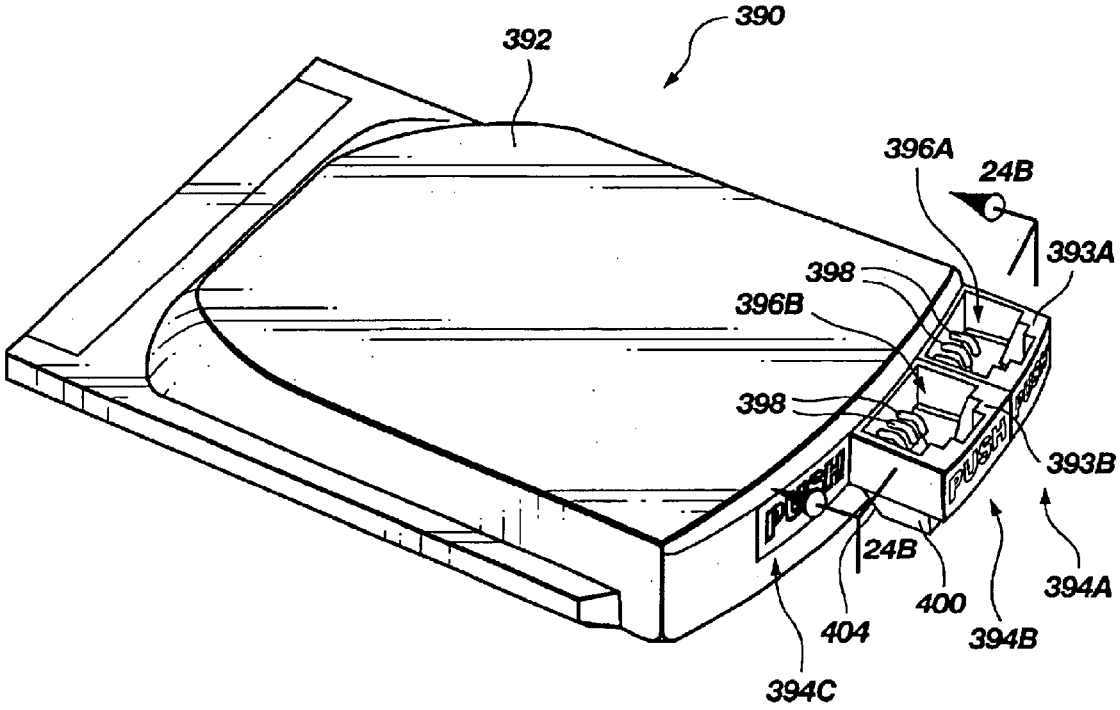
FIG. 24A is a perspective view of a communications card in accordance with the present invention having a plurality of RJ-xx series receptacles positioned in sliding drawers with each drawer provided with a movable bottom.

FIG. 24A will be referred to next to describe another communications card within the scope of the present invention, generally indicated at 390. FIG. 24A is a perspective view of the communications card 390 which includes a plurality of RJ-xx series receptacles positioned in sliding drawers, the sliding drawers being generally indicated at 394A–C, with each of the sliding drawers 394A–C being provided with a movable bottom 400 which functions to shield electrical conductors 398 from contact with the surrounding environment. A card body 392 preferably includes the components necessary to provide the communications functions which are desired by the user and which can be arrived at by those skilled in the art using the information set forth herein and using the information readily available in the industry.

Figure 24B:
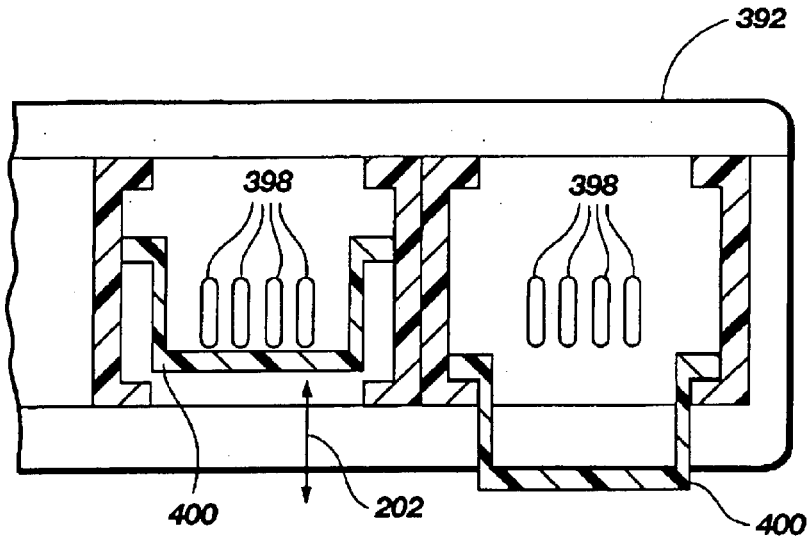
FIG. 24B is a cross sectional view taken along line 24B—24B of FIG. 24A.

As shown best in FIG. 24B, which is a cross sectional view taken along line 24B—24B of FIG. 24A, the structure of the sliding drawers 394A–C each include a movable bottom 400. FIG. 24B shows the movement in the direction of arrow 402 of the movable bottom 400 to shield the electrical conductors 398 when there is no RJ plug present and the position of the movable bottom 400 when an RJ plug is received into the recess, two of which are indicated at 396A&B in FIG. 24A, when an RJ plug is received therein.

As will be appreciated from an examination of FIG. 24A, the recesses 396A&B include structures, such as ledges 393A&B, to engage the biased clip of the RJ plug. Also as shown in FIG. 24A, the moveable bottom 400 preferably includes a bevel 404 to urge the movable bottom 400 in an upward position when the sliding drawers 394A–C are moved into their retracted position.

Figure 24D:
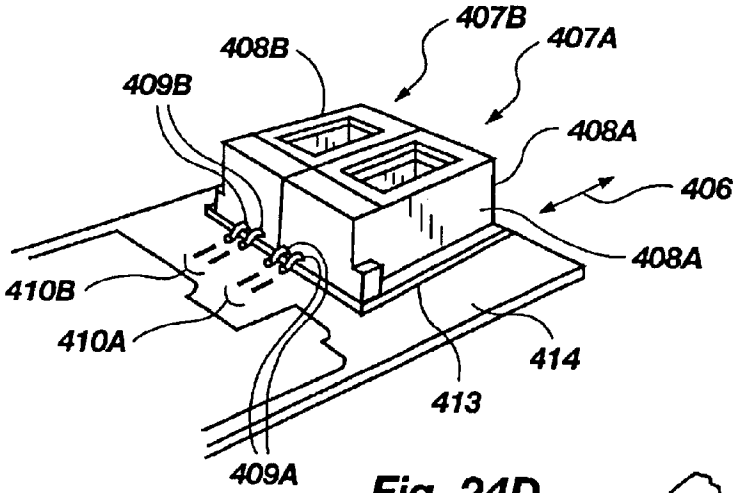
FIG. 24D is a perspective view showing the position of the sliding drawer on a printed circuit board.
Figure 24E:
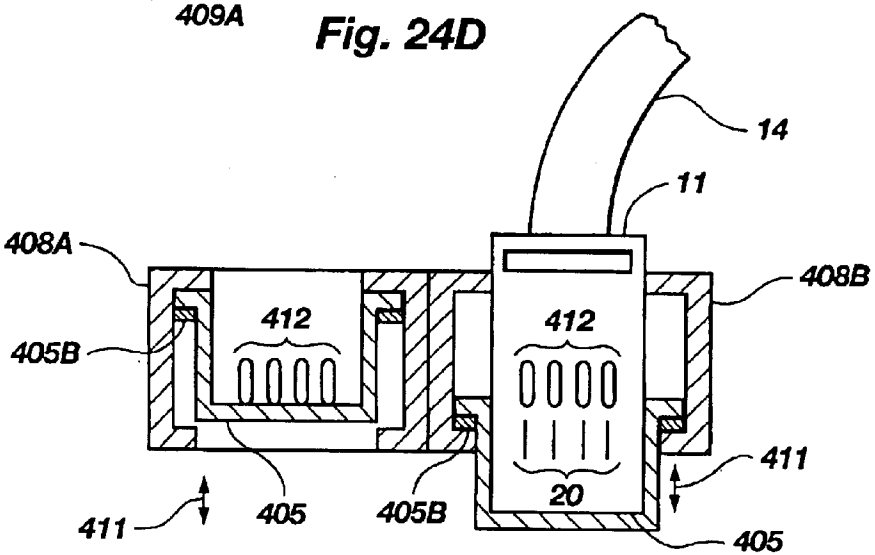
FIG. 24E is an elevated cross sectional end view of two sliding drawers with one sliding drawer being in an extended operational position with an RJ-xx series plug inserted therein and with one sliding drawer being in a closed storage position.
Figure 24C:
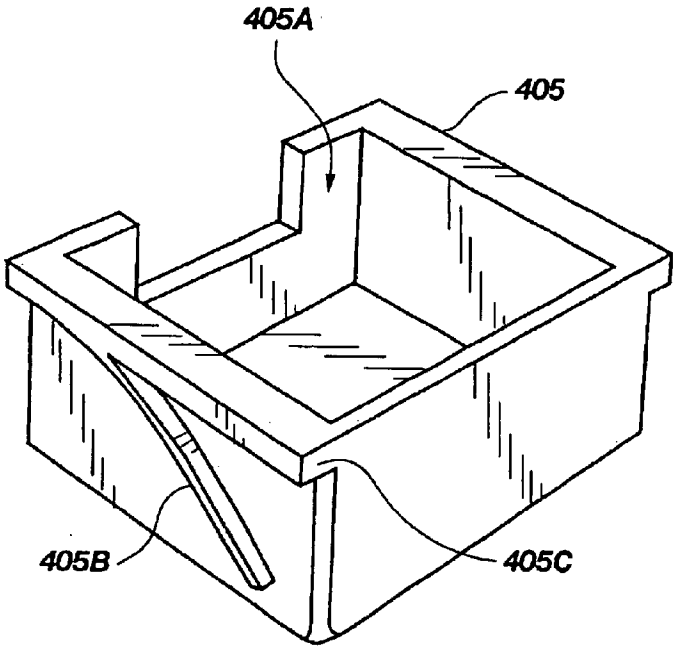
FIG. 24C is a perspective view of another preferred arrangement for the sliding drawer represented in FIG. 24A.

Reference will next be made to FIGS. 24C–E for an explanation of alternative embodiments which can be used in a fashion similar to the embodiments illustrated in FIGS. 24A&B. FIG. 24C is a perspective view of another preferred arrangement for a bottom portion of a sliding drawer 405, similar to that represented in FIG. 24A. The sliding drawer bottom 405 includes a central opening into which the RJ-xx series plug is inserted during use. The sliding drawer bottom. 405 also includes a live hinge 405B which functions to push the sliding drawer bottom 405 upwards, to allow retraction of the drawer, unless an RJ-xx series plug is inserted therein. FIG. 24D provides a perspective view showing two sliding drawer assemblies, generally designated at 407A and 407B, respectively, in position on a circuit board 414. Each of the two sliding drawer assemblies 407A and 407B include an upper drawer portion, 408A&B, respectively, which slide between an extended operable position and a retracted storage position (illustrated in FIG. 24D) as indicated by arrow 406. A guide rail 413 functions to properly position the sliding drawers 407A&B and to limit their travel from off the circuit board 414. Electrical signal continuity is maintained by the two sets of sliding contacts 409A&B and the corresponding two sets of electrical tracks 410A&B, partially represented in FIG. 24D. It is also within the scope of the present invention to provide two electrical contact pads on the circuit board so that the two sets of sliding contacts 409A&B only make operative contact when the sliding drawers 407A&B are in their fully extended positions.

FIG. 24E, which is an elevated cross sectional end view of the sliding drawers with one sliding drawer 407B being in an extended operational position with an RJ-xx series plug body 11 inserted therein and with one sliding drawer 407A being in a closed storage position. The live hinge 405B can be seen in the cross sectional view of FIG. 24E and can be fabricated from an appropriate material known in the art and can be fabricated integrally with the drawer bottom 405. By the action of the live hinge 405B, the drawer bottom 405 is normally in the upward storage position in the sliding drawer 407A in the direction of arrows 411. When the RJ-xx series plug body 11 is inserted into the drawer 407B electrical continuity is made between contacts 20 on the RJ-xx series plug body 11 and the contacts 412 provided in the sliding drawers 407A&B.

As previously explored in connection with other embodiments of the present invention, the structures represented in FIGS. 24C–E provide for rapid and easy connection of a communications plug and when the communications card is not being used. Moreover, the pertinent components are protected from damage when the communications card is not being used and the overall length of the communications card is preferably and substantially within the PCMCIA/PC Card standard.

Figure 25:
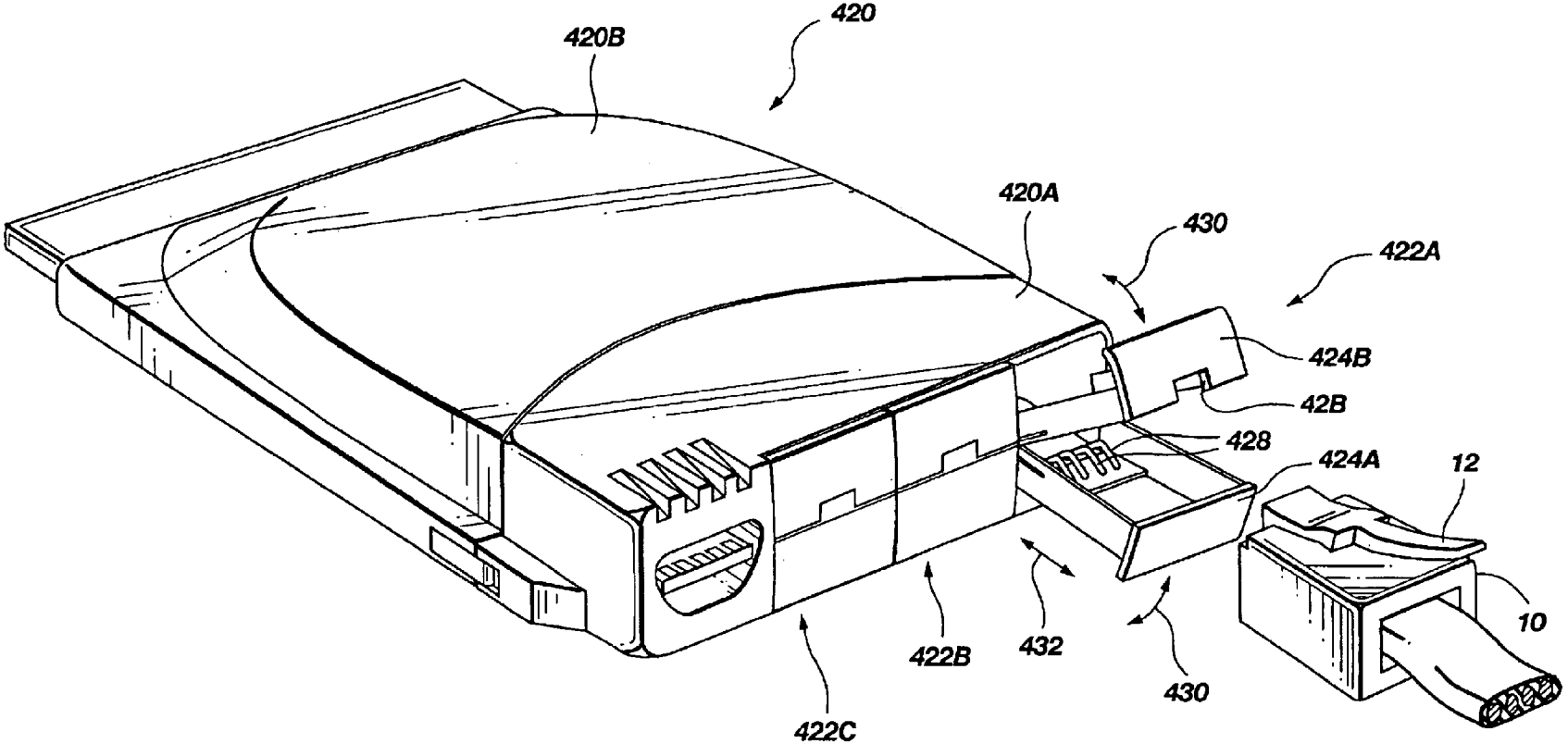
FIG. 25 is a perspective view of a communications card in accordance with the present invention having a plurality of RJ-xx series receptacles each including a pair of retractable expanding jaws.

Reference will next be made to FIG. 25. FIG. 25 is a perspective view of another communications card, generally indicated at 420, in accordance with the present invention. The communications card 420 includes a plurality of RJ-xx receptacles, generally indicated at 422A–C, each formed by a pair of retractable and expanding jaws, two of which are represented at 424A&B. When in the retracted position, as shown with RJ-xx receptacles 422B&C, the communications card 420 (including card body 420B and connector housing 420A) substantially complies with the dimension requirements of the PCMCIA Type III standard. Included in the connector housing 420A are the structures which allow the jaws 424A&B to be extended out of and retracted into the connector housing 351A in the directions of arrow 432 and also to pivot in the directions of arrows 430 as well as to bias the jaws 424A&B toward each other.

An RJ plug 10 represented in FIG. 25 is received into the receptacle 422A formed by the jaws 424A&B by manually separating the jaws 424A&B and inserting the RJ plug 10 between the jaws 424A&B. The jaws 424A&B are biased toward each other thus capturing the RJ plug 10 therein and holding the electrical contacts of the RJ plug 10 in continuity with the conductors, one of which is represented at 428, in the jaw 424A. A ledge 426 engages the biased clip on the RJ plug 10 to further secure the RJ plug 10 in position in the jaws 424A&B. The structures represented in FIG. 25 provide that the RJ plug 10 and the communications card 420 can be easily connected and disconnected and that the internal components of the communications card 420, including the conductors 428, are shielded from the surrounding environment.

Figure 26A:
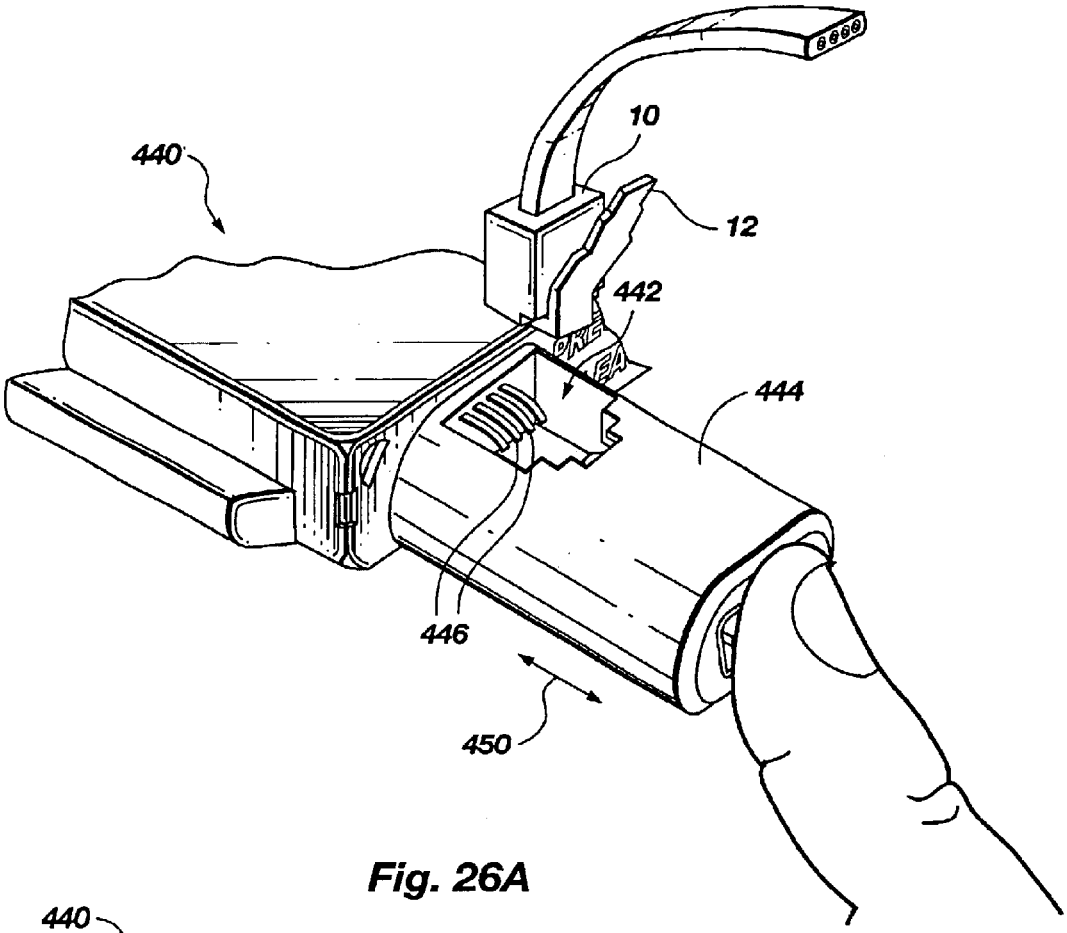
FIG. 26A is a partial perspective view of a communications card in accordance with the present invention having two different connector receptacles positioned on a retractable member shown in an extended position.
Figure 26B:
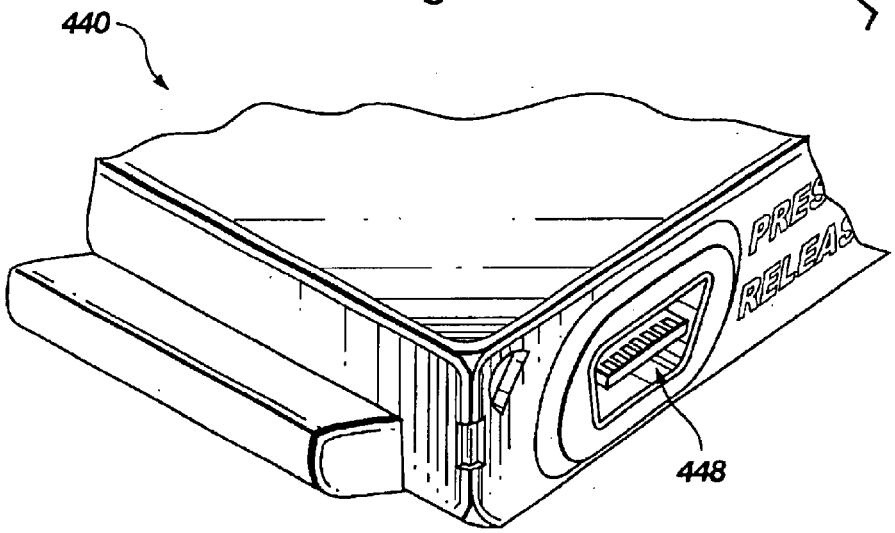
FIG. 26B is a partial perspective view of the communications card represented in FIG. 26A with the retractable member shown in a retracted position.

FIG. 26A is a partial perspective view of a communications card generally indicated at 440 which includes two different connectors, an RJ-xx series receptacle generally indicated at 442 and an auxiliary connector, generally indicated at 448, which preferably can be a connector suitable for coupling to a wireless communications device, for example a portable telecommunications device which complies with the GSM communications standard, both of which are positioned on a retractable/extendable member 444. The retractable/extendable member 444 is shown in an extended position in FIG. 26A and is shown in a retracted position in FIG. 26B. Those skilled in the art can readily arrive at the structures included in the communications card 440 needed to implement the extension and retraction functions of the member 444. The electrical connections included in the communications card 440 can be readily arrived at using the information set forth herein and using the information well-known in the industry.

Figure 27:
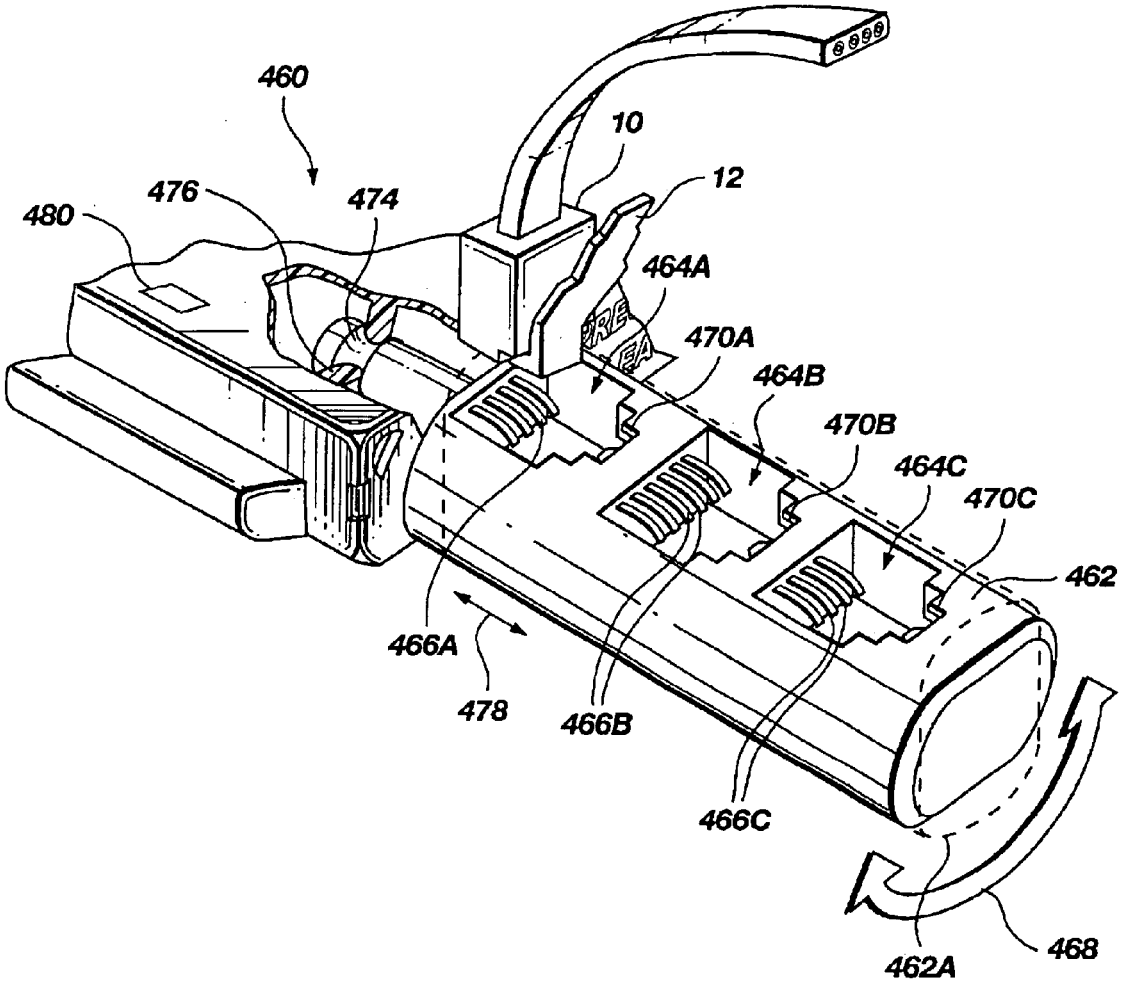
FIG. 27 is a partial perspective view of a communications card in accordance with the present invention having three RJ-xx series receptacles positioned on a rotatable and retractable member shown in an extended position.

Reference will next be made to FIG. 27. FIG. 27 is a partial perspective view of a communications card, generally 151 indicated at 460, in accordance with the present invention. The communications card 460 includes a rotatable and retractable member 462. The rotatable and retractable member 462 includes three RJ-xx series receptacles, generally indicated at 464A–C. The RJ-xx series receptacles 464A–C each include conductors, some of which are indicated at 466A–C, which receive corresponding contacts in the RJ plug 10. Each of the RJ-xx series receptacles 464A–C include a ledge 470A–C which engage the biased clip on the RJ plug with the dimensions of the RJ-xx series receptacles 464A–C being such that the appropriate RJ plug is closely received therein, as is preferred with all of the communications cards described herein. Moreover, as with the other communications cards described herein, the RJ-xx series receptacles 464A–C can be fabricated to receive any appropriate RJ-xx series plugs, for example receptacles 464A and 454C preferably receiving an RJ-11 plug and receptacle 464B preferably receiving an RJ-45 plug.

The rotatable and retractable member 462 rotates in the directions of arrow 468 such that after one or more RJ plugs have been operatively received therein the cords extending from the RJ plug can be oriented in a direction which is 90° (as represented in phantom image at 462A), 180°, 270°, or some intermediate orientation, from the orientation illustrated in FIG. 27. One preferred structure to provide for rotation of the rotatable and retractable member 462 is represented by the post 472 with a groove 474 which is engaged by ring 476. The structures which maintain electrical continuity between the components housed within the communications card 460 are represented at 480 with the structures which provide for the retraction/extension of the rotatable and retractable member 462 are represented at 482, all of which can be readily arrived at using information set forth herein and well-known in the industry. As is the case with many of the embodiments described herein, the features represented in the embodiment of FIG. 27 can be implemented in many different platforms, for example PCMCIA Type II and III PC Cards, as well as other platforms known in the industry.

FIG. 27A is a perspective view of another communications card in accordance with the present invention providing three RJ-xx series receptacles positioned on a rotatable and retractable member shown in an extended position. It will be appreciated that the communications card illustrated in FIG. 27A is provided with structures which function similarly to those described in connection with FIG. 27.

The communications card 461 includes a housing 461A which is preferably compliant with the PCMCIA Type III dimensions.

The communications card 461 includes a rotatable and retractable member 463. The rotatable and retractable member 463 includes three RJ-xx series receptacles, generally indicated at 463A–C. The RJ-xx series receptacles 463A–C each include contacts which complete a circuit with corresponding contacts in an RJ plug. Each of the RJ-xx series receptacles 463A–C include structures similar to those described earlier (such as ledges 470A–C) which engage the biased clip on an RJ plug with the dimensions of the receptacles 463A–C being such that the appropriate RJ plug is closely received therein, as is preferred with all of the communications cards described herein. Moreover, as with the other communications cards described herein, the RJ-xx series receptacles 463A–C can be fabricated to receive any appropriate RJ-xx series plugs, for example receptacles 463A and 463B are preferably configured to receive an RJ-11 plug and receptacle 464C is preferably configured to receive an RJ-45 plug.

The rotatable and retractable member 463 rotates in the directions of arrow 483 such that after one or more RJ plugs have been operatively received therein the cords extending from an RJ plug can be oriented in many different directions (similarly to the description provided in connection with FIG. 27).

Referring next to FIG. 27B, one preferred structure to provide for rotation of the rotatable and retractable member 463 includes contact blocks 475A&B which mate together to capture the post 481A which allows the rotatable and retractable member 463 to rotate as indicated by arrow 483 (FIG. 27A).

A cable, such as a ribbon cable 467, provides electrical continuity between the communication components positioned within the communications card and the receptacles 463A–C. The electrical signals present on the ribbon cable 467 are conveyed through sensor leads, a few of which are represented at 471A–C (sensor lead 471A being shown in detail in FIG. 27C) which mate with cylindrical contacts 479, as shown best in FIG. 27D, when the post 481A is captured by the contact blocks 475A&B. The sensor leads 417A–C allow for substantially continuous electrical continuity to be maintained.

FIG. 27D is a diagrammatic view showing the position of sensor leads in the rotatable and retractable member 463. In the cross sectional view of FIG. 27D, the path taken by the conductors between the cylindrical contacts 479 and each of the three sets of RJ contacts in the receptacles 463A–C in the rotatable and retractable member 463 is disclosed. It will be appreciated that while the illustrated structures are preferred, the number and arrangement of conductors can be altered in accordance within the scope of the present invention.

With reference to both FIGS. 27A&B, the structures which provide for the retraction and extension of the rotatable and retractable member 463 will now be explained. The contact blocks 475A&B are each provided with runners 475C&D (see FIG. 27B) respectively, which engage tracks 465 (see FIG. 27A) and allow the contact blocks 475A&B (when assembled) to slide within the communications card 461 in the directions of arrow 473 and thus extend and retract the rotatable and retractable member 463. A release mechanism 469 is provided at the end of the tracks 465 to hold the rotatable and retractable member 463 in its retracted position and to, upon release by a user, to partially extend the rotatable and retractable member 463 toward its extended position.

While it will be appreciated that many different structures can be readily arrived at using information set forth herein, those structures illustrated in the drawings are presently preferred in accordance with the present invention. As is the case with many of the embodiments described herein, the features represented in the embodiment of FIGS. 27A–C can be implemented in many different platforms, for example PCMCIA Type II and III PC Cards, as well as other platforms known in the industry.

Figure 28:
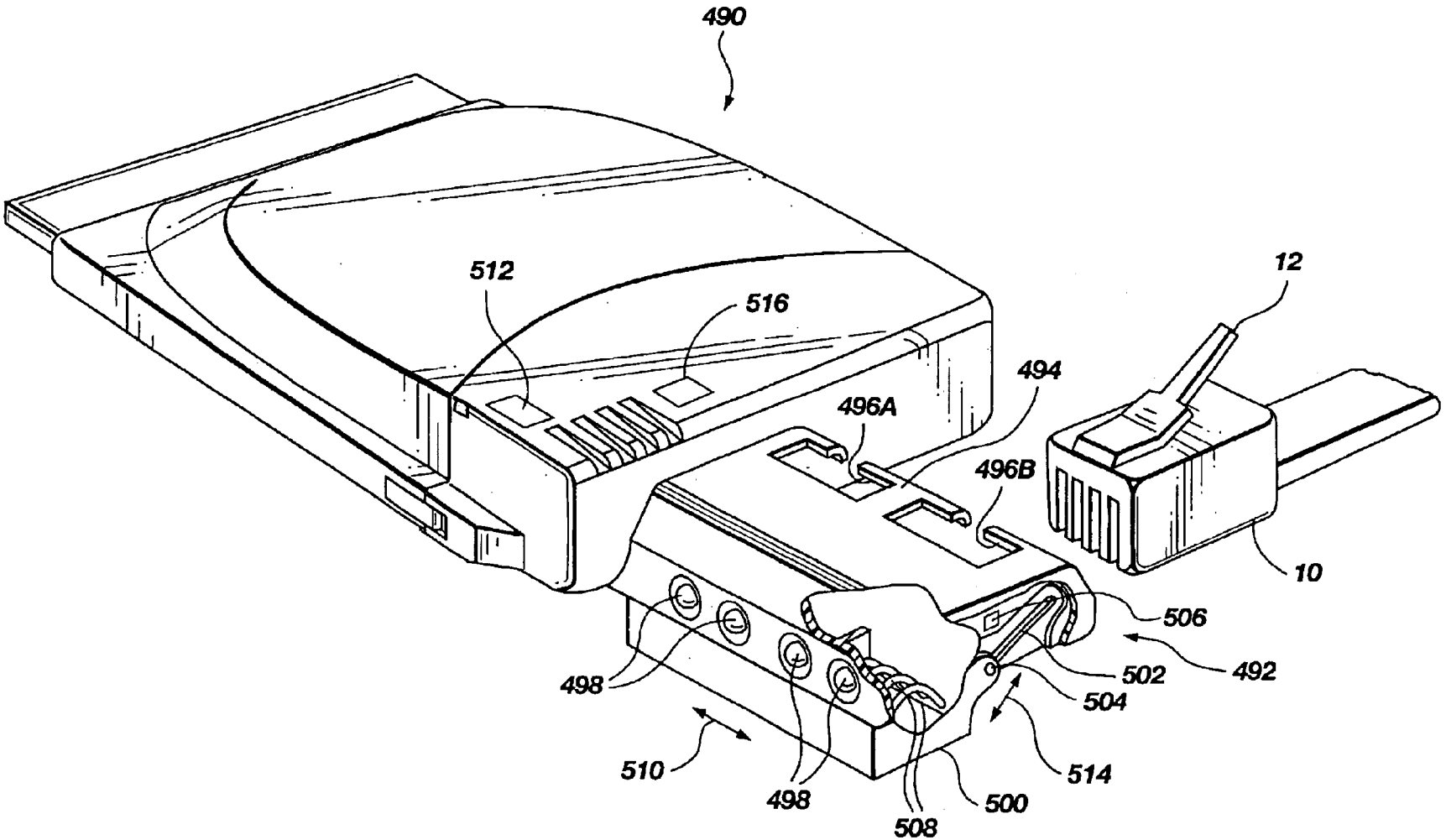
FIG. 28 is a perspective view of a communications card in accordance with the present invention having two RJ-xx series receptacles positioned in a retractable shell member shown in an extended position.

Reference will next be made to FIG. 28 which is a perspective view of a communications card, generally indicated at 490, having two RJ-xx series receptacles positioned in a retractable shell, generally indicated at 492. The retractable shell 492 comprises an upper member 494 and a lower member 500. The lower member 500 is slidably joined to the upper member 494 by a pin 504 resting within a slot 502 which allows the lower member to slide in the directions of arrow 514. The lower ember 500 is biased toward the upper member 494 by the structures represented at 506. When an RJ plug is inserted between the upper member 494 and the lower member 500, such that the biased clip on the RJ plug 10 is received by one of the receivers 496A or 496B., the lower member 500 pushes the RJ plug 10 towards the upper member 494 and makes operative contact between the conductors 508 and the corresponding contacts provided in the RJ plug 10.

Provided on the upper member 494 are a plurality of visual indicators 498 which provide an indication of the operation of the communication card 490. The structures which allow the retractable shell 492 to extend and retract in the directions of arrow 510 are represented at 512 with the structures which maintain the necessary electrical coupling being represented at 516. The retractable shell 492 provides for convenient and secure connection to two RJ plugs in accordance with the present invention.

Figure 29A:
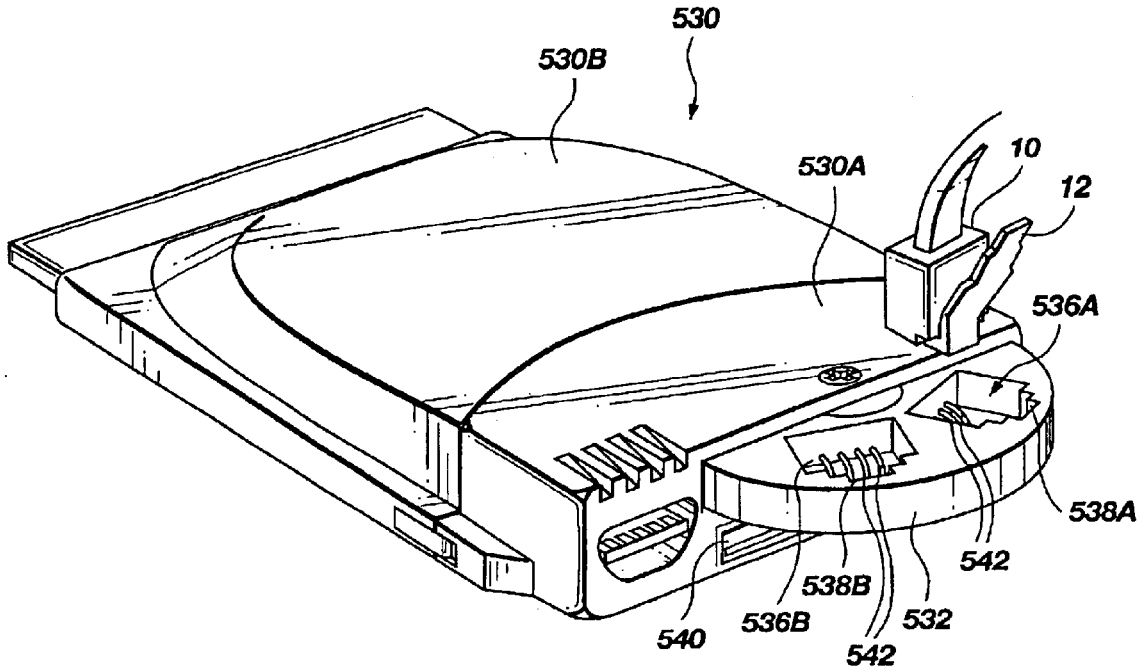
FIGS. 29A&B are a perspective view and a top view, respectively, of a communications card in accordance with the present invention having two RJ-xx series receptacles positioned on a pivoting and retractable member shown in an extended position.
Figure 29B:
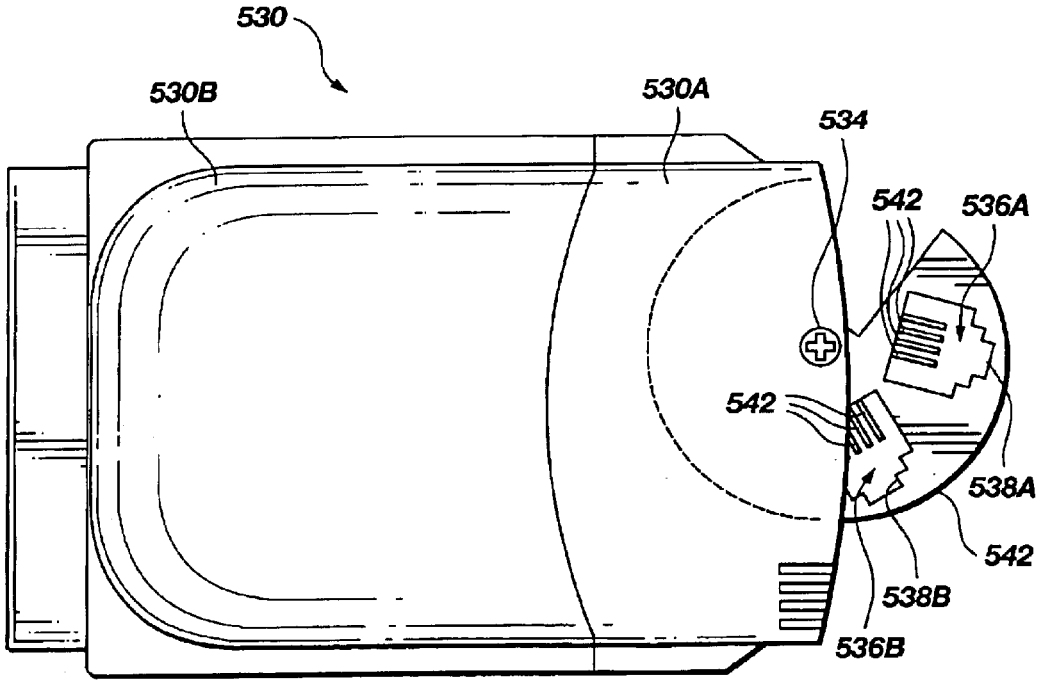

FIGS. 29A&B will be referred to next. FIGS. 29A and 29B are a perspective view and a top view, respectively, of another communications card, generally indicated at 530, in accordance with the present invention. The communications card 530 preferably follows the PCMCIA (also referred to as PC Card) Type III standard for dimensions and configuration and includes a card body 530B and a connector housing 530A. The connector housing 530A includes an auxiliary connector, generally indicated at 544, and an auxiliary slot 540 which can operatively receive a memory card, such as a compact flash memory card, as known in the industry. Further information regarding memory cards adhering to the Compact Flash standard, and to the Miniature Card standard can be obtained from the publications *I.C. Memory Handbook* 1995: *DRAM, Scram, EPROM, Flash* published by Rector Press, Limited, Published 1995 (ISBN 0760529698) and *Flash Memory* published by Intel Corporation, Published 1994 (ISBN 1555122000) both of which are now incorporated by reference herein in their entireties. The cards adhering to the Compact Flash standard and to the Miniature Card standard are examples of preferred memory cards for use with the present invention.

As represented in FIGS. 29A&B, a receptacle body 532 which is preferably and substantially semicircular in shape, is provided with two recesses 536A&B which each receive an RJ plug 10. The recesses 536A&B each include a ledge 538A&B such that the conductors 542 disposed in the recesses 536A&B can make operative connection with an RJ plug 10.

The receptacle body 532 is preferably semicircular in shape and pivots about a bolt 534. The bolt 534 allows the receptacle body 532 to be rotated in the directions of arrow 546 to an extended position as illustrated in FIGS. 29A&B. In its extended position, the receptacle body 532 allows access to the recesses 536A&B. The communications card 530 allows convenient connection to a communications line via an RJ plug 10 and operative connection to a memory card via the slot 540.

Figure 30A:
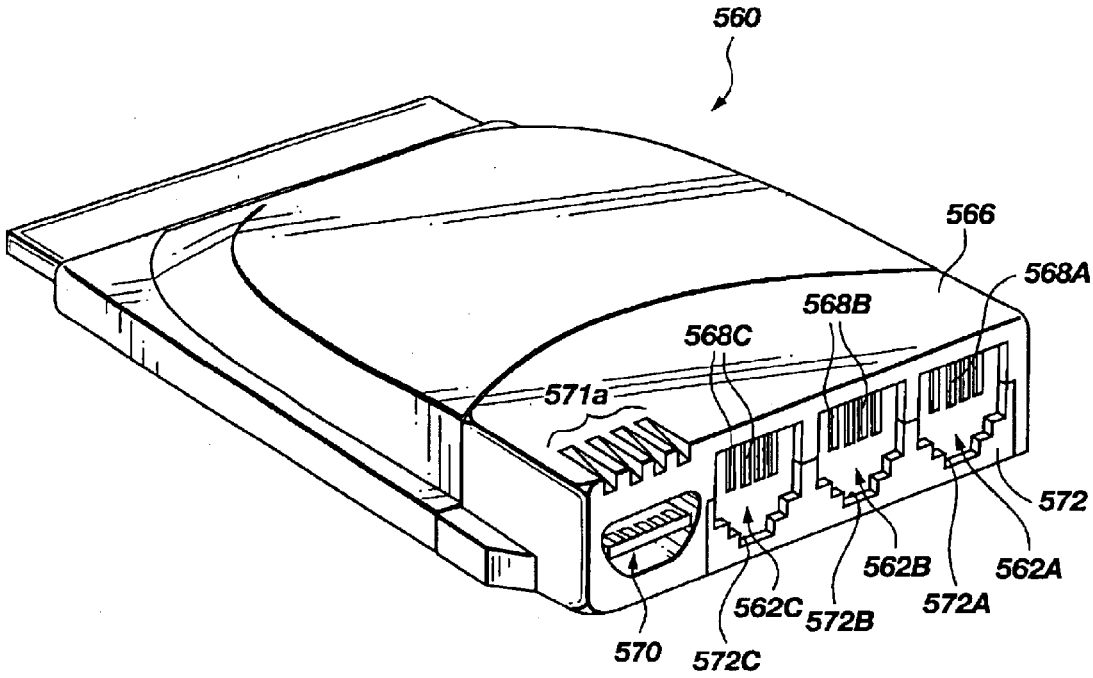
FIGS. 30A&B are perspective views of a communications card in accordance with the present invention including three RJ-xx series receptacles positioned on an end of the communications card with a shell member shown in a compact configuration in FIG. 30A and shown in a an extended configuration in FIG. 30B ready to receive one, two, or three RJ-xx series plugs.
Figure 30B:
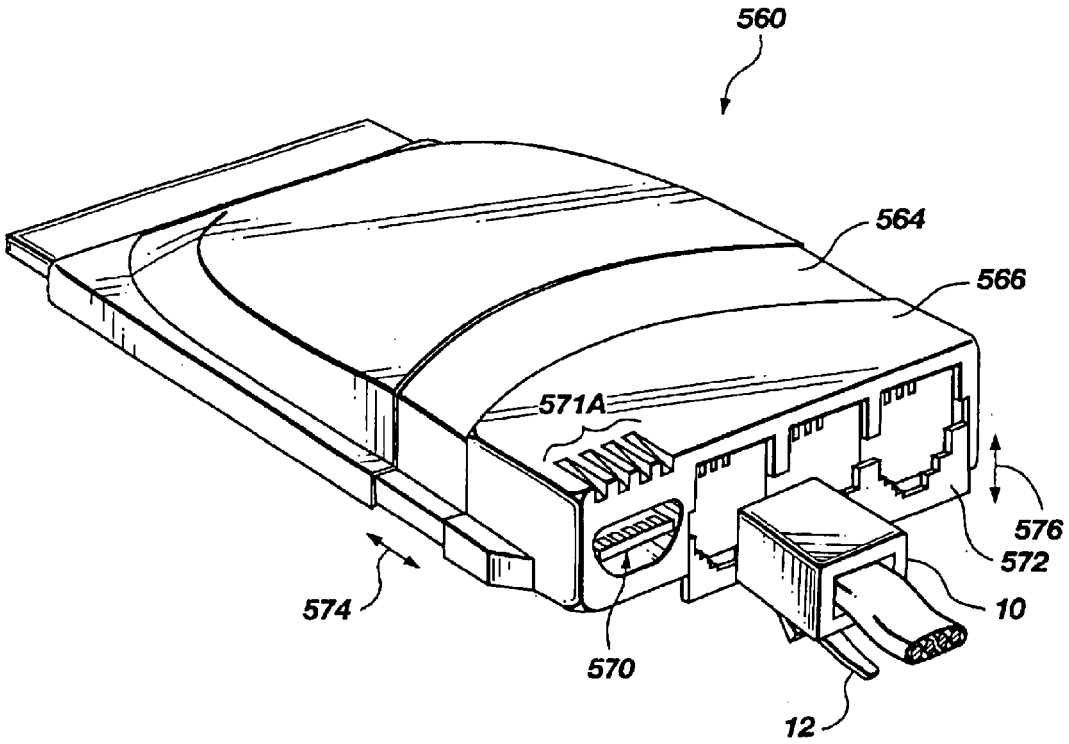
FIG. 30C is an exploded perspective view of another communications card in accordance with the present invention which includes three RJ-xx series receptacles positioned on the end of the communications card with a shell member shown exploded off from the end of the communications card.
FIG. 30D is a partially cutaway perspective view of another communications card in accordance with the present invention which allows simultaneous connection of three RJ-xx series receptacles positioned on the end of the communications card when a shell member is positioned in an extended configuration.
FIG. 30E is a partial reverse perspective view of the communications card represented in FIG. 30D–FIGS. 30F&G are elevational cross sectional views taken along line 30F/G—30F/G with FIG. 30F showing the shell member positioned in an extended configuration and with FIG. 30G showing the shell member positioned in a collapsed/retracted configuration.

Reference will next be made to FIGS. 30A&B which are perspective views of a communications card, generally indicated at 560, in accordance another aspect of the present invention. The communications card 560 includes three RJ-xx series receptacles, each generally indicated at 562A–C, positioned on an end of the communications card 560. As shown best in FIG. 30B, a shell member 566 is extended from a card body 564 as indicated by arrow 574. When the shell member 566 is in the retracted position represented in FIG. 30A, the length of the communications card substantially conforms to the PCMCIA Type III standard. Also illustrated in FIG. 30A are a plurality of contacts 568A–C which are connected to the card body. 564 and which make electrical connection with corresponding contacts in the RJ plug 10 (FIG. 30B). When the shell member 566 is in the extended position represented in FIG. 30B, a clip capture member 572 is dropped into the position indicated in FIG. 30B. The clip capture member 572 moves in the directions of arrow 576. When the clip capture member 572 is in its upper position (as represented in FIG. 30A), the communications card 560 substantially conforms to the PCMCIA thickness standard. When the clip capture member 572 is in its lower position (as represented in FIG. 30B), the RJ plug 10 can be received therein. With the shell member 566 in its extended position (FIG. 30B), the contacts provided on the RJ plug 10 impinge upon the corresponding conductors 568C when the RJ plug 10 is inserted into one of the receptacles 562A–C.

The communications card 560 is another example of the present invention which provides a convenient connection to one or more RJ plugs which substantially complies with the PCMCIA physical dimension standard when not in use, which does not require any additional proprietary cords or connectors to make the necessary connections, and which shields electrical conductors from the surrounding environment. The embodiment of the present invention which is represented in FIGS. 30A–B also includes an auxiliary connector, generally designated at 570, which those skilled in the art will appreciate can be used to convey various types of signals/data pertinent to the present invention. Also represented in FIGS. 30A–B are illuminating indicators 571A. The illuminating indicators 571A may preferably be LEDs which indicate the function of the communications card 560. Alternatively, multiple LEDs may be positioned in the card body 564 with light emitted from such LEDs being piped by a light piping structure (either rigid or flexible) to the illuminating indicators 571A. Moreover, the surface of the illuminating indicators 571A may be flush with the surface of the shell member 566 to improve the conveyance of the light emitted therefrom to the user.

Figure 30C:
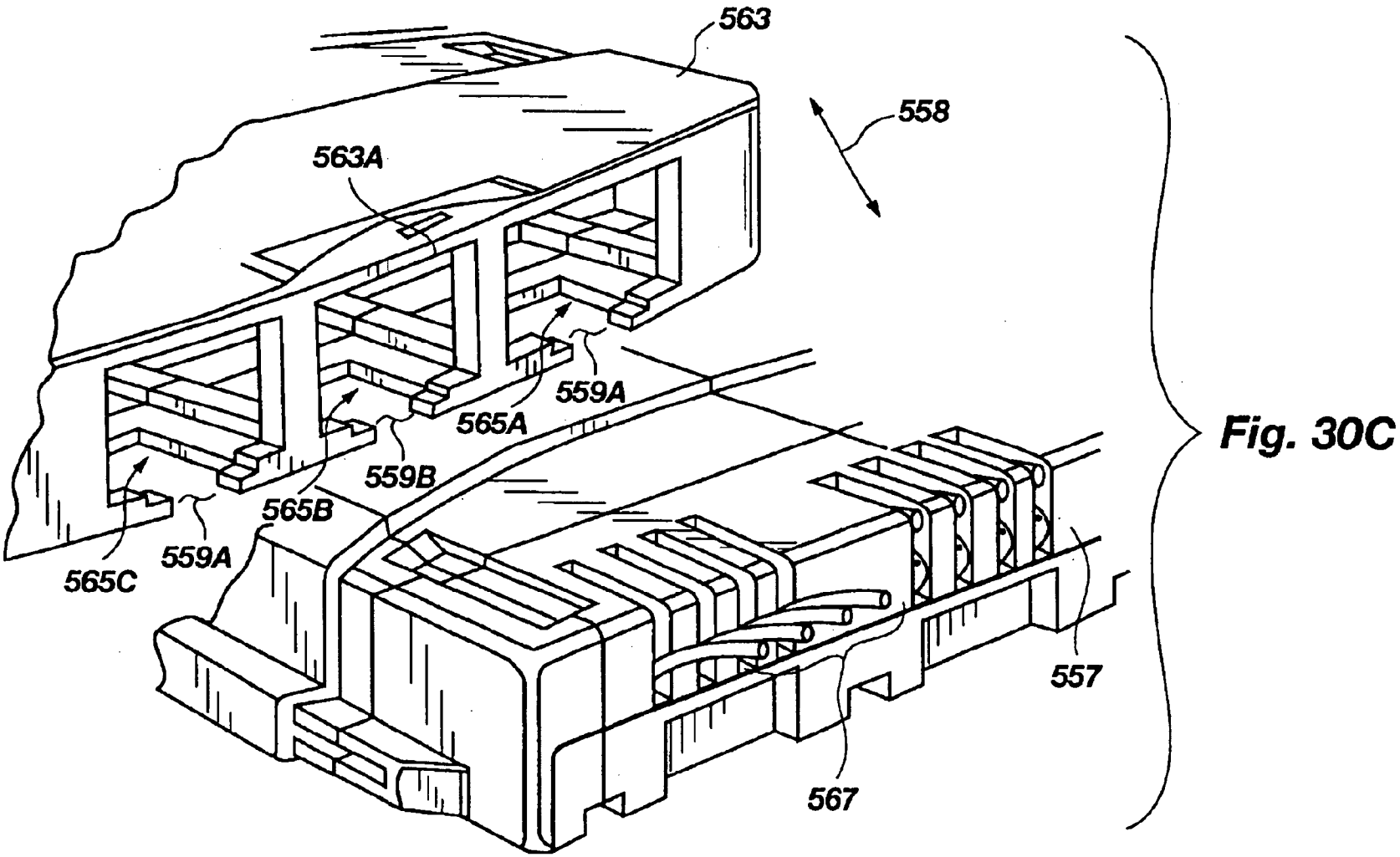
Figure 30E:
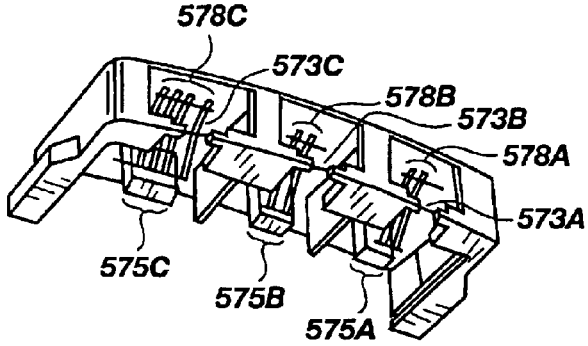

Reference will next be made to FIG. 30C which is an exploded perspective view of another communications card in accordance with another aspect of the present invention which includes three RJ-xx series receptacles positioned on the end of the communications card with a shell member shown exploded off from the end of the communications card. It will be appreciated that the communications card represented in FIG. 30C includes many structures similar to those represented in FIGS. 30A&B and thus only the significant differences will be discussed.

In FIG. 30C three RJ-xx series receptacles, respectively and generally indicated at 565A–C, are positioned on an end of the communications card. The three RJ-xx series receptacles 565A–C are defined by a shell member 563 which engages the end 557 of a card body 561 when in use. When the shell member 563 is in the retracted position, namely when it is fully rested against the end 557 of the card body 561, the length of the communications card substantially conforms to the PCMCIA Type III standard. Also illustrated in FIG. 30C are a plurality of contacts 567 which extend from the end 557 card body 561 (only the set of the three contacts which are associated with receptacle 565C being designated in FIG. 30C) and which make electrical connection with corresponding contacts in the RJ plug 10 (not represented in FIG. 30C).

Still referring to FIG. 30C, when the shell member 563 is pulled from the end 557 of the card body 561, in keeping with the directions of arrow 558, an RJ plug 10 can be held in each of the receptacles 565A–C. Each receptacle includes a clip engaging structure 559A–C which allows an RJ plug to be held so that the contacts provided on the RJ plug impinge upon the corresponding conductors (one set being indicated at 567) when the RJ plug is inserted into one of the receptacles 565A–C. The communications card of FIG. 30C is another example of the present invention which provides a convenient connection to one or more RJ plugs which substantially complies the PCMCIA physical dimension standard when not in use, which does not require any additional proprietary cords or connectors to make the necessary connections, and which shields electrical conductors from the surrounding environment, and which allows connection to a plurality of RJ plugs without requiring loss of space devoted to circuit board and communications components within the communications card.

Figure 30D:
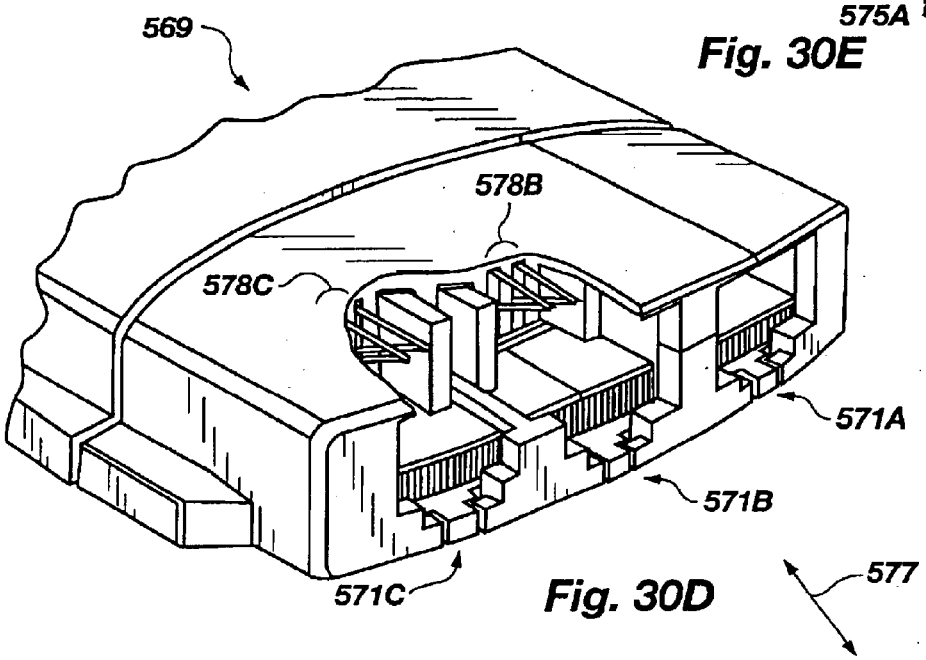
Figure 30F:
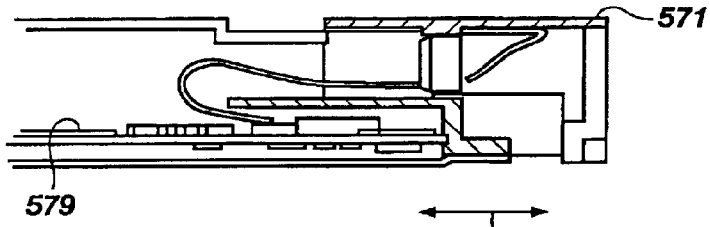
Figure 30G:
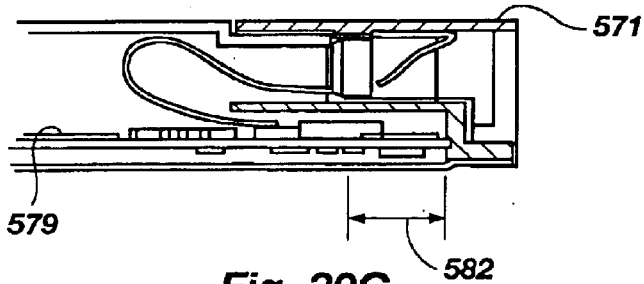

Reference will next be made to FIGS. 30D–G to describe another presently preferred embodiment in accordance with another aspect of the present invention. Reference will first be made to FIG. 30D which is a partially cutaway perspective view of a communications card generally designated 569. The communications card 569 allows simultaneous connection to three RJ-xx series receptacles positioned on the end of the communications card 569 when a shell member 571 is positioned in an extended configuration. The shell member is shown in a retracted configuration in FIGS. 30D and 30G and shown in an extended configuration in FIG. 30F.

The communications card 569 includes three RJ-xx series receptacles, each respectively and generally indicated at 571A–C, positioned on an end of the communications card 569. A shell member 571 is provided on one end of the communications card 569. As seen best in the partial reverse perspective view provided in FIG. 30D, the shell member 571 includes one set of electrical contacts 578A–C supported by contact blocks 575A–C. The contact blocks 575A–C are attached (or molded) to the shell member 0.571. One contact block 575A–C and one set of electrical contacts 578A–C are associated with each one of the receptacles 571A–C. Each of the receptacles 571A–C is also provided with a clip engaging structure 573A–C which functions to engage the biased clip of an RJ plug (not represented in FIGS. 30D–G) to securely hold the RJ plug against the respective set of electrical contacts 578A–C.

The shell member 571 can be extended and retracted in the directions of arrow 577. The extension and retraction can be best explained by referencing the cross sectional views of FIGS. 30F and 30G. When the shell member 571 is in its retracted position represented in FIG. 30G, the length of the communications card substantially conforms to the PCMCIA length standard. A flexible connector, such as a ribbon cable 581, provides an operative connection between a circuit board 579 and the contact blocks 575A–C thus providing the necessary electrical communications circuit for the communications card 569 to operate. When the shell member 571 is in its extended position represented in FIG. 30F (as indicated by arrow 577), an RJ plug is securely received into one of the receptacles 571A–C. As indicated by the arrow 582 in FIG. 30G, the structures shown in FIGS. 30D–G allow additional space for the circuit board 579 in the communications card 569 which would otherwise be required for the RJ plug receptacles. Thus, the embodiment of the present invention represented in FIGS. 30D–G provides another example of the present invention which substantially complies with the PCMCIA physical dimension requirements when in a storage configuration yet allows additional space to be devoted to an internal circuit board even though multiple RJ plugs are simultaneously connected to the communications card.

Figure 31A:
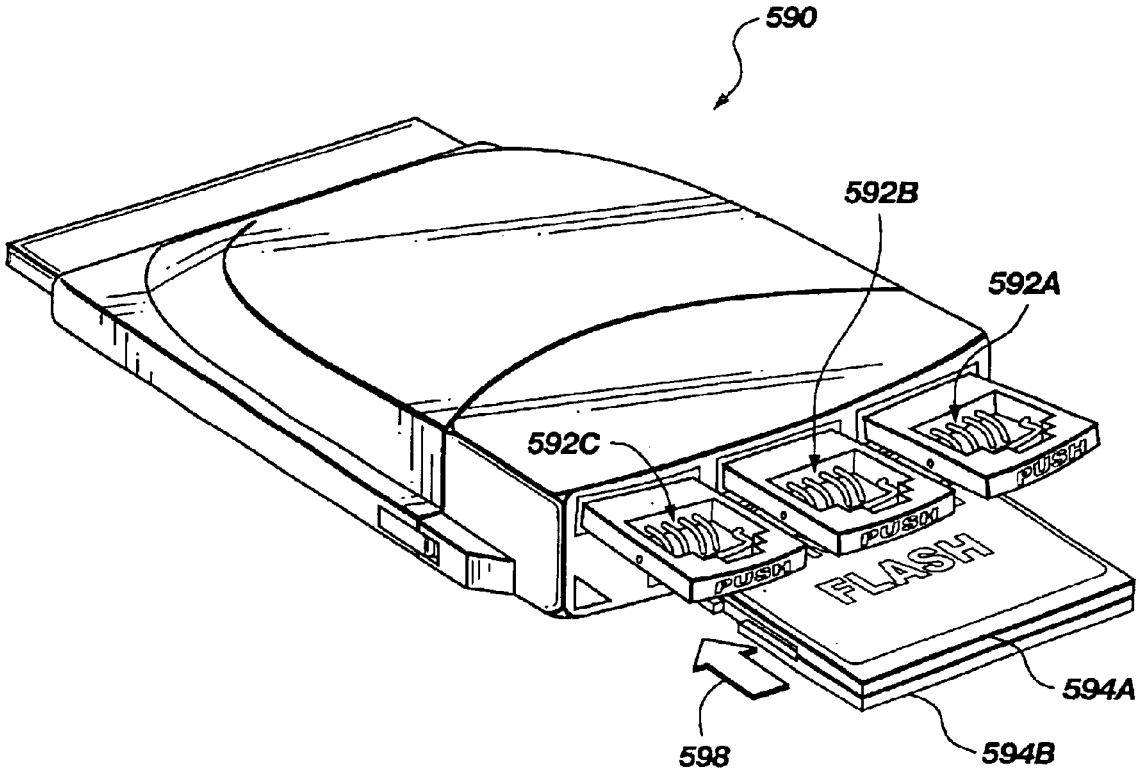
FIGS. 31A&B are perspective views of a communications card in accordance with the present invention including three RJ-xx series receptacles and a memory card operatively and removably received into the communications card.
Figure 31B:
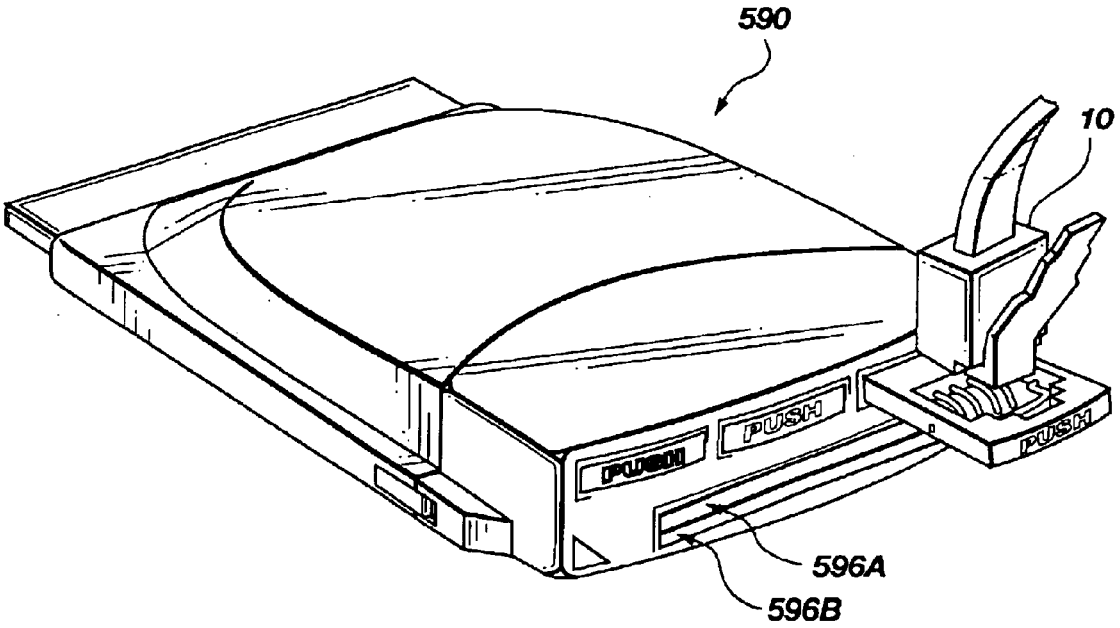

Reference will next be made to FIGS. 31A&B. FIGS. 31A&B are perspective views of a communications card 590 including three RJ-xx series receptacles, generally indicated at 592A–C, and memory card slots, generally indicted at 596A&B which operatively and removably receive memory cards 594A&B, respectively, in the direction of arrow 59B. Those skilled in the art can readily arrive at the necessary hardware and software needed to make an operative connection with the memory cards 596A&B.

Figure 32A:
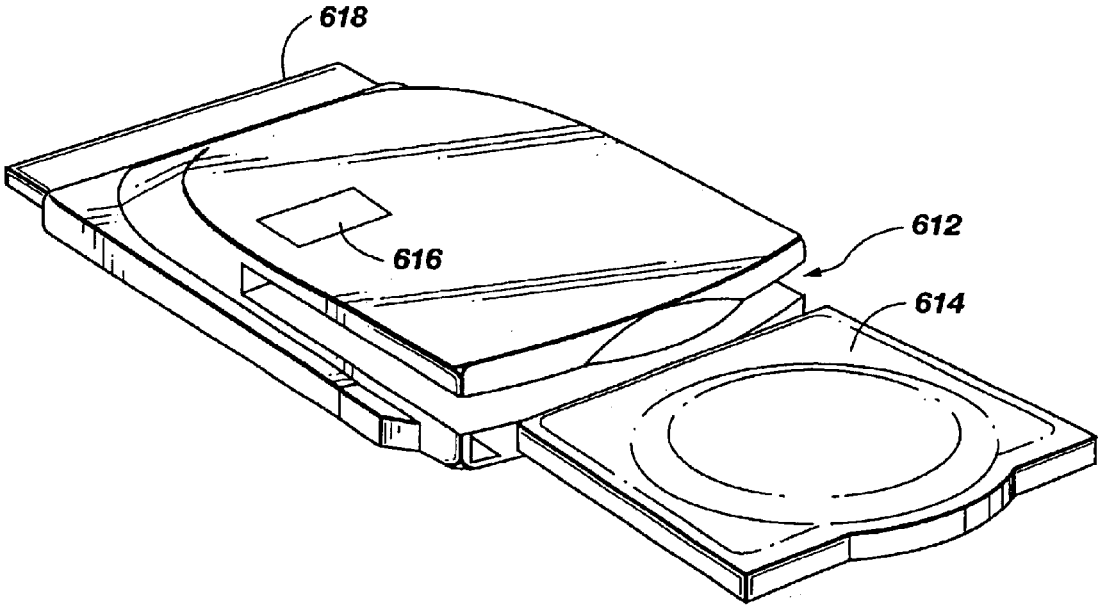
FIGS. 32A&B are perspective views of a PC card in accordance with the present invention which operatively receives a magnetic disk storage medium.
Figure 32B:
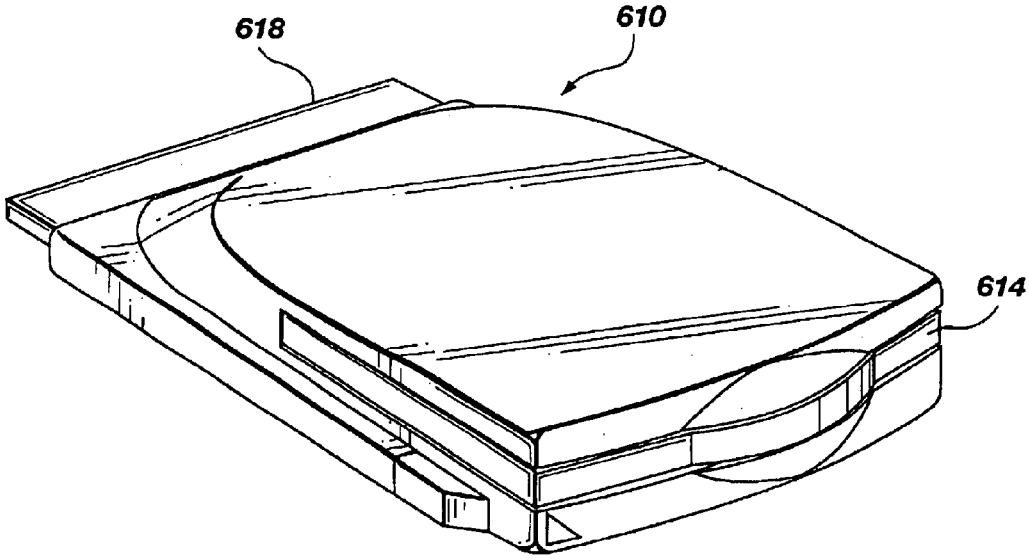

FIGS. 32A&B are perspective views of a PC card 610 which operatively receives a magnetic disk storage medium 614 in a slot, the slot being generally indicated at 612. When inserted into a PC card slot on a computing device so that a front end 618 engages a PC card socket, the internal components, represented at 616, of the PC card 610 provide for data transfer between the PC card 610 (and thus the computing device) and the magnetic disk storage medium 614. It will be appreciated that the optical storage medium can be used in the place of the magnetic disk storage medium.

One example of the magnetic disk storage medium 614 is the disks used in the clik!™ drive which has been announced by Iomega Corporation. Current specifications designate that clik!™ disks (cartridges) are 2.16 inches by 1.98 inches by 0.077 inches (54.9 mm by 50.1 mm by 1.95 mm) which hold 40 MB of data and which are suited for applications which currently require flash memory cards. The clik!™ disks and drive are particularly suited for inclusion in miniature apparatus such as Personal Digital Assistants (PDAs) and other miniature digital electronic devices. Further information regarding the clik!™ disk can readily be obtained by those skilled in the art from Iomega Corporation and from other sources in the industry.

Figure 33:
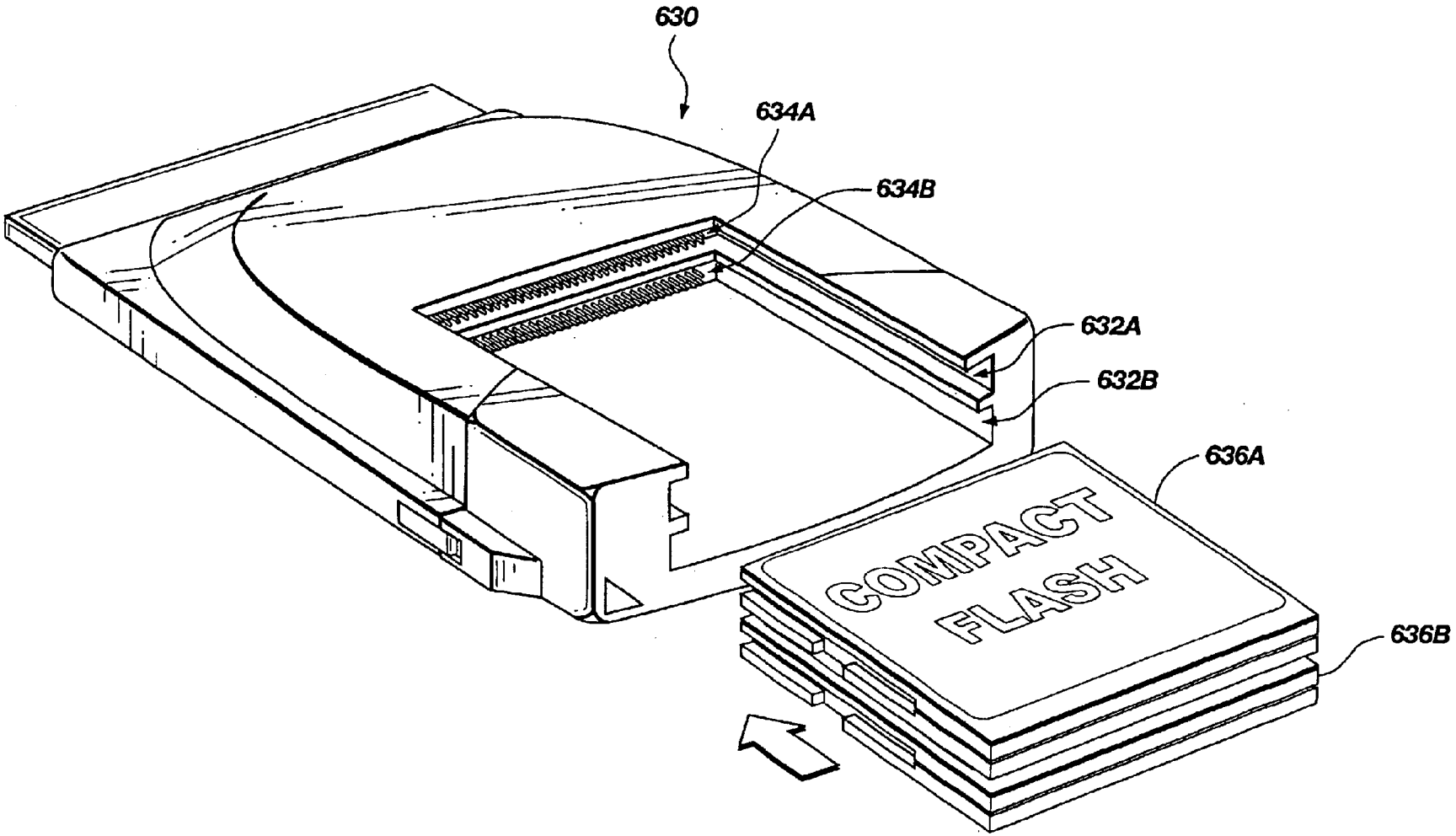
FIG. 33 is a perspective view of a PC card in accordance with the present invention including two memory cards which are operatively received into the PC card.

Reference will next be made to FIG. 33 which is a perspective view of a PC card, generally indicated at 630, which includes a first slot, generally indicated at 632A, and a second slot, generally indicated at 632B, each which operatively receive memory cards, 636A and 636B, respectively. The slots 632A and 632B are each provided with a set of connector pins 634A and 634B which are arranged in accordance with a memory card standard. Internal to the PC card 630 are the components needed to interface both memory cards 636A&B to a computing device into which the PC card 630 is inserted. The PC Card 630 preferably adheres to the PCMCIA Type III standard and desirably allows two memory cards to be simultaneously interfaced with a computing device. Using the information contained herein, those skilled in the industry will readily arrive at the hardware and software necessary to convey data between a computing device in which the PC Card 630 is inserted and one or both memory cards 636A&B.

Figure 34A:
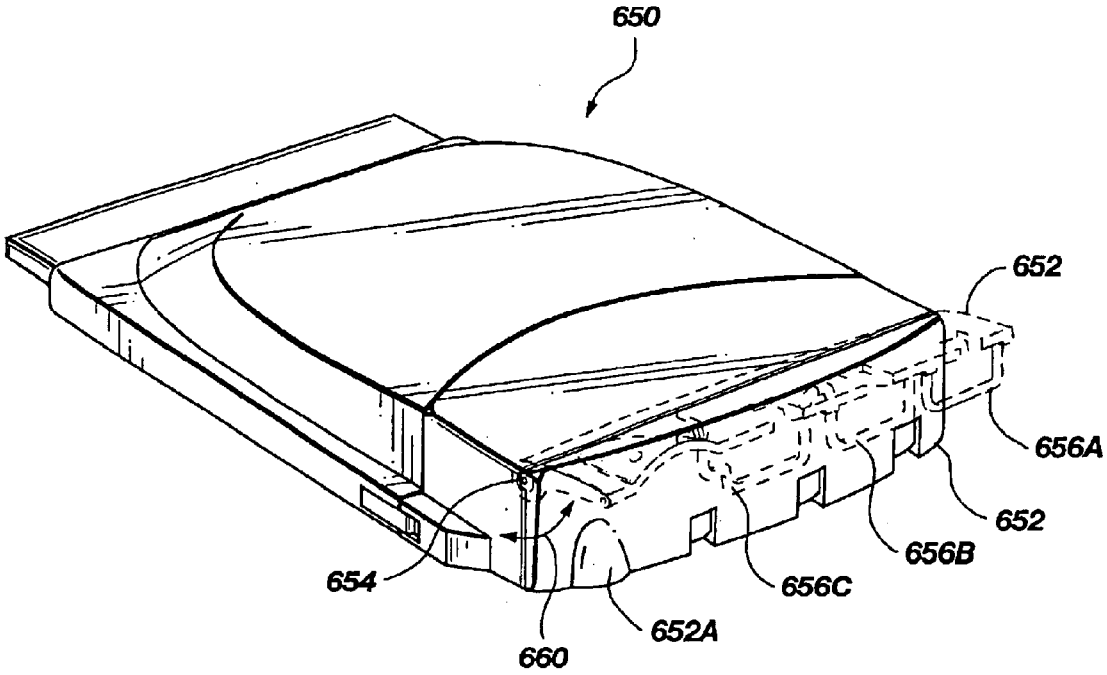
FIG. 34A is a perspective view of a communications card in accordance with the present invention including three RJ-xx series receptacles positioned on an end of the communications card with retracting bails, shown in phantom image, which individually hold an RJ-xx series plug in an operative position.
Figure 34B:
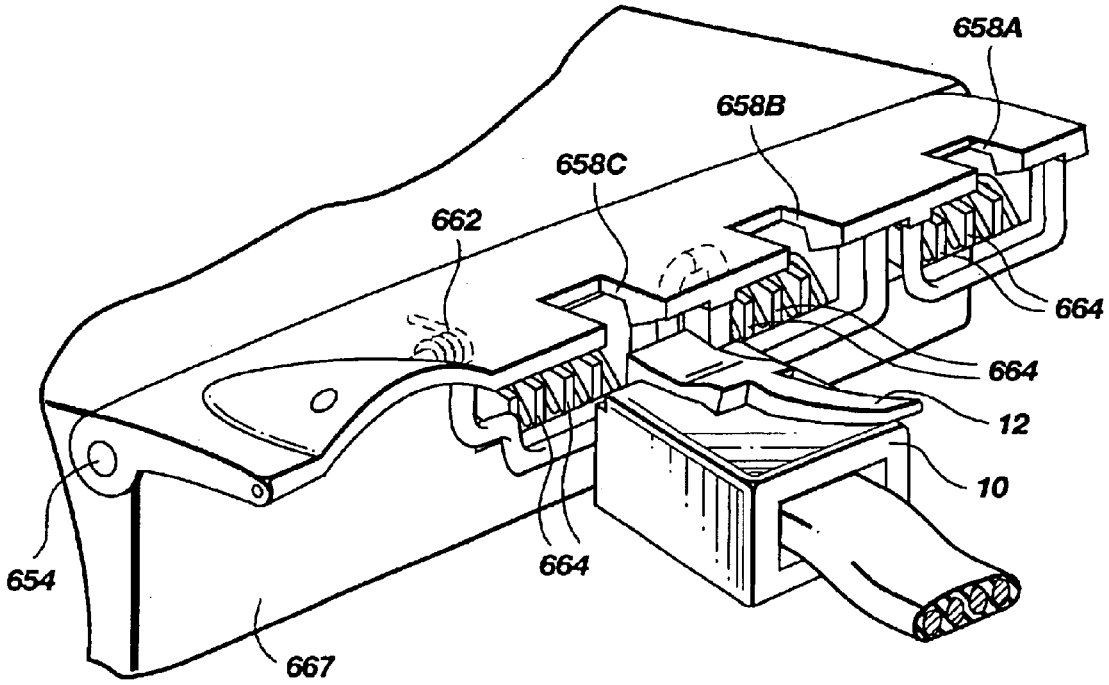
FIG. 34B is a detailed perspective view of the operative structures represented in FIG. 34A.

Reference will next be made to FIGS. 34A&B which are a perspective view and a detailed perspective view, respectively, of a communications card generally indicated at 650. The communications card 650 can simultaneously receive up to three RJ plugs, such as the RJ plug 10 represented in FIG. 34B. As shown best in FIG. 34A, a cover 652 is provided with a finger pull 652A and the cover 652 pivots about an axis 654 in the directions of arrow 660 and as shown by the phantom image of FIG. 34A. When the cover 652 is moved to its open position represented in FIG. 34B, three sets of conductors 664 are exposed. The sets of conductors 664 are arranged to correspond to the contacts provided in the RJ plug 10. It will be appreciated that the sets of conductors are preferably recessed into the front of the card body 667 so that the ends thereof are flush with the end of the card body 667. With the cover 652 in the position represented in FIG. 34B, a plurality of plug bails 656A–C are lowered to the position shown in FIG. 34B. The bails 656A–C are biased in an upward direction by spring 662. When an RJ plug 10 is inserted into one of the bails 656A–C, the biased clip 12 engages one of the ledges 658A–C so that the RJ plug 10 is operatively held in place and signals can be passed between the RJ plug and the communication card 650. The communication card 650 allows more than one RJ plug to be simultaneously and conveniently connected to a computing device.

Reference will next be made to FIGS. 34C, 34D, 34E, and 34F to describe another communications card, generally designated at 651, in accordance with yet another aspect of the present invention. It will be appreciated that the embodiment of the present invention illustrated in FIGS. 34C, 34D, 34E, and 34F shares features similar to those described in connection with FIGS. 34A&B. Thus, the additional features and differences will be emphasized in this discussion.

Figures 34C, 34D, 34E, 34F:
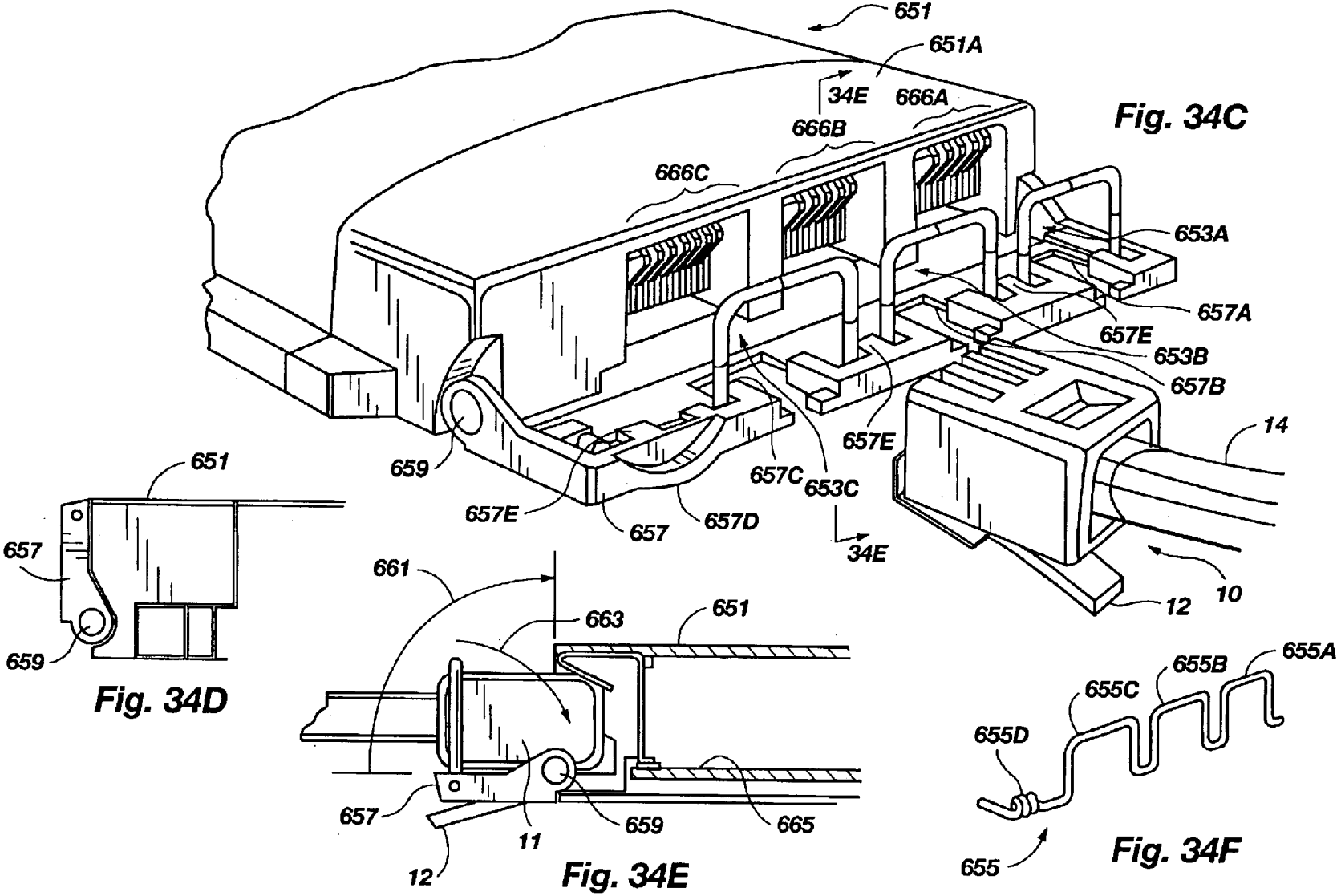
FIG. 34C is a partial perspective view of another communications card in accordance with the present invention including three RJ-xx series receptacles positioned on one end of the communications card with a pivoting cover positioned over the receptacles and retracting bails positioned on the pivoting cover which each individually hold an RJ-xx series plug in an operative position.
FIG. 34D is a cross sectional side view of a portion of the communications card represented in FIG. 34C taken along line 34D—34D.
FIG. 34E is a cross sectional view of a portion of the communications card represented in FIG. 34C taken along line 34E—34E.
FIG. 34F is a perspective view of a spring member which is preferred for providing the bails represented in FIG. 34C.

FIG. 34C is a partial perspective view of the communications card 651 which can simultaneously receive up to three RJ plugs, such as the RJ plug 10 represented in FIG. 34C. As shown best in FIG. 34C, a cover 657 is provided with a finger pull 657D and the cover 657 pivots about an axis 659 in the directions of arrow 661 (see FIG. 34E). When the cover 657 is moved to its open position represented in FIG. 34C, three sets of conductors 666A–C are exposed and can be accessed by the RJ plug 10. The sets of conductors 666A–C are arranged to correspond to the contacts provided in the RJ plug 10. The sets of conductors 666A–C are each positioned in a respective recess formed in a card body 651A, with each recess forming part of one of three receptacles, the receptacles being respectively indicated at 653A–C.

With the cover 657 in the open position represented in FIG. 34C, a bail 655 (also see the detailed view of FIG. 34F) is raised to the position shown in FIG. 34C to define the receptacles 653A–C, each of which can receive an RJ plug 10. As shown best in FIG. 34F, the bail 655 is organized into three bail portions 655A–C. A biasing device 655D is preferably provided to cause the bail 655 to be biased to its upright position. The bail 655 is held on the cover 657 by bail tabs 657E, the bail tabs 657E preferably being formed integrally with the cover 657.

When the RJ plug 10 is inserted into, for example, receptacle 653C the bail portion 655C holds the RJ plug 10 in place and ensures that the biased clip 12 on the RJ plug 10 engages the clip ledges 657A–C so that the RJ plug 10 is tightly held against the appropriate set of conductors 666A–C positioned in a respective recess formed in the card body 651A, as best illustrated in FIG. 34E, and signals can be passed between the RJ plug 10 and the communications card 651. The illustrated structures, and all of the structures described herein, allow for easy release of the biased clip and removal of the RJ plug 10 when the communications card 651 is not being used. The cross sectional view of FIG. 34E shows that the connection to multiple RJ plugs can be made using less space in the communications card 651 and thus allowing more room for a circuit board 665 while allowing three or more RJ plugs to be simultaneously and conveniently connected to a computing device.

When the communications card is not being used, the RJ plug 10 is removed and the bail 655 is returned to its lowered position indicated by arrow 663 (FIG. 34E). The cover 657 is returned to its closed position illustrated in FIG. 34D. It will be appreciated that the embodiment of the present invention represented in FIGS. 34C–F simultaneously accommodates three RJ-xx series plugs yet provides substantial advantages over the previously available devices. Such advantages include, for example: The electrical components are protected from damage when not being used; The overall length and thickness of the communications card is preferably and substantially within the PCMCIA standards; More room is provided within the communications card for a circuit board and components; and, The components which carry electrical current from the communications line are shielded from contact with structures in the surrounding environment thus preventing the contacts from being inadvertently shorted together or shorted to ground or conveying current to a human being.

Figure 35:
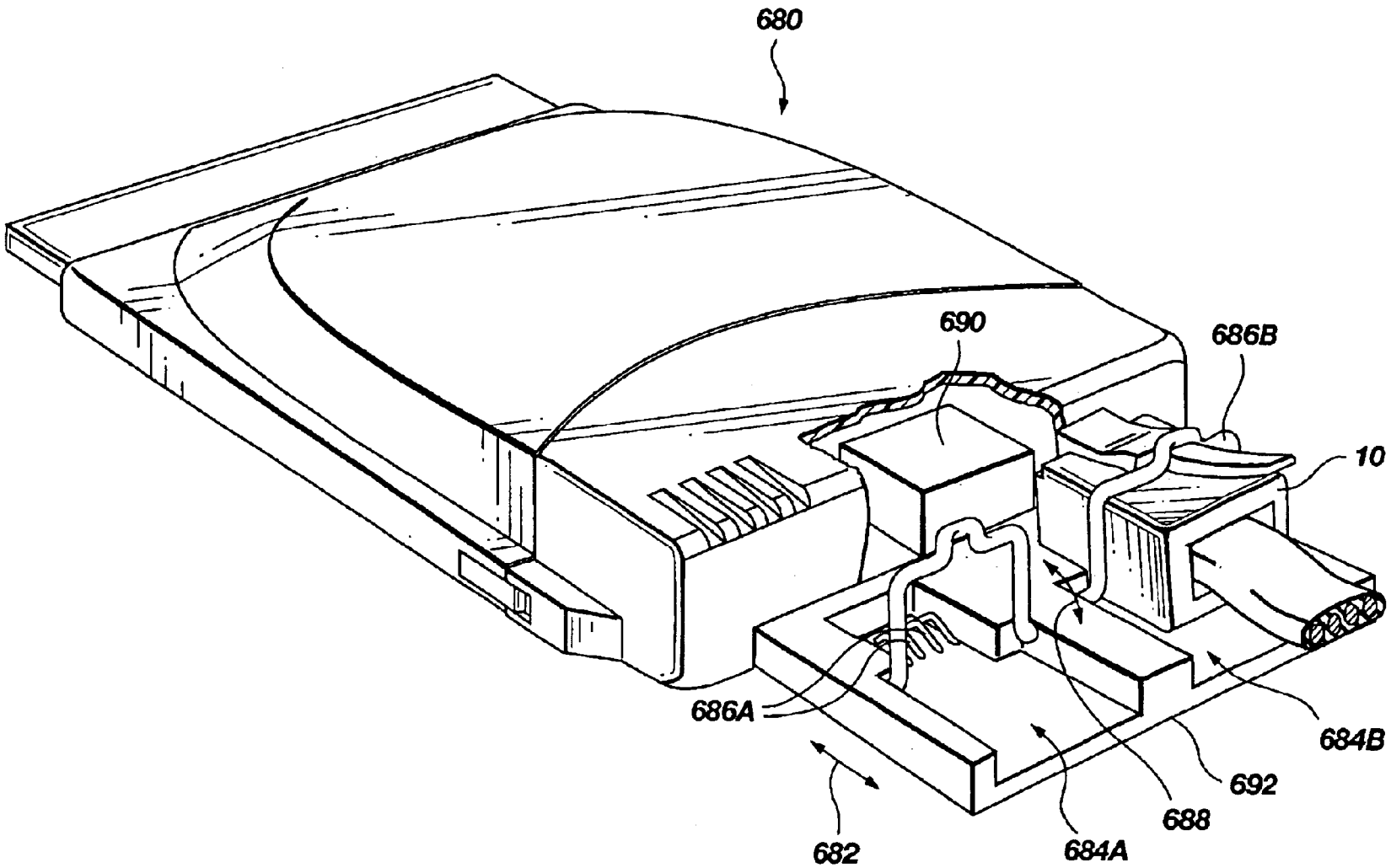
FIG. 35 is a perspective view of a communications card in accordance with the present invention which includes a retractable member providing two RJ-xx series receivers with pivoting bails which hold respective RJ-xx series plugs in operative positions.

Reference will next be made to FIG. 35 which is a perspective view of a communications card, generally indicated at 680, in accordance with the present invention. The communications card 680 includes a retractable receiver member 692 which provides two RJ-xx series receivers, generally indicated at 684A&B. Each of the receivers 684A&B are provided with pivoting bails 686A&B which pivot in the directions of arrow 688. The pivoting bails 686A&B, when in the position represented in FIG. 35, engage the biased clip and the body of the RJ plug and hold the RJ plug in an operative position so that the conductors, one set of which is represented at 686A, engage the corresponding contacts provided on the RJ plug. The receiver member 692 retracts into, and extends from, the communications card 680 in the directions of arrow 682. The components housed within the communications card 680 which allow electrical continuity to be maintained with the conductors 686A as the receiver member is retracted and extended are represented at box 690.

Figure 35A:
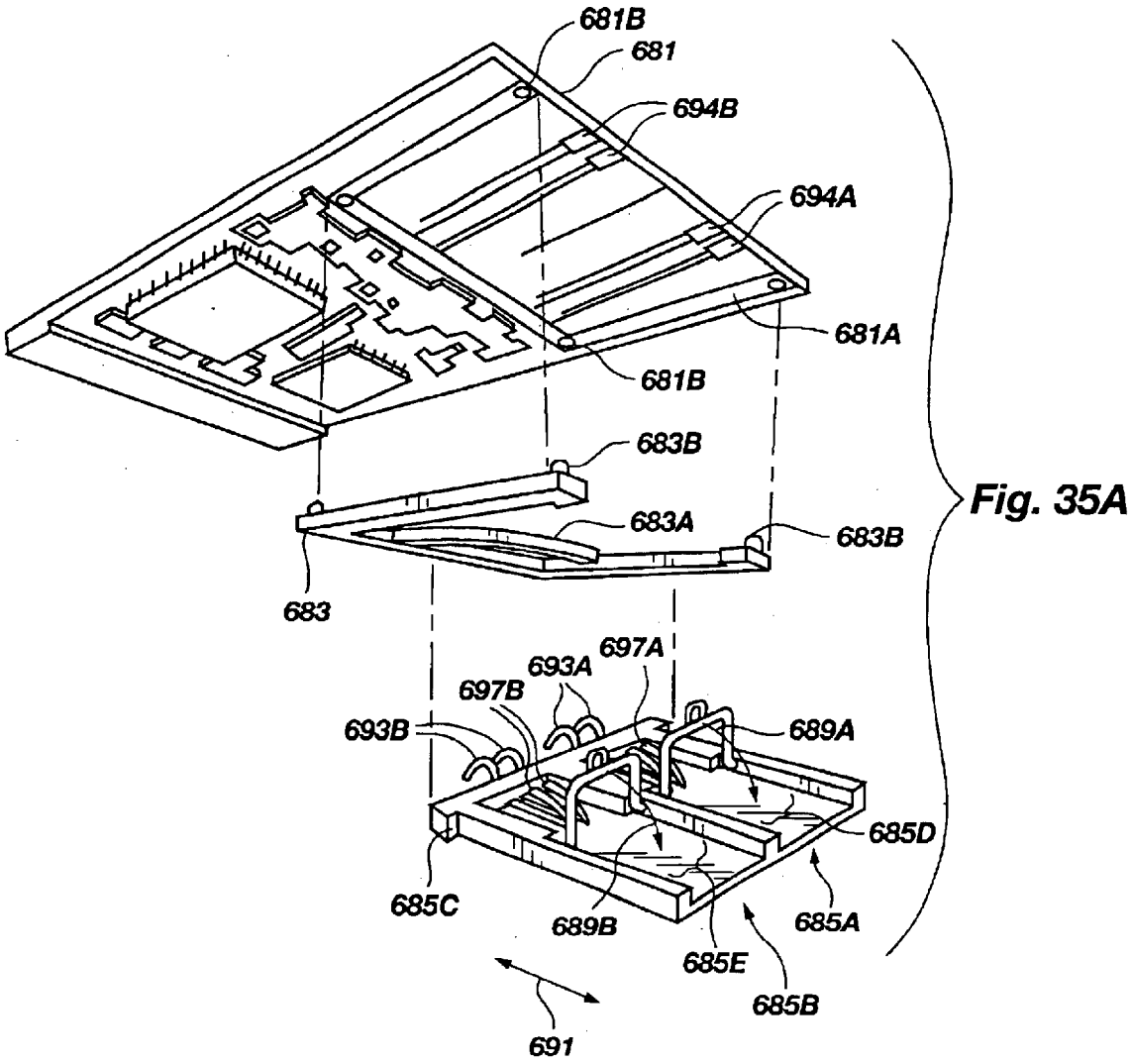
FIG. 35A is an exploded perspective view of a communications card similar to the communications card represented in FIG. 35 showing principal components included therein.
Figure 35B:
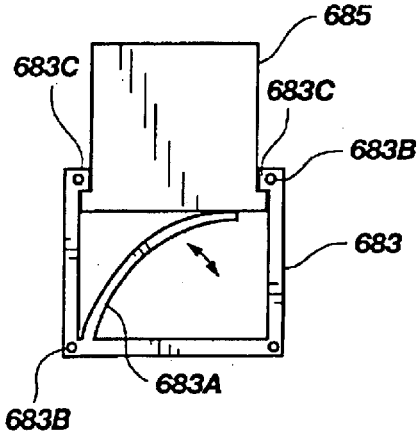
FIG. 35B is a top cross sectional view of a portion of the internal construction of the communications card represented in FIG. 35A.

Reference will next be made to FIG. 35A which is an exploded perspective view of a communications card similar to the communications card 680 represented in FIG. 35 showing principal components included therein. In the exploded view of FIG. 35A a circuit board receives a guide rail 683. Posts 683B on the guide rail 683 are received into corresponding recesses 681B in the circuit board 681. The footprint of the guide rail 683 on the circuit board is represented by the shaded area 681A. The guide rail includes a biasing mechanism such as a live hinge 683A (see also FIG. 35A) which functions to bias a socket bed 685 toward the end of the circuit board 681 and out of the housing (not represented in FIGS. 35A–D) of the communications card (also not represented in FIGS. 35A–D). The travel of the socket bed 685 toward the end of the circuit board is limited by corresponding stops 685C provided on the socket bed 685 and stops 683C provided on the guide rail 683 (see also FIG. 35B). As shown best in FIG. 35A, the socket bed 685 stops precisely where both contact prongs 693A&B will rest upon contact pads 694A&B, respectively, on the circuit board 681 so that the necessary signal path is established between the components on the circuit board 681 and RJ plug contacts 697A&B (see FIG. 35C) as the socket bed 685 slides to the extended most limit of the directions of arrow 691.

The socket bed 692 provides two RJ-xx series receptacles, generally indicated at 685A&B. Each of the two RJ-xx series receptacles 685A and 685B includes a socket 685D and 685E, respectively, which each closely receive an RJ-xx series plug. The sockets 685D&E are each provided with pivoting bails 687A&B which pivot in the directions of arrow 689A. The pivoting bails 687A&B, when in the position represented in FIG. 35A, engage the biased clip and the body of the RJ plug and hold the RJ plug in an operative position so that the RJ conductors 697A&B engage the corresponding contacts provided on the RJ plug. The socket bed 685 retracts into, and extends from, the guide rails 683, and thus the communications card, in the directions of arrow 691.

Figure 35C:
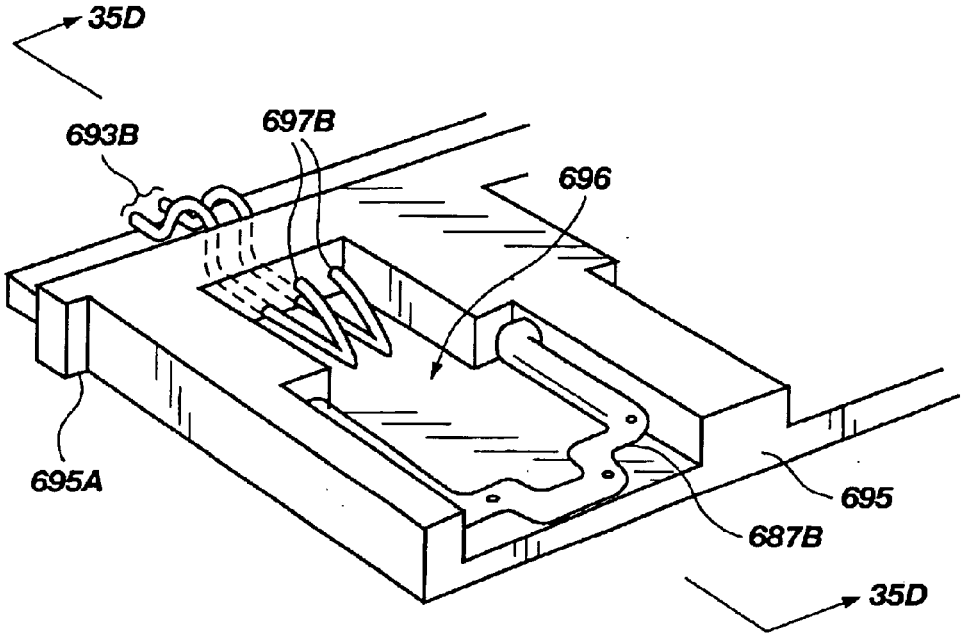
FIG. 35C is a detailed perspective view of the plug receiving portion which can be used in a communications card such as that represented in FIG. 35A.
Figure 35D:
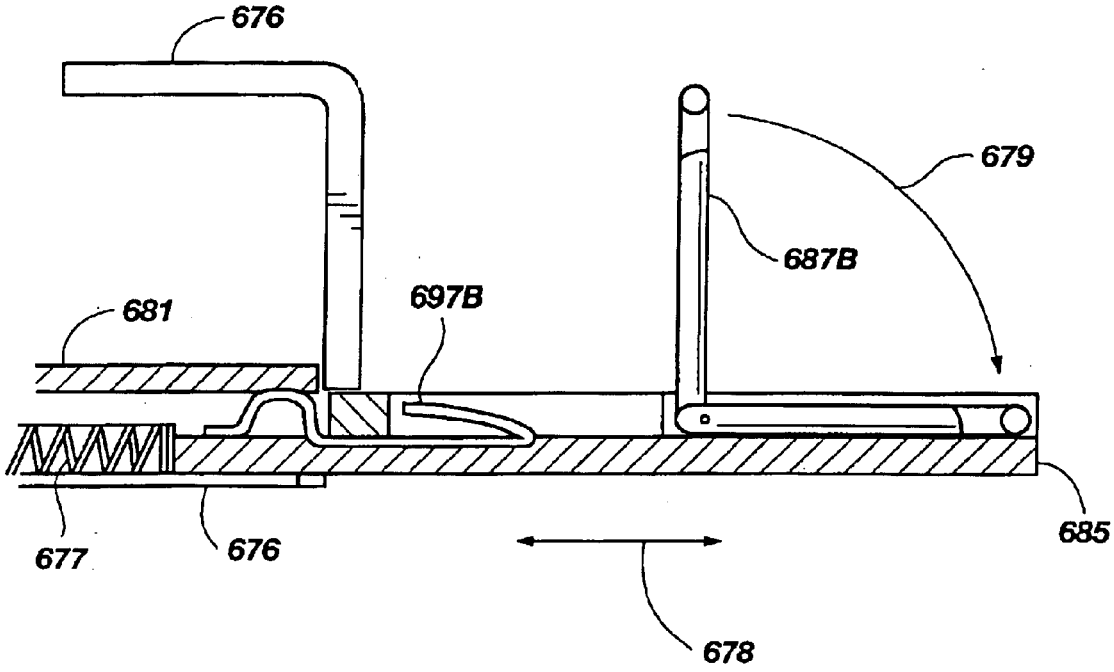
FIG. 35D is a elevated cross sectional view of plug receiving portion taken along line 35D—35D of FIG. 35C.

When an RJ plug is not connected, the bails assume the position illustrated in FIG. 35C and the socket bed 695 is retracted into the guide rail 683 (see FIG. 35A). FIG. 35D is an elevated cross sectional view of the socket bed 695 and the bail 687B showing the bail in both an open and a closed configuration. FIG. 35D also shows the relationship between the socket bed 695 and the circuit board 681 and the housing 676 of the communications card. Those skilled in the art can arrive at other structures for incorporation into the structures described herein to provide additional features or to enhance features already described or present. FIG. 35D also includes a representation of a spring 677 which can be used as a biasing mechanism in place of the live hinge 683A (see FIGS. 35A–B).

It will be appreciated by those skilled in the art that the embodiments of the present invention represented in FIGS. 35A–D, as well as other figures set forth herein, provide structures and methods for making operative connection between one or more RJ plugs and a communications card which does not require excessive space inside of the communications card to be devoted to empty space reserved to receive an RJ plug thus allowing more space to be devoted to electronic components.

In view of the foregoing, it will be appreciated that the present invention provides many different communications line receptacles for use with a miniaturized communications device wherein the electrical contacts are shielded from the surrounding environment and which is resistant to breakage and which can be moved out of the way when not being used. The present invention also provides communications line receptacles which are easily replaceable if broken. Moreover, the embodiments of the present allow more space within the communications card to be devoted to other components, such as active electrical components. The present invention also provides communications cards which can be readily adapted to meet various communications standards and which can provide wireless communications. Furthermore, the present invention also provides that one or more RJ-xx series plugs can be connected to a communications card while the external dimensions of the communications card meet an established standard when the card is not being used and also such that the communications line receptacles occupy minimal space in the communications card.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured is:

1. A communications card to be used in a data utilization device and to receive an RJ-xx series plug having a biased clip including an engagement ridge, and to make electrical connection with at least first and second electrical contacts provided on the plug, the communications card comprising:

a face having a dimension that follows a PCMCIA Type III standard;

a recess in the face of the card to receive the RJ-xx series plug, the recess being oriented such that a direction the RJ-xx plug travels if being inserted into the recess is substantially parallel to two larger surfaces of the card;

a plurality of electrical conductors in the recess positioned to make contact with the first and the second electrical contacts respectively of the RJ-xx plug if the plug is received in the recess; and a channel extending through a wall of the recess to form an opening to hold the biased clip of the RJ-xx plug if the plug is received in the recess, the channel including an edge to engage the engagement ridge of the clip of the RJ-xx series plug.

2. The communications card of claim 1, further comprising a note book sized lap top containing a Flash memory and a PCMCIA slot having the card inserted therein.

3. The communications card of claim 1, wherein the opening comprises a T-shaped cutout in the wall of the recess.

4. The communications card of claim 3, wherein the T-shaped cutout includes a first portion running from the face of the card in which the recess is located in a direction substantially perpendicular to the face, for receiving the arm of the clip of an RJ-xx series plug and a second portion substantially perpendicular to the first portion, the second portion including the edge for engaging the engagement ridge of the clip of an RJ-xx series plug.

5. The communications card of claim 1, further comprising a cover overlying the opening.

6. The communications card of claim 5, further comprising the cover including an elastic material.

7. The communications card of claim 1, further comprising a component to provide wireless communication.

8. The communications card of claim 7, wherein the component comprises an auxiliary connector to connect to a cellular telephone.

9. The communications card of claim 1, further comprising a retractable shell, the retractable shell including an upper member containing the opening and a lower member slidably joined to the upper member to slide away from the upper member to form the recess if the plug is inserted between the upper member and the lower member.

10. The communications card of claim 1, further comprising an extendable and retractable shell member to extend to form the recess, the shell member including the wall having the opening therein.

11. The communications card of claim 10, further comprising a flexible connector coupled with the electrical conductors in the recess to flex to maintain electrical connection if the shell member is extended and retracted.

12. The communications card of claim 10, wherein the flexible connector comprises a ribbon cable.

13. The communications card of claim 1, further comprising a pivotable cover to pivot about an axis parallel to the face of the card to an open position to uncover the recess and to a closed position to cover the recess, the pivotable cover including the wall having the opening formed therein.

14. The communications card of claim 13, further comprising a finger pull on the pivotable cover.

15. The communications card of claims 14, further comprising a moveable plug bail coupled with the pivotable cover to engage a portion of the biased clip if the pivotable cover is moved into a position in which the recess is uncovered and if the plug is inserted into the recess.

16. A communications card to be used in a data utilization device and to receive an RJ-xx series plug having a biased clip and to make electrical connection with at least first and second electrical contacts provided on the plug, the communications card comprising:

a height and a length compliant with PCMCIA standards for a Type III card;

a first surface, the first surface forming an outer surface of the card;

a first end;

a recess provided at the first end, the recess having dimensions such that the plug is closely received therein, the recess being oriented such that a direction the RJ-xx series plug travels if inserted into the recess is substantially parallel to the first surface and substantially perpendicular to the first end;

a first electrical conductor provided in the recess, the first electrical conductor being positioned to make electrical continuity with the first electrical contact if the plug is received into the recess;

a second electrical conductor provided in the recess, the second electrical conductor being positioned to make electrical continuity with the second electrical contact if the plug is received into the recess;

a conductor to convey an electrical signal present on the first and the second electrical contacts to the data utilization device; and a biased clip receiving structure adjacent to the recess, the biased clip receiving structure shaped to receive the biased clip if the plug is inserted into the recess and to hold the biased clip and the plug in operative engagement in the recess, wherein the biased clip receiving structure includes an opening in a wall of the recess.

17. The communications card of claim 16, further comprising a cover overlying the opening.

18. The communications card of claim 17, wherein the cover has a thickness from about 0.001 inch to about 0.050 inches.

19. The communications card of claim 18, further comprising the cover including an elastic material.

20. The communications card of claim 17, further comprising the cover straddling at least a portion of the first surface of the communications card.

21. The communications card of claim 16, wherein the opening comprises a T-shaped cutout.

22. The communications card of claim 16, further comprising a component to provide wireless communication.

23. The communications card of claim 22, wherein the component comprises an auxiliary connector to connect to a cellular telephone.

24. The communications card of claim 16, further comprising a retractable shell, the retractable shell including an upper member containing the opening and a lower member slidably joined to the upper member to slide away from the upper member to form the recess if the plug is inserted between the upper member and the lower member.

25. The communications card of claim 16, further comprising an extendable and retractable shell member to extend to form the recess, the shell member including the wall having the opening therein.

26. The communications card of claim 25, further comprising a flexible connector coupled with the electrical conductors in the recess to flex to maintain electrical connection if the shell member is extended and retracted.

27. The communications card of claim 26, wherein the flexible connector comprises a ribbon cable.

28. The communications card of claim 16, further comprising a pivotable cover to pivot about an axis parallel to the end of the card to an open position to uncover the recess and to a closed position to cover the recess, the pivotable cover including the wall having the opening formed therein.

29. The communications card of claim 28, further comprising a finger pull on the pivotable cover.

30. The communications card of claim 29, further comprising a moveable plug bail coupled with the pivotable cover to engage a portion of the biased clip if the pivotable cover is moved into a position in which the recess is uncovered and if the plug is inserted into the recess.

31. The communications card of claim 16, wherein the communications card substantially complies with the PCMCIA standards for a Type III card.

32. The communications card of claim 16, further comprising:

a second surface, the second surface being substantially parallel to the first surface and forming upper and lower surfaces of the communications card;

second recess means provided at the first end, the second recess means having dimensions such that a second RJ-xx plug is closely received therein, the second recess means being oriented such that the plug is received therein both between and parallel to the first and second surfaces;

a third electrical conductor provided in the second recess means, the third electrical conductor being positioned such that it makes electrical continuity with a first electrical contact in the second plug when the second plug is received by the second recess means;

a fourth electrical conductor provided in the second recess means, the fourth electrical conductor being positioned such that it makes electrical continuity with a second electrical contact in the plug when the plug is received by the second recess means;

means for conveying an electrical signal present on the first and second electrical contacts to the communications card; and a second biased clip receiving structure adjacent to the second recess means, the second biased clip receiving structure shaped to receive the biased clip when the RJ plug is inserted into the second recess means.

33. An apparatus to be used in a host system having a PCMCIA Type III standard slot, the apparatus comprising:

a housing having longitudinal sides, a front end and a rear portion, at least the rear portion of the housing having a thickness conforming substantially to a thickness of a PCMCIA Type III standard;

a connector at the front end of the housing adapted to be received by a corresponding connector within the slot of the host system, the connector being electrically connected to a first conductor to convey an electrical signal present on the corresponding connector to the apparatus;

at least one recess, the at least one recess being defined at the rear portion of the housing, the at least one recess being sized and configured to receive an RJ-type plug if the plug is inserted into the at least one recess in a direction substantially perpendicular to the front end;

a plurality of contact wires located in the at least one recess, each of the contact wires being shaped and positioned to engage a corresponding contact on the RJ-type plug, the contacts on the RJ-type plug to engage the contact wires in the at least one recess if the plug is inserted into the recess, each of the contact wires being electrically connected to a second conductor to convey an electrical signal present on the electrical contacts to the apparatus; and a cutout in a wall of the at least one recess to receive a biased clip of the plug if the plug is inserted into the recess and to hold the biased clip and the plug in operative engagement in the recess.

34. The apparatus of claim 33, further comprising a note book sized lap top containing a Flash memory and a PCMCIA slot having the card inserted therein.

35. The apparatus of claim 33, wherein the cutout comprises a T-shaped cutout.

36. The apparatus of claim 33, further comprising a cover including an elastic material overlying the cutout.

37. The apparatus of claim 33, further comprising an auxiliary connector at the rear portion of the housing, the auxiliary connector to connect to a cellular telephone.

38. The apparatus of claim 33, further comprising a retractable shell, the retractable shell including an upper member containing the cutout and a lower member slidably joined to the upper member to slide away from the upper member to form the recess if the plug is inserted between the upper member and the lower member.

39. The apparatus of claim 33, further comprising an extendable and retractable shell member to extend to form the recess, the shell member including the wall having the cutout therein.

40. The apparatus of claim 39, further comprising a flexible connector coupled with the contact wires in the recess to flex to maintain electrical connection if the shell member is extended and retracted.

41. The apparatus of claim 40, wherein the flexible connector comprises a ribbon cable.

42. The apparatus of claim 33, further comprising a pivotable cover to pivot about an axis parallel to an end of the card to an open position to uncover the recess and to a closed position to cover the recess, the pivotable cover including the wall having the cutout formed therein.

43. The apparatus of claim 42, further comprising a finger pull on the pivotable cover.

44. The apparatus of claim 43, further comprising a moveable plug bail coupled with the pivotable cover to engage a portion of the biased clip if the pivotable cover is moved into a position in which the recess is uncovered and if the plug is inserted into the recess.

45. An apparatus comprising:

a lap top including a Flash memory and a PCMCIA slot;

a communications card in the PCMCIA slot, the communication card to receive an RJ-xx series plug having a biased clip including an engagement ridge, and to make electrical connection with at least first and second electrical contacts provided on the plug, the communications card including:

a face having a dimension that follows a PCMCIA Type III standard;

a recess in the face of the card to receive the RJ-xx series plug, the recess being oriented such that a direction the RJ-xx plug travels if inserted into the recess is substantially parallel to two larger surfaces of the card;

a plurality of electrical conductors in the recess positioned to make contact with the first and the second electrical contacts respectively of the RJ-xx plug if the plug is received in the recess; and a channel extending through a wall of the recess to form an opening to hold the biased clip of the RJ-xx plug if the plug is received in the recess, the channel including an edge to engage the engagement ridge of the clip of the RJ-xx series plug.

46. The apparatus of claim 45, wherein the opening comprises a T-shaped cutout in the wall of the recess.

47. The apparatus of claim 45, further comprising a cover overlying the cutout.

48. The apparatus of claim 47, further comprising an elastic material of the cover.

49. The apparatus of claim 45, further comprising a component to provide wireless communication.

50. The apparatus of claim 49, wherein the component comprises an auxiliary connector to connect to a cellular telephone.

51. The apparatus of claim 45, further comprising a retractable shell, the retractable shell including an upper member containing the opening and a lower member slidably joined to the upper member to slide away from the upper member to form the recess if the plug is inserted between the upper member and the lower member.

52. The apparatus of claim 45, further comprising an extendable and retractable shell member to extend to form the recess, the shell member including the wall having the opening therein.

53. The apparatus of claim 52, further comprising a flexible connector coupled with the electrical conductors in the recess to flex to maintain electrical connection if the shell member is extended and retracted.

54. The apparatus of claim 53, wherein the flexible connector comprises a ribbon cable.

55. The apparatus of claim 45, further comprising a pivotable cover to pivot about an axis parallel to the face of the card to an open position to uncover the recess and to a closed position to cover the recess, the pivotable cover including the wall having the opening formed therein.

56. The apparatus of claim 55, further comprising a finger pull on the pivotable cover.

57. The apparatus of claim 56, further comprising a moveable plug bail coupled with the pivotable cover to engage a portion of the biased clip if the pivotable cover is moved into a position in which the recess is uncovered and if the plug is inserted into the recess.

* * * * *